US005101979A

United States Patent [19]

Uno et al.

[11] Patent Number: 5,101,979

[45] Date of Patent: Apr. 7, 1992

[54] PAPER SHEET DEPOSITING AND DISPENSING APPARATUS, ABNORMALITY RECOVERY PROCESS OF THE PAPER SHEET DEPOSITING AND DISPENSING APPARATUS, AND AUTOMATIC CASHIER

[75] Inventors: Motoo Uno; Masuo Furutono; Mitsuyoshi Satoo, all of Ibaraki; Kenji Taguchi, Shibata; Toshio Ogata, Niigata; Akihisa Ueda, Shibata; Hiroshi Kitahata, Niigata, all of Japan

[73] Assignee: Hitachi, Ltd., Tokyo, Japan

[21] Appl. No.: 376,867

[22] Filed: Jul. 7, 1989

[30] Foreign Application Priority Data

Jul. 8, 1988 [JP] Japan ..... 63-168736
Sep. 5, 1988 [JP] Japan ..... 63-220353

[51] Int. Cl.[5] ..... B07C 5/38; B65H 53/32; G07D 7/00

[52] U.S. Cl. ..... 209/534; 235/379; 414/796; 414/796.9; 414/907; 902/12

[58] Field of Search ..... 209/534; 235/379; 414/792.9, 796, 796.9, 907; 901/47; 902/11, 12

[56] References Cited

U.S. PATENT DOCUMENTS

| | | | |
|---|---|---|---|
| 3,391,806 | 7/1968 | Geis et al. | 414/796 X |
| 3,966,059 | 6/1976 | Sase | 414/796 |
| 4,055,258 | 10/1977 | Schneider | 414/796 |
| 4,551,053 | 11/1985 | Ishibashi | 414/907 X |
| 4,620,827 | 11/1986 | Sameshima et al. | 414/796 |
| 4,820,909 | 4/1989 | Kawauchi et al. | 235/379 |
| 4,884,698 | 12/1989 | Tutamune et al. | 209/534 |
| 5,019,249 | 5/1991 | Sugai et al. | 209/534 |

FOREIGN PATENT DOCUMENTS

| | | | |
|---|---|---|---|
| 60-137738 | 7/1985 | Japan . | |
| 61-188342 | 8/1986 | Japan | 414/796 |
| 61-291370 | 12/1986 | Japan . | |
| 62-244832 | 10/1987 | Japan | 414/796.9 |

*Primary Examiner*—Michael S. Huppert
*Assistant Examiner*—Edward M. Wacyra
*Attorney, Agent, or Firm*—Antonelli, Terry, Stout & Kraus

[57] ABSTRACT

A paper sheet handling apparatus including a plurality of sheet accumulating portions and a sheet conveyor. A pointed separator is mounted on the conveyor for movement into a stack of paper sheets accumulated in one sheet accumulating portion to divide the stack into two parts with a gap formed therebetween. Gripping fingers mounted on the conveyor are moved into gripping engagement with one of the divided parts of the stack and then retracted to transfer the gripped part of the stack onto the conveyor. Holding members on the conveyor are movable into the gap to hold the paper sheets of the other part of the stack. The conveyor is movable to convey the gripped paper sheets to another sheet accumulating portion. The gripping fingers are again moved to transfer the thus conveyed sheets to the other sheet accumulating portion. Sensors are mounted on the conveyor to determine whether or not the paper sheets to be transferred are directly positioned relative to the sheet transferring members of the sheet accumulating portions and, if not correctly positioned, corrective action is effected in response to the determined incorrect positioning.

26 Claims, 42 Drawing Sheets

○ LIGHT TRANSMITTED
● LIGHT SHIELD
⊖ LIGHT SHIELD → LIGHT TRANSMITTED

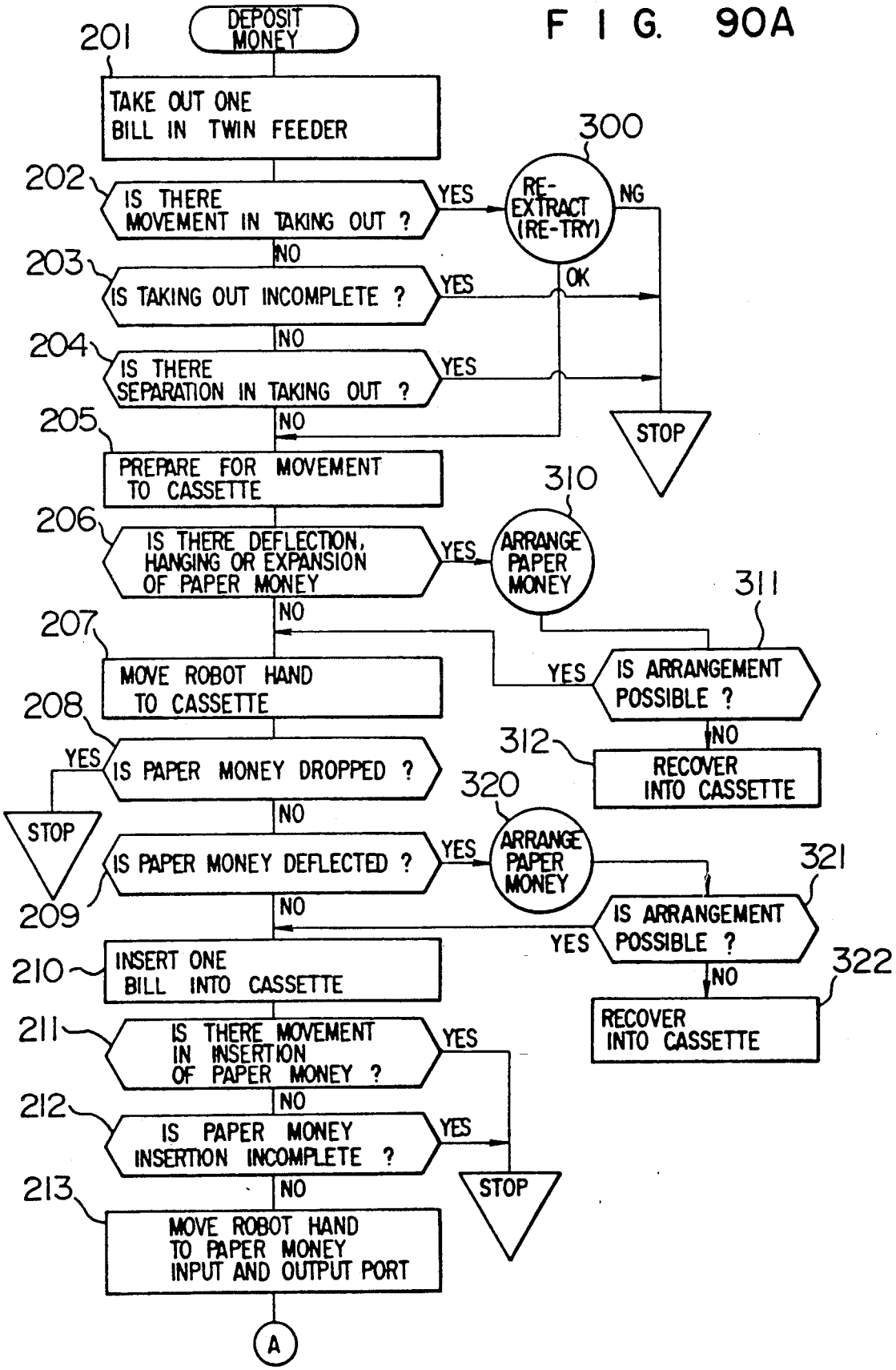
FIG. 90A
DEPOSIT MONEY
201
TAKE OUT ONE BILL IN TWIN FEEDER
202
IS THERE MOVEMENT IN TAKING OUT ?
YES
NO
300
RE-EXTRACT (RE-TRY)
NG
OK
203
IS TAKING OUT INCOMPLETE ?
YES
NO
204
IS THERE SEPARATION IN TAKING OUT ?
YES
NO
STOP
205
PREPARE FOR MOVEMENT TO CASSETTE
206
IS THERE DEFLECTION, HANGING OR EXPANSION OF PAPER MONEY
YES
NO
310
ARRANGE PAPER MONEY
311
IS ARRANGEMENT POSSIBLE ?
YES
NO
312
RECOVER INTO CASSETTE
207
MOVE ROBOT HAND TO CASSETTE
208
IS PAPER MONEY DROPPED ?
YES
NO
STOP
209
IS PAPER MONEY DEFLECTED ?
YES
NO
320
ARRANGE PAPER MONEY
321
IS ARRANGEMENT POSSIBLE ?
YES
NO
322
RECOVER INTO CASSETTE
210
INSERT ONE BILL INTO CASSETTE
211
IS THERE MOVEMENT IN INSERTION OF PAPER MONEY ?
YES
NO
212
IS PAPER MONEY INSERTION INCOMPLETE ?
YES
NO
STOP
213
MOVE ROBOT HAND TO PAPER MONEY INPUT AND OUTPUT PORT
A

F I G. 92

| SENSOR(S) | DETECTION OF ABNORMALITY WHEN PAPER MONEY IS SENT AND RECIEVED FROM OPERATING COMPONENT | | | DETECTION OF ABNORMALITY OF PAPER MONEY | | | | |
|---|---|---|---|---|---|---|---|---|
| | PAPER MONEY INPUT AND OUTPUT PORT | COUNTER STACKER TWIN FEEDER | CASSETTE | DEFLECTION | | HANGING AND EXPANSION | DROPPING | SEPARATION |
| | | | | LATERAL DEFLECTION | REARWARD DEFLECTION | | | |
| SENDING AND RECEIVING SENSOR (10-a, 10-b) | ○ NO MOVEMENT INCOMPLETE | ○ NO MOVEMENT INCOMPLETE | ○ NO MOVEMENT INCOMPLETE | — | — | — | ○ | ○ |
| LATERAL DEFLECTION SENSOR (10-c, 10-d) | DEFLECTED AT TAKING OUT | DEFLECTED AT INSERTION | DEFLECTED AT INSERTION | — | — | — | — | — |
| LATERAL DEFLECTION SENSOR (10-e, 10-f) | — | — | — | ○ | ○ | — | — | — |
| REARWARD DEFLECTION SENSOR (10-g, 10-h) | — | — | — | — | — | — | — | — |
| HANGING AND EXPANSION DETECT SENSOR (10-i, 10-j, 10-k) | — | — | — | — | — | ○ | — | — |

FIG. 93

| | | PAPER MONEY INPUT AND OUTPUT PORT | COUNTER | CASSETTE | ROBOT HAND | |
|---|---|---|---|---|---|---|
| ROBOT HAND | SEND TO COOPERATING SIDE | NO MOVEMENT<br>--→STOP<br>INCOMPLETE<br>--→RETRY<br>--→STOP<br>DEFLECTION<br>--→ARRANGE<br>--→SEND | NO MOVEMENT<br>--→STOP<br>INCOMPLETE<br>--→STOP<br>DEFLECTION<br>--→ARRANGE<br>--→SEND | NO MOVEMENT<br>--→STOP<br>INCOMPLETE<br>--→STOP<br>DEFLECTION<br>--→ARRANGE<br>--→SEND | VERTICAL MOVEMENT | DEFLECTION<br>--→ARRANGE<br>FALLING<br>--→STOP |
| | RECEIVES FROM COOPERATING SIDE | NO MOVEMENT<br>SEPARATION<br>INCOMPLETE<br>--→<br>DEFLECTION<br>--→RETURN IMMEDIATELY | NO MOVEMENT --→RETRY<br>--→STOP<br>SEPARATION ----→STOP<br>INCOMPLET<br>→TO PAPER MONEY INPUT AND OUTPUT PORT (INPUT MONEY REJECT)<br>→RECOVER (INPUT PAPER MONEY)<br>→STOP (OUTPUT MONEY) | NO MOVEMENT<br>--→RETRY<br>--→STOP<br>SEPARATION<br>--→STOP<br>INCOMPLETE<br>--→RECOVERY (OUTPUT PAPER MONEY) | | HANGING·EXPANSION<br>--→ARRANGE |

PAPER SHEET DEPOSITING AND DISPENSING APPARATUS, ABNORMALITY RECOVERY PROCESS OF THE PAPER SHEET DEPOSITING AND DISPENSING APPARATUS, AND AUTOMATIC CASHIER

BACKGROUND OF THE INVENTION

1. Field of the Invention

The present invention relates to a paper sheet depositing and dispensing apparatus and, more particularly, to a paper sheet and/or depositing and dispensing apparatus such as, for example, an automatic cashier or automatic teller machine.

2. Description of the Prior Art

A conventional paper sheet depositing and dispensing apparatus, for example, a paper sheet depositing and dispensing apparatus disclosed in Japanese Patent Unexamined Publication No. 60-137738 or an apparatus disclosed in Japanese Patent Unexamined Publication No. 61-291370 comprises a conveying means for collectively conveying a plurality of paper sheets between the paper sheet accumulating portion and the accommodating portion and a paper sheet separating means for separating a predetermined number of sheets from the accommodating portion so that the paper sheets are collectively supplied from the accumulating portion to the conveying means.

A disadvantage of the above-described conventional apparatuses resides in the fact that the overall size of the apparatus cannot be reduced since the paper sheet separating means or the accommodating means must be provided in the paper sheet accumulating portion. Furthermore, the conventional apparatuses are constructed to hold the paper sheets regardless of the state of the paper sheets to be sent and received between the components in the apparatus and the holding means. Therefore, if the paper sheet is held by the holding means in an any abnormal state, an operation error is generated during the paper sheet sending and receiving actions due to this abnormal state of the paper sheet leading to the stop of the operation of the apparatus thereby reducing the operational efficiency of the apparatus.

SUMMARY OF THE INVENTION

An object of the present invention is to reduce the overall size of an apparatus by providing a means for separating a predetermined number of paper sheets from a paper sheet accumulating portion for a holding and conveying means.

Another object of the present invention is to reduce the rate of malfunctions in operation of the apparatus by detecting the abnormality in sending and receiving paper sheets by the holding means and by performing a recovery action in response to the type of the detected abnormality.

A further object of the present invention is to reduce the overall size of an automatic cashier by reducing the size of the holding and conveying means for collectively holding and conveying paper sheets.

The apparatus according to the present invention is arranged in such a manner that holding means, forming a conveying means for collectively holding and conveying a plurality of paper sheets, is provided with a paper sheet separating means for separating a predetermined number of paper sheets such as, for example, paper money, from the paper sheets accumulated in a paper sheet accumulating portion and paper sheet accommodating portion for accommodating a predetermined number of paper sheets in the paper sheets accumulated in the paper sheet accumulating portion. A detection means detects the state of the paper sheets held by the holding means whereby the type of the abnormality of paper sheets such as, for example, positional deflection, expansion, hanging and the like can be detected. Means are provided for effecting an abnormality recovery action necessary to maintain operational integrity of the apparatus in response to the detected abnormality and position of the abnormality.

According to such an apparatus, the paper money separating means projects into the accumulated paper sheet group and forms a gap at a predetermined position in the stacked sheets. Then, the paper sheet holding member projects into the thus-formed gap so as to hold and convey a predetermined number of sheets of paper money. Furthermore, the paper money accommodating means holds an accumulated paper sheet group so as to form an accommodating space, and the holding member projects into the thus-formed accommodating space so as to accommodate the held and conveyed paper money.

Since the detection means, fastened to the holding means, is disposed to surround the paper sheets for the purpose of detecting the state of the paper sheets held by the holding means, the lateral (right and left directions) and longitudinal deflections of the paper sheets can be detected. In addition, since the detection means is provided at both the lower and the upper portions of the holding means, the hanging and expansion of the paper sheets can be detected. As described above, since the state of the abnormality of the paper sheets can be detected, the rate of operational malfunctions of the apparatus can be decreased by enabling a performance of the proper recovery action in response to the detected abnormality.

BRIEF DESCRIPTION OF THE DRAWINGS

FIGS. 90A and 90B are flowcharts of the abnormality recovery action in the money input action;

FIG. 92 is a table which illustrates types of abnormalities;

FIG. 93 is a view which illustrates the abnormality recovery process;

DESCRIPTION OF THE PREFERRED EMBODIMENT

Figure 1:
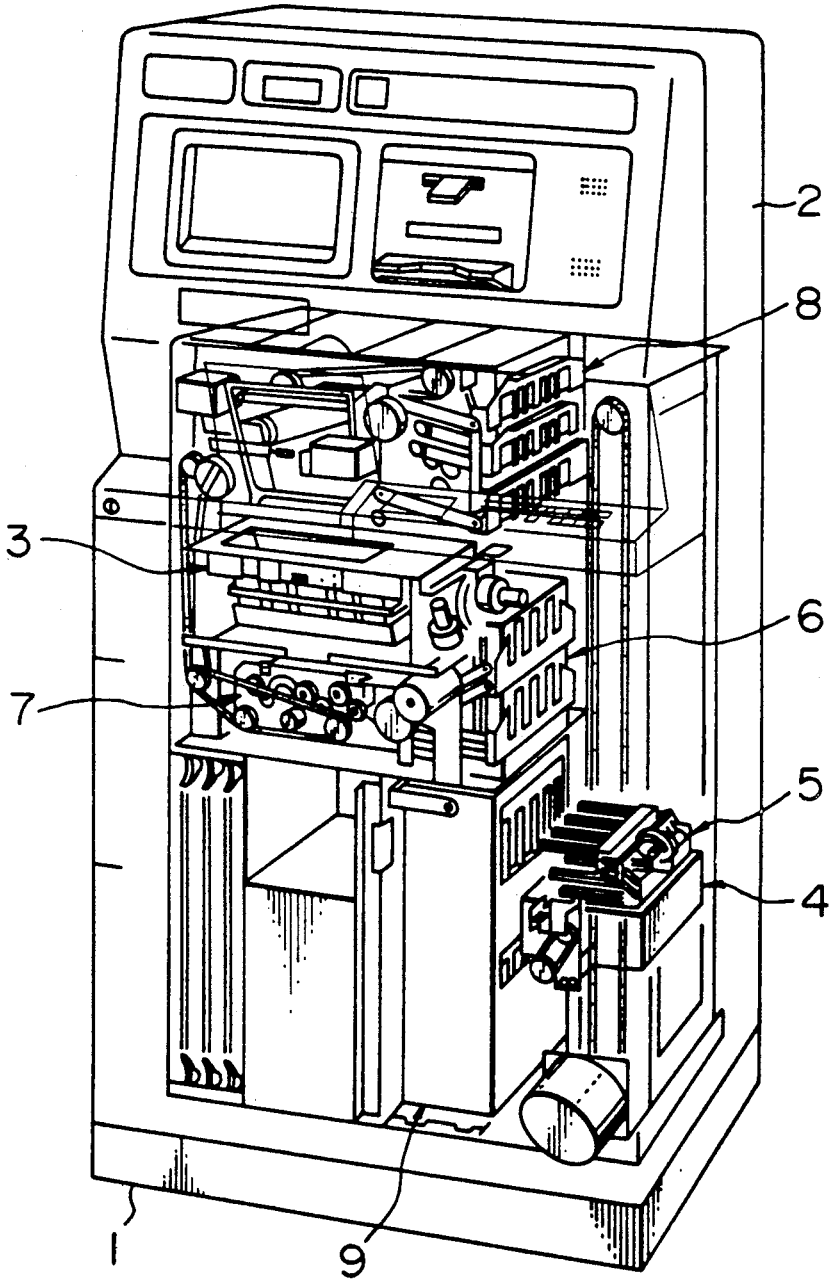
FIG. 1 is a perspective view of an embodiment of an automatic cashier according to the present invention.

Referring now to the drawing wherein like reference numerals are used throughout the various views to designate like parts and, more particularly, to FIG. 1, according to this figure, an automatic cashier includes a money input and output portion 3, a lift 4, and a holding means 5 which form a paper money conveying means, a paper money separating portion 6, a discriminating portion 7, a third accumulating portion 8, and a cash box 9 provided in a case disposed on a frame 1.

Figure 2:
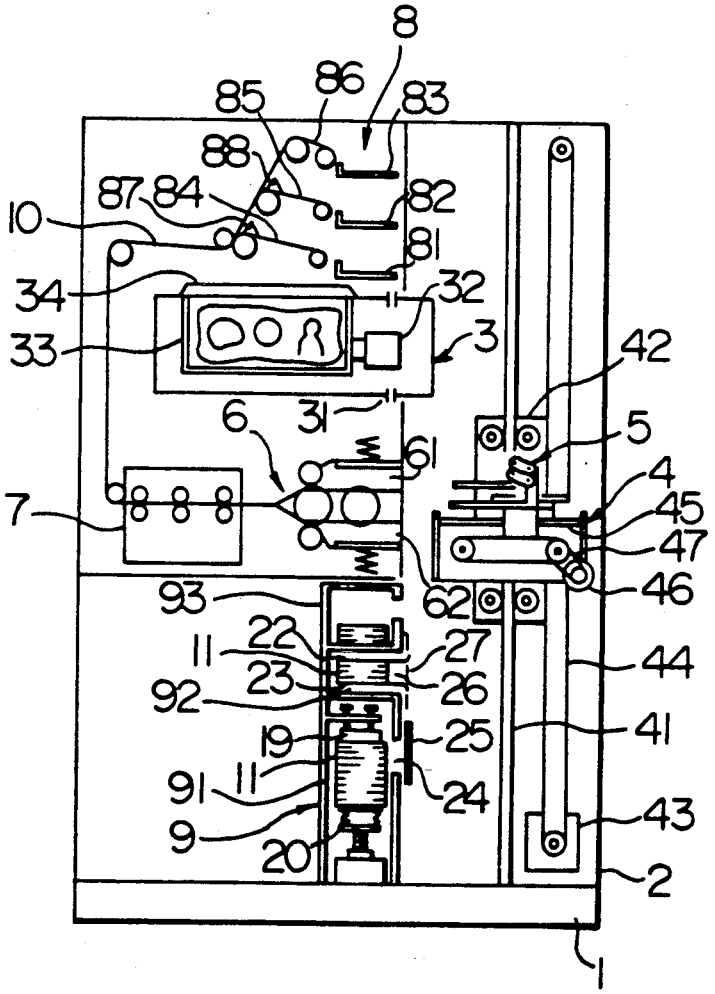
FIG. 2 is a schematic view of the automatic cashier of FIG. 1.

As shown in FIG. 2, the money input and output portion 3 comprises a fourth accumulating portion 33 arranged to be moved by a first motor 32 and an money input and output port 34 so that this money input and output portion 3 can rotate relative to a shaft 31 for the purpose of being positioned to confront the front surface of the case 2 and the holding means 5. The lift 4, forming a part of the paper money conveying means, is supported by a rail 41 and a car 42 so that it can be raised and lowered within the case 2 by a second motor 43 and a belt 44. The holding means 5, forming another part of the paper money conveying means, is so supported by a rail 45 provided on the lift 4 so as to be moved forward and rearward by a third motor 46 and a belt 47. The paper money separating portion 6 is positioned to confront the holding means 5, with the money separating portion 6 comprising a first accumulating portion 61 and a second accumulating portion 62. The discriminating portion 7, connected to the paper money separating portion 6, acts to discriminate the paper money, with the discriminating portion 7 being disposed in a conveying passage 10 formed between the paper money separating portion 6 and the third accumulating portion 8. The third accumulating portion 8 comprises three stack portions 81, 82 and 83 which are disposed so as to confront the holding means 5. The stack portion 81, connected to a conveying passage 84, is a portion for stacking paper money which has been determined as counterfeit or the money which cannot be discriminated Stack portions 82 and 83 are successively provided above the stack portion 81 and connected to the corresponding passages 85 and 86 so as to stack the corresponding types of the paper money. These passages 84, 85 and 86 are branched from the passage 10, and gates 87 and 88 are respectively disposed at their junctions. The gates 87 and 88 direct the paper money sheets 11 to any of the passages 84, 85 and 86 in response to an instruction issued from the discriminating portion 7. The cash box 9 comprises a first paper money accommodating portion 91 for accommodating paper money sheets 11 to be dispensed and to be utilized in a circulated manner, a second accommodating portion 92 for accommodating paper money sheets 11 to be also dispensed, and a third accommodating portion 93 for accommodating paper money sheets 11 to be rejected and those not to be utilized in the circulated manner.

The first accommodating portion 91 comprises a push plate 19 and a lower plate 20 so that the paper money sheets 11 are held and stacked. The second accommodating portion 92 comprises an upper plate 22 and a separation plate 23 so that the paper money sheets 11 are held and stacked. A paper money input and output port 24, formed in the first paper money accommodating portion 91 is provided with a shutter 25, while a paper money input and output port 26, formed in the second paper money accommodating portion 92, is provided with a shutter 27.

Figure 3:
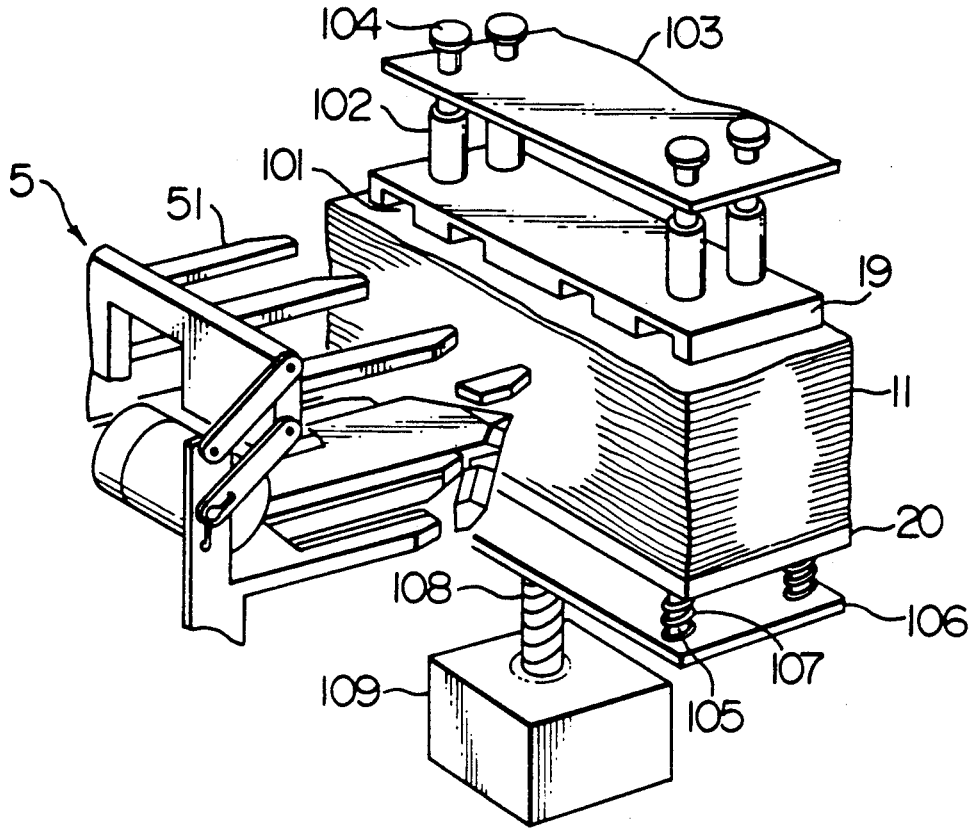
FIG. 3 is perspective view of a first paper money accommodating portion of the cash box of the automatic cashier of the present invention.

As shown in FIG. 3, the first accommodating portion 91 of the cash box 9 includes a push plate 19 comprising a plurality of grooves 101 formed therein, with the push plate 19 being supported by a push-plate support plate 103 and a plurality (four in this embodiment) of stepped shafts 102. A stopper 104 is fastened to the upper portion of each stepped shaft 102 for preventing the separation of the push plate 19 from the push-plate support plate 103. This push-plate support plate 103 is connected to the case for the cash box 9. The positions of the grooves 101 are arranged so as to correspond to the positions of fork-like parallel upper holding fingers 51 of the holding means. The lower plate 20 is supported on a lower-plate drive plate 106 by a plurality (four in this embodiment) of guide shafts 105 formed on the lower surface of the lower plate 20 in such a manner that the thus-supported lower plate 20 can be vertically moved. The end portions of the guide shafts 105 are arranged to be vertically movable with respect to the lower-plate drive plate 106 by a compression spring 107 fitted between the lower plate 20 and the lower-plate drive plate 106. A ball screw 108 is connected to the lower-plate drive plate 106, with the ball screw 108 being capable of moving vertically by the rotation of a fourth motor 109 secured to the case for the cash box 9 for the purpose of moving the lower-plate drive plate 106. As a result, the lower-plate drive plate 106 can be vertically moved. Paper money sheets 11 are accumulated on the lower plate 20, with the lower plate 20 being supported, by compression springs 107, on the vertically movable lower-plate drive plate 106. The push plate 19 is, as described above, suspended from the push-plate support plate 103 by the stepped shafts 102 and the stoppers 104 connected to the upper portions of the stepped shafts 102. Therefore, when the lower plate 20 and stacked paper money sheets 11 are raised by the rotation of the fourth motor 109, the push plate 19 is raised with respect to the push-plate support plate 103 since it is pushed by the stacked paper money sheets 11 so that a predetermined load is applied to the stacked paper money sheets 11 by the dead weight of the push plate 19. Referring to FIG. 3 in which the state described above is illustrated, since the push plate 19 is capable of moving vertically by a distance which corresponds to the stroke of the stepped shaft 102 and the lower plate 20 is supported by the lower-plate drive plate 106 with the compression springs 107, the stacked paper money sheets 11 are supported under a predetermined compressive force and with a predetermined compliance.

Figure 4:
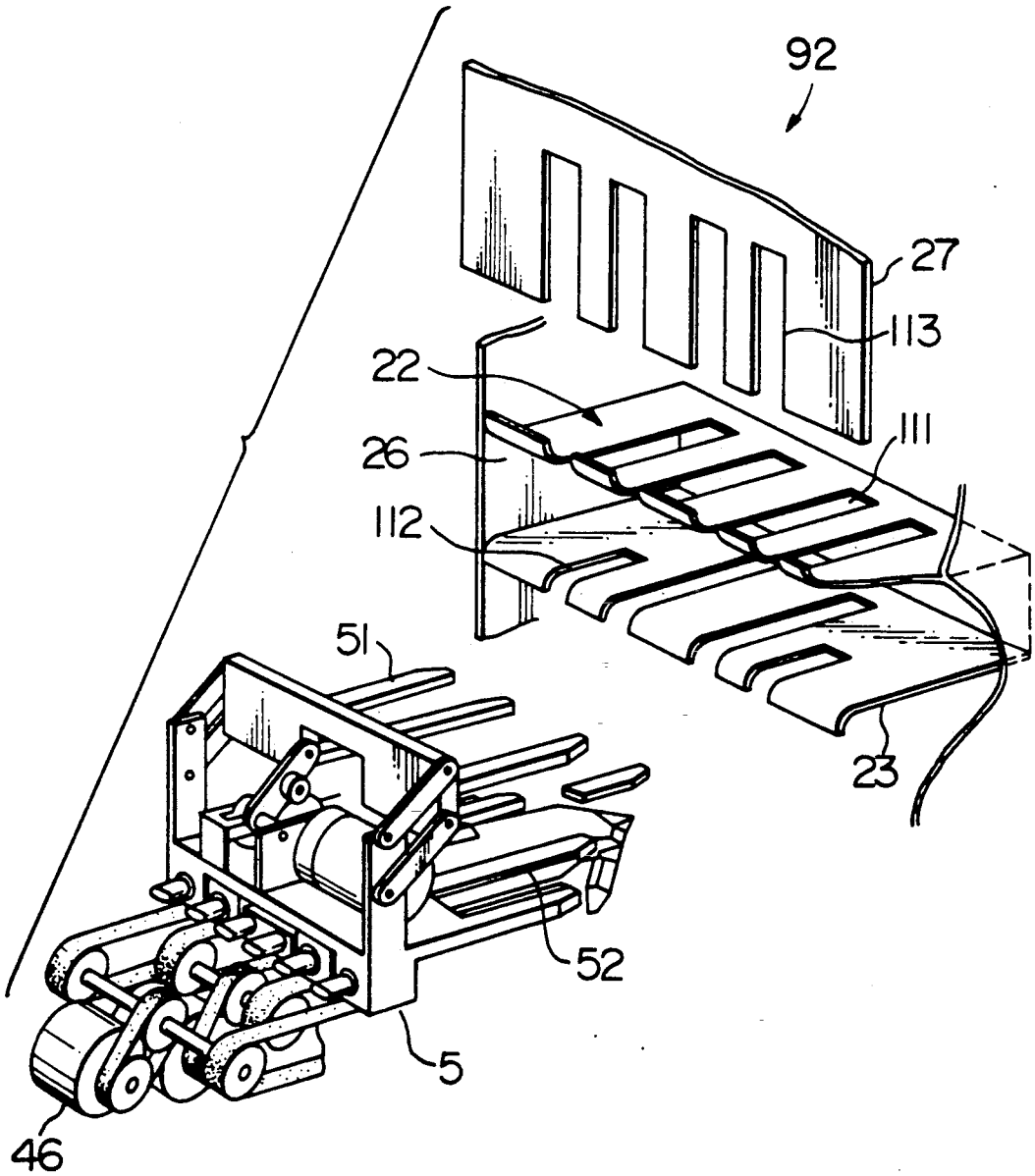
FIG. 4 is a perspective view of a second paper money accommodating portion of the cash box of the automatic cashier of the present invention.

As shown in FIG. 4, the second accommodating portion 92 of the cash box 9 comprises an upper plate 22 provided with a plurality of notches 111 formed therein and supported so as to be able to be vertically movable along the paper money input and output port 26. A separating plate 23 is provided with a plurality of notches 112 formed therein, and is supported so as to be vertically movable along the paper money input and output port 26. A shutter 27 is provided with a plurality of notches 113 formed therein, and is supported so as to be able to be vertically movable along the paper money input and output port 26. The positions and the shape of the notches 111 formed in the upper plate 22 are arranged to correspond to the positions and the shape of the fork-like parallel upper holding fingers 51, with the holding fingers 51 being provided for the holding means 5 to be described more fully hereinbelow.

Similarly, the notches 112 formed in the separating plate 23 correspond to the positions and the shape of the fork-like parallel lower holding fingers 52 for the holding means 5. The positions and widths of the notches 113 formed in the shutter 27 correspond to the positions and the widths of the fork-like parallel upper holding fingers 51 and the fork-like parallel lower holding fingers 52 and 53 which are provided for the holding means 5. Thus, the shutter 27 does not contact the upper holding fingers 51 and the lower holding finger 52 when the shutter 27 is lowered to a position corresponding to the position of the holding means 5 along the paper money input and output port 26. The upper plate 22 can be, similarly to the lower plate 20 in the first accommodating portion 91, moved vertically with a predetermined compliance by a moving mechanism including, for example, a spring and a ball screw (not shown). A similar moving mechanism (not shown) may also be provided for vertically moving the shutter 27.

The constructional features of the first accumulating portion 61 and the second accumulating portion 62 of the paper money separating portion 6, the stacking portions 81, 82 and 83 of the third accumulating portion 8 for stacking the paper money, and the fourth accumulating portion 33 of the money input and output portion 3 are substantially the same as those described above in connection with the second accommodating portion 92 of the cash box 9.

Figure 5:
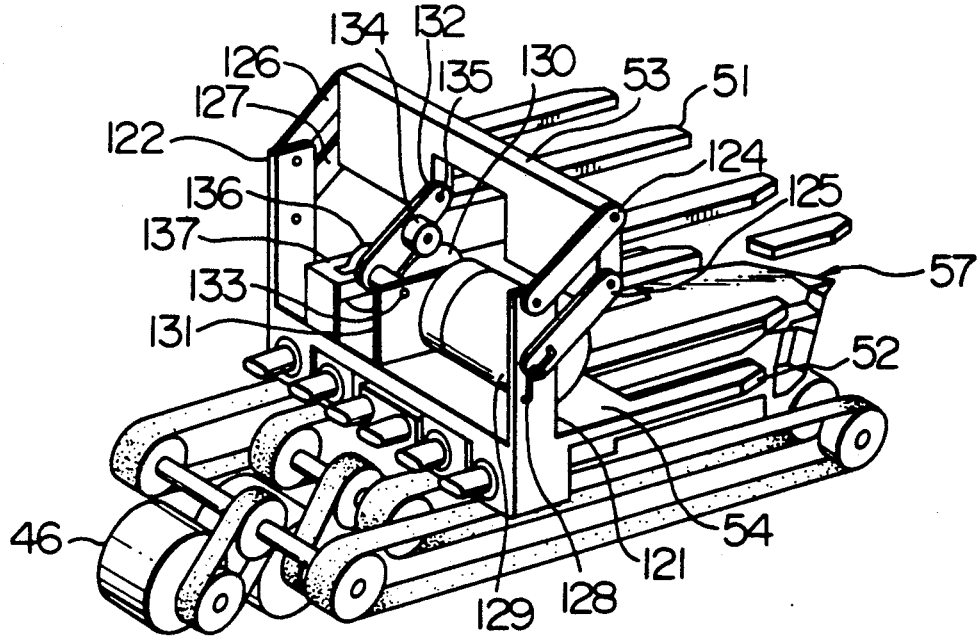
FIG. 5 is a perspective view of the holding means of the automatic cashier of the present invention.

A holding structure of the holding and conveying portion of the holding means 5, as shown most clearly in FIG. 5, includes four parallel upper holding fingers 51 on the upper holding plate 53, with the four parallel lower holding fingers 52 being provided on the lower holding plate 52. First bearing plates 121 and 122 are respectively provided on the both sides of the lower holding plate 54. Between these first bearing plates 121 and 122 and the upper holding plate 53, corresponding parallel linking plates 124, 125, 126 and 127 are provided. Between the parallel linking plate 125 and the first bearing plate 121, a torsion spring 128 for connecting the above parallel linking plate 125 and the first bearing plate 121 is provided. Another torsion spring (not shown) for connecting the parallel linking plate 127 and the first bearing plate 122 may be provided between the parallel linking plate 127 and the first bearing plate 122. A fifth motor 129 is mounted on the lower holding plate 54, and a cam plate 130 is fitted to the shaft of this fifth motor 129. A second bearing plate 131 is secured to this lower holding plate 54. A linking plate 132, connected to the second bearing plate 131 by a shaft 133, is provided with a cam follower 134 adapted to contact the cam plate 130, with the linking plate 132 being connected to the upper holding plate 53 by a shaft 135. A slit plate 136 is fitted to the shaft of the fifth motor 129, and a sensor 137 is mounted on the second bearing plate 131 to hold the slit plate 136. This sensor 137 is arranged to be actuated by a slit in the slit plate 136 so that the fifth motor 129 is stopped at a rotational angle which corresponds to the position of the slit. That is, for example, when the cam plate 130 is stopped at a maximum eccentricity with the cam follower 134 raised at the uppermost position, the linking plate 132 pushes the upper holding plate 53 with the shaft 134 in an upward direction, thereby causing the upper holding fingers 51 to be opened. On the contrary, when the cam plate 130 is stopped at a minimum eccentricity, the cam plate 130 cannot push the cam follower 134 in an upward direction and, consequently, the upper holding fingers 51 are closed by the torsion spring 128. If block a of paper money sheets was present between the lower holding fingers 52 and the upper holding fingers 51, the block can be held with a proper strength since the urging force of the torsion spring 128 is utilized to close the upper holding fingers 51. Therefore, the fifth motor 129 or the linking plate 132 can be protected from any excessive force.

Figure 6:
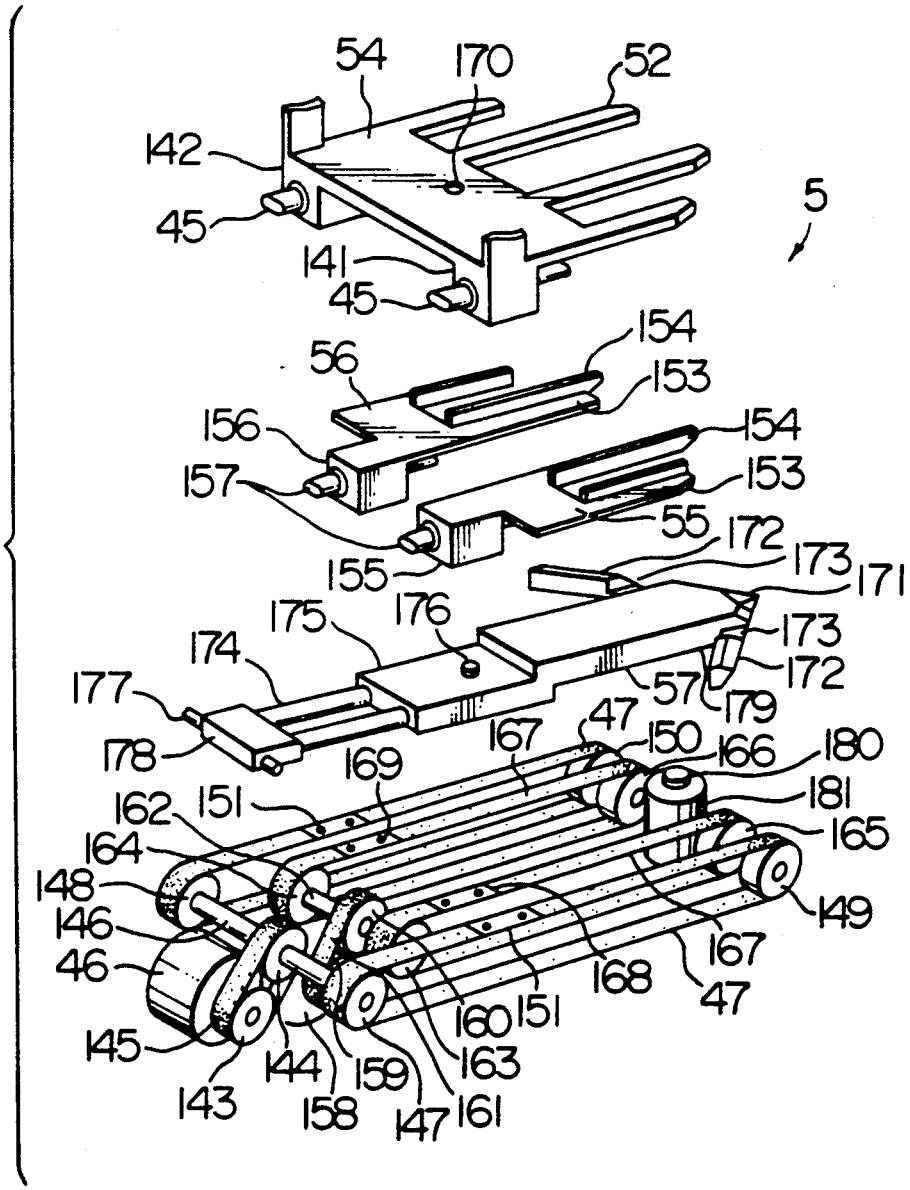
FIG. 6 is an exploded view of the holding means shown in FIG. 5.

As shown in FIG. 6, holding means 5 further includes a pair of accommodating members consisting of right and left accommodating members 55 and 56 respectively provided below the lower holding plate 54, with a separating member 57 being disposed below the lower holding plate 54 in a central position of the holding means 5. The members 55, 56, 57 can be moved forward and rearward with respect to the lift 4.

Means for enabling a forward/rearward movement of the holding means 5 includes bearings 141 and 142 disposed on the two sides of the lower portion of the lower holding plate 54 and guided by rails 45 provided for the lift 4. The lower holding plate 54 is movable in a forward and rearward direction by the third motor 46 with an aid of a pulley 143 coupled to the shaft of the third motor 46, a belt extending around the pulley 143 and a pulley 144, pulleys 147 and 148 connected to the pulley 144 by a shaft 146, belts 47 extending around pulleys 147, 149 and 148, 150, and a connecting portion 151 connecting the belts 47 and bearings 141 and 142. The accommodating portion of the holding means 5, as also shown in FIG. 6, includes a pair of accommodating members 55 and 56 having accommodating fingers 153 arranged to have substantially the same shape as the four parallel lower holding fingers 52 and guides 154 for guiding the paper money sheets to the lower holding fingers 52. Bearings 155 and 156, disposed below the accommodating members 55 and 56, are respectively guided by rails 157 provided for the lift 4. Similarly to the above-described lower holding plate 54, the accommodating members 55 and 56 are moved forward and rearward by a sixth motor 158 along the lower holding plate 54 with an aid of a pulley 159 coupled to the shaft of the sixth motor 158, a belt 161 extending around the pulley 159 and a pulley 160, pulleys 163 and 164 connected to the pulley 160 by a shaft 162, belts 167 extending around pulleys 163, 165 and 164, 166, and connecting portions 168 and 169 for connecting the belts 167 and the bearings 155 and 156 of the accommodating members 55 and 56.

The separating portion of the holding means 5 includes a separating member 57 comprising a pointed member 171 at the front portion thereof, a setter 172 provided on the two sides of this pointed member 171 and having a groove 173, and a bearing 175 disposed in the rear portion thereof and arranged to be guided by rails 174. Furthermore, the separating member 57 comprises a pin 176 disposed on the upper surface of the bearing 175 and arranged to be fitted into a connection hole 170 formed in the lower holding plate 54. The rails 174 are fastened to a bearing 178 capable of rotating relative to a shaft 177 provided for the lift 4. A solenoid 181 has a head 180 capable of contacting a moving portion 179 disposed in the front lower portion of the separating member 57 to move the same. When the head 180 is raised by the operation of the solenoid 181, the separating member 57 rotates relative to the shaft 177, causing the pointed member 171 to be raised and causing the pin 176 to be fitted into the connection hole 170. As a result, the rails 174 and the bearing 175 are moved forward and rearward by the forward and rearward movement of the lower holding plate 54. When the operation of the solenoid 181 is stopped, the separating member 57 is lowered due to its dead weight and the pin 176 is disengaged from the connection hole 170. As a result, the rails 174 and the bearing 175 are not moved even if the lower holding plate 54 is moved forward and rearward.

The holding means 5 functions to separate, hold, and convey the paper money sheets stacked in the first paper money accommodating portion 91, with such function including accommodating paper money sheets to be utilized in a circulated manner, extracting or accommodating the block of paper money sheets to and from the second accommodating portion 92 accommodating the paper money sheets to be dispensed, the first and second accumulating portions 61 and 62 of the paper money separating portion 6, the third accumulating portion 8 for stacking the paper money sheets, and the fourth accumulating portion 33 of the money input and output portion 3.

FIGS. 7 to 12 are views which illustrate the operation of the upper holding plate 53 having the upper holding fingers 51 and the lower holding plate 54 having the lower holding fingers 52 of the holding means 5, the separating member 57 having the pointed member 171 and the setter 172, and the accommodating members 55 and 56 having the accommodating fingers 153.

Figure 7:
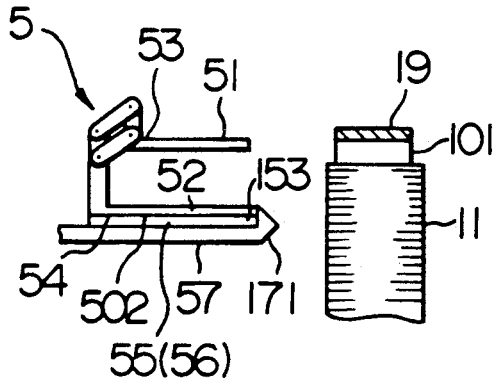
FIGS. 7 to 26 are schematic views illustrating the operations of the components of the holding means according to the present invention.

FIG. 7 is a view which illustrates a state where the holding means 5 is, by the lift 4, positioned to confront the paper money input and output port 24 of the first paper money accommodating portion 91, with the upper holding fingers 51 being open, and the separating member 57 and the accommodating members 55 and 56 being positioned in a rearmost portion of the holding means 5.

Figure 8:
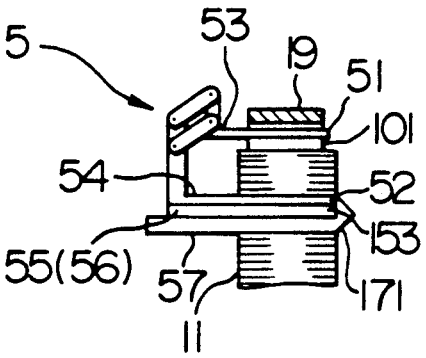
Figure 9:
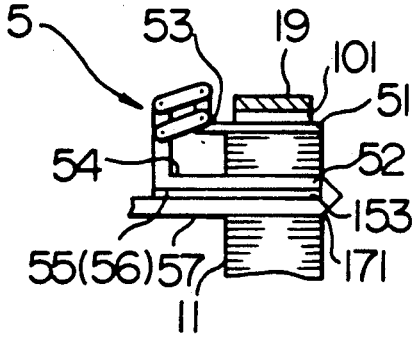

During the separating action, as shown most clearly in FIG. 8, the lower holding plate 54, the separating member 57, and the accommodating members 55 and 56 move forward with the upper holding fingers 51 opened, and the pointed member 171 and setter introduced into the stack of the paper money sheets 11. At this time, since the stack of the paper money sheets 11 is supported under a predetermined compressive force and with a predetermined compliance due to the forward movement of the fork-like parallel upper holding fingers 51 along the grooves 101 formed in the pushing plate 19, the stacked paper money sheets 11 can be smoothly separated vertically in accordance with the introduction of the pointed member 171 and the setter, and the upper holding fingers 51 are then closed as shown in FIG. 9.

Figure 10:
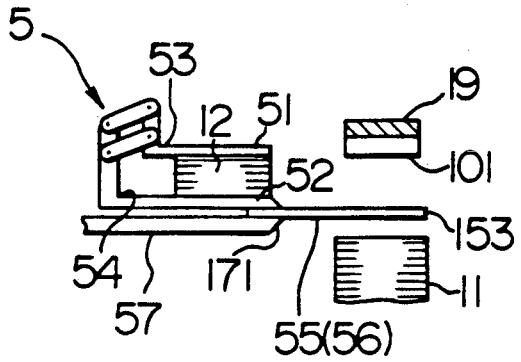

During an extracting of paper money sheets 11, as shown in FIG. 10, the lower holding plate 54 and the separating member 57 are retracted with the upper holding fingers 51 closed, and the paper money block 12 of paper money sheets 11 is extracted through the paper money input and output port 24 formed in the first paper money accommodating portion 91. At this time, the accommodating members 55 and 56 hold the upper portion of the stacked paper money 11 left in the first paper money accommodating portion 91 with the accommodating members 55, 56 being stopped at the forward position for the purpose of preventing dispersion of the stack of paper money sheets 11.

Figure 11:
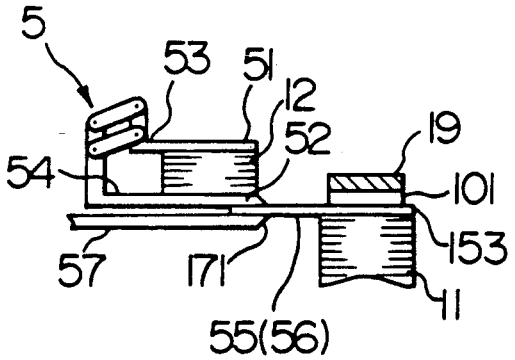

In FIG. 11, the push plate 19 is lowered and, as described above, the accommodating fingers 153 are arranged to have substantially the same shape as that of the fork-like parallel lower holding fingers 52. Therefore, the grooves 101 formed in the push plate 19 are lowered along the accommodating fingers 153, and the push plate 19 pushes the upper portion of the stack of the paper money sheets 11 remaining in the first paper money accommodating portion 91 with a predetermined load without any contact with the accommodating members 55 and 56.

Figure 12:
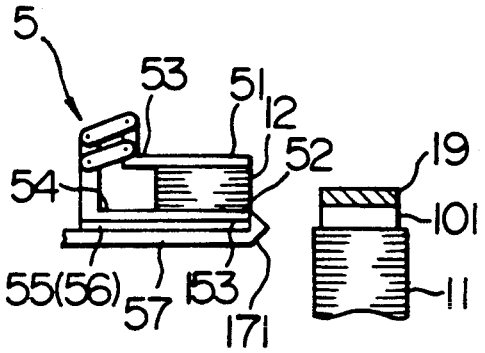

Upon a completion of the separation action, as shown in FIG. 12, the accommodating members 55 and 56 are retracted. Then, the holding means 5 is moved by the lift 4, and the separated block 12 of paper money sheets 11 is held by the four parallel lower holding fingers 52 fastened to the lower holding plate 54 and the four parallel upper holding fingers 51 fastened to the upper holding plate 53 so as to be conveyed to a predetermined accumulating portion.

Figure 13:
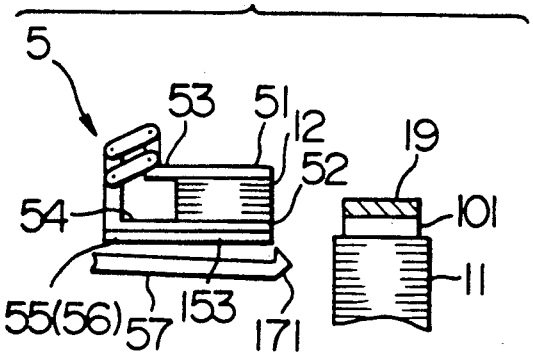

FIG. 13 to 18 illustrate the action of the lower holding plate 54 having the lower holding fingers 52 and the upper holding plate 53 having the upper holding fingers 51 of the holding means 5, the separating member 57, and the accommodating members 55 and 56 having the accommodating fingers 153 when the paper money sheets 11 which are being circulated are accommodated in the first paper money accommodating portion 91. During these actions, the separating member 57 is maintained at a lowered position due to its dead weight as shown in FIG. 13 and is maintained in the rearmost portion of the holding means 5 even if the lower holding plate 54 moved forward or rearward.

In FIG. 13, the holding means 5 is, by the lift 4, positioned to confront the paper money input and output port 24 of the first paper money accommodating portion 91, where the block 12 of paper money sheets to be accommodated is held by the four parallel lower holding fingers 52 and the four parallel upper holding fingers 51, and the accommodating members 55 and 56 are positioned in the rearmost portion of the holding means 5.

Figure 14:
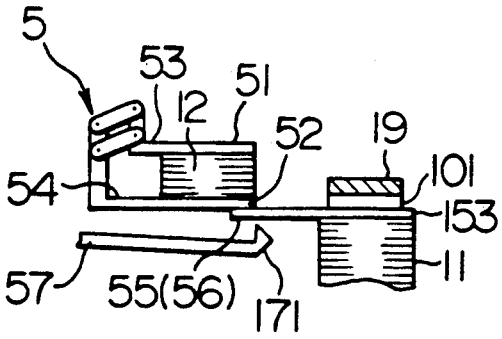

In FIG. 14, in preparation for accommodation of paper money, the accommodating fingers 153 of the accommodating members 55 and 56 are moved forward. As described above, the accommodating fingers 153 are arranged to have substantially the same shape as that of the fork-like parallel lower holding fingers 52. Therefore, the accommodating fingers 153 can be moved forward along the grooves 101 formed in the push plate 19 without any contact with the push plate 19.

Figure 15:
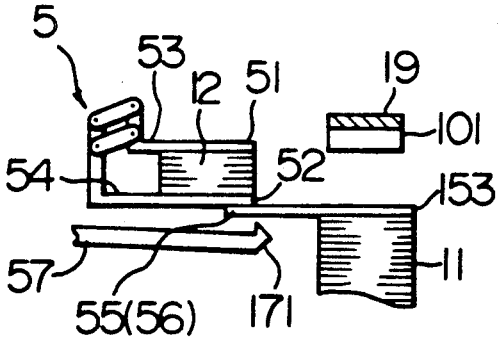

In FIG. 15, the push plate 19 has been raised; however, in order to prevent dispersion of the stacked paper money 11 in the first paper money accommodating portion 91 due to release of the load of the push plate 19, the accommodating fingers 153 of the accommodating members 55 and 56 hold the upper portion of the stacked paper money 11.

Figure 16:
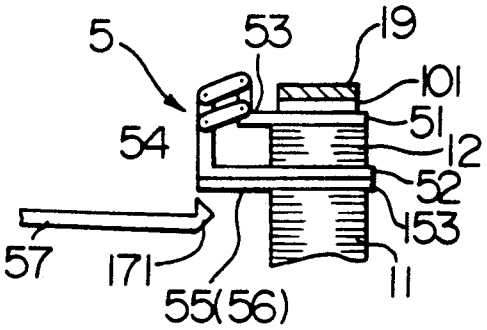

In FIG. 16, during a sending action, the lower holding plate 54 is moved forward with the upper holding fingers 51 closed and the paper money block 12 is sent above the stacked paper money 11 accommodated in the first paper money accommodating portion 91 for delivery through the paper money input and output port 24 formed in the first paper money accommodating portion 91.

Figure 17:
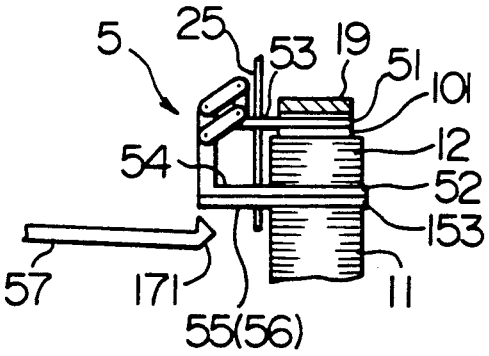

In FIG. 17, the push plate 19 and the shutter 25 are lowered and the upper holding fingers 51 are opened. As described above, in order to prevent the dispersion of the paper money block 12, the fork-like parallel upper holding fingers 51 hold the upper portion of the paper money block 12 with a predetermined load without any contact with the push plate 19.

Figure 18:
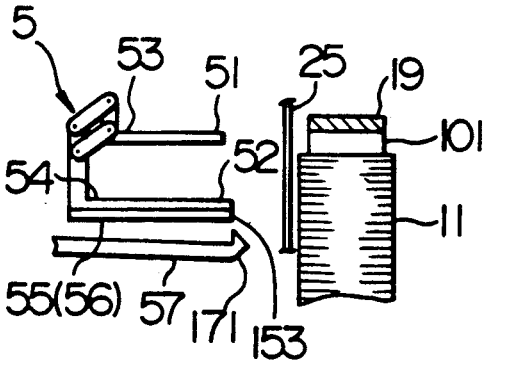

Upon completion of the accommodating operation, as shown in FIG. 18, the lower holding plate 54 is, together with the accommodating members 55 and 56, retracted with the upper holding fingers 51 opened. At this time, since the movement of the accommodated paper money block 12 is restricted by the shutter 25, it is left intact in the first paper money accommodating portion 91. After the lower holding plate 52 and the accommodating members 55 and 56 have been retracted from the paper money input and output port 24, the push plate 19 applies a predetermined load to the upper portion of the accommodated paper money block 12 and the stacked paper money sheets 11.

FIGS. 19 to 22 illustrate the action of the lower holding plate 54, lower holding fingers 52, upper holding plate 53, and upper holding fingers 51 of the holding means 5, the separating member 57, and the accommodating members 55 and 56 when the paper money is taken out from the second paper money accommodating portion 92. In order to achieve this operation, the accommodating members 55 and 56 are moved forward together with the lower holding plate 54. As described above, since the accommodating fingers 153 of the accommodating members 55 and 56 are arranged to have substantially the same shapes as the fork-like parallel lower holding fingers 52, they can perform the function substantially the same as that performed by the fingers. As shown in FIGS. 13 to 18, the separating member 57 has been lowered due to its dead weight and is maintained in the rearmost portion of the holding means 5 even if the lower holding plate 54 moved forward or rearward.

Figure 19:
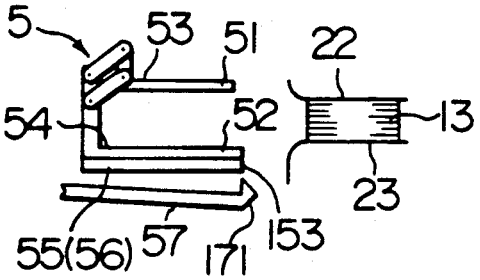

FIG. 19 is a view which illustrates a state where the holding means 5 is, by the lift 4, positioned to confront the paper money input and output port 26 formed in the second accommodating portion 92 of the cash box 9 for accommodating paper money to be dispersed, the upper holding fingers 51 being opened in this state. At this time, the upper holding fingers 51 are opened to a degree which is larger than the thickness of the paper money block 13.

Figure 20:
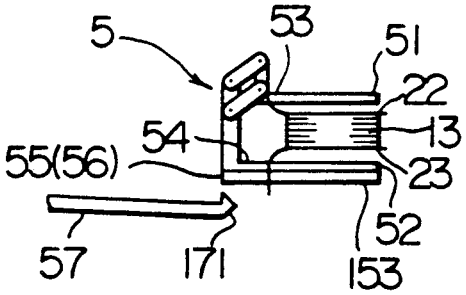

FIG. 20 is a view which illustrates a forward state where the lower holding plate 54 and the accommodating members 55 and 56 are moved forward with the upper holding fingers 51 opened.

Figure 21:
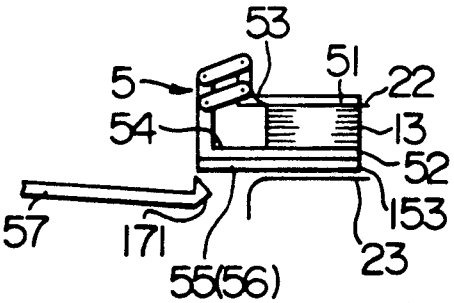

FIG. 21 is a view which illustrates an ensuing state where the holding means 5 is slightly raised by the lift 4 and the upper holding fingers 51 are closed. In this state, the lower holding plate 54 is positioned slightly higher than the position of the separating plate 23. As described above, the position and the shape of the notches 112 formed in the separating plate 23 and the notches 111 formed in the upper plate 22 correspond to the upper holding fingers 51 and the lower holding fingers 52. As a result, the upper plate 22 involves a compliance caused from the structure in which, for example, a spring and a ball screw are employed and the same can be moved vertically. Therefore, the holding means 5 can scoop the paper money block 13 without contact between the lower holding fingers 52 and the separating plate 23 and between the upper holding fingers 51 and the upper plate 22 and without any excessive load applied to the paper money block 13.

Figure 22:
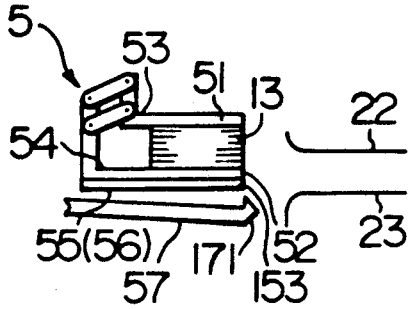

Upon completion of a drawing out action, as shown in FIG. 22, the lower holding plate 54 and the separating fingers 57 are retracted with the upper holding members 51 closed so that the paper money block 13 is drawn out through the paper money input and output port 26 formed in the second paper money accommodating portion 92. Then, the holding means 5 is moved by the lift 4, and the separated paper money block 13 is held between the four parallel lower holding fingers 52 and the four parallel upper holding fingers 51 and is conveyed to the accumulating portion.

FIGS. 23 to 26 illustrate the action of the lower holding plate 54 having the lower holding fingers 52 and the upper holding plate 53 having the upper holding fingers 51 of the holding means 5, the separating member 57, and the accommodating members 55 and 56 when the paper money sheets are accommodated in the second paper money accommodating portion 92. In this case, similarly to the above-described extracting action shown in FIGS. 19 to 22, the accommodating members 55 and 56 are, together with the holding plate 54, moved forward. The separating member 57 has been lowered due to its dead weight and is stopped in the rearmost portion of the holding means even if the lower holding plate 54 is moved forward or rearward.

Figure 23:
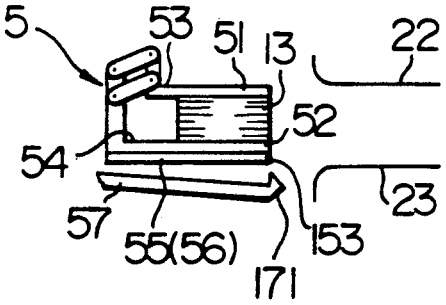

FIG. 23 illustrates a state where the holding means 5 is, by the lift 4, positioned to confront the paper money input and output port 26 formed in the second accommodating portion 92. In this state, the paper money block 13 to be accommodated is held by the four parallel upper holding fingers 51 and the four parallel lower holding fingers 52, and the separating member 57 and the accommodating members 55 and 56 are positioned in the rearmost portion of the holding means 5.

At this time, the lower holding plate 54 is positioned slightly higher than the position of the separating plate 23 and the upper plate 22 is positioned higher than the position of the upper holding plate 53. Therefore, the interval between the separating plate 23 and the upper plate 22 is larger than the thickness of the paper money block 13.

Figure 24:
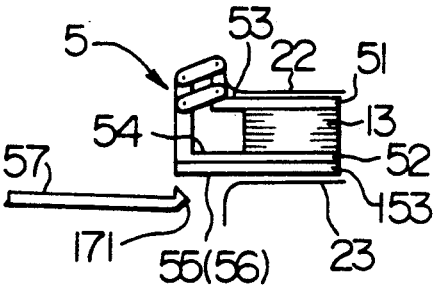

FIG. 24 illustrates a state of preparation for the accommodation, where the lower holding plate 54 and the accommodating members 55 and 56 are moved forward with the upper holding fingers 53 closed.

Figure 25:
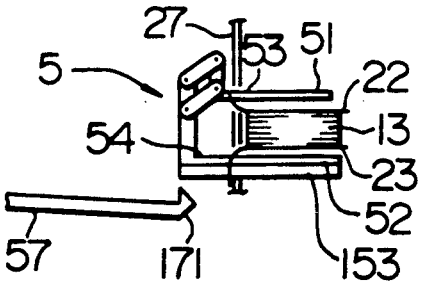

FIG. 25 illustrates a state where the upper holding fingers 51 have been opened, the holding means 5 has been slightly lowered by the lift 4, the upper plate 22 has been lowered, and the shutter has been lowered. The lower holding plate 54 is positioned slightly lower than the separating plate 23. The position and the shape of the notches 112 formed in the separating plate 23 and the notches 111 formed in the upper plate 22 correspond to the upper holding fingers 51 and the lower holding fingers 52. As a result, the upper plate 22 involves a compliance caused from the mechanism in which, for example, a spring and a ball screw are employed and the same can be moved vertically. Therefore, the separating plate 23 can scoop the paper money block 13 and the upper plate 22 applies a predetermined load in order to prevent dispersion of the paper money block 13 without contact between the lower holding fingers 52 and the separating plate 23 and between the upper holding fingers 51 and the upper plate 22 and without any excessive load applied to the paper money block 13.

Figure 26:
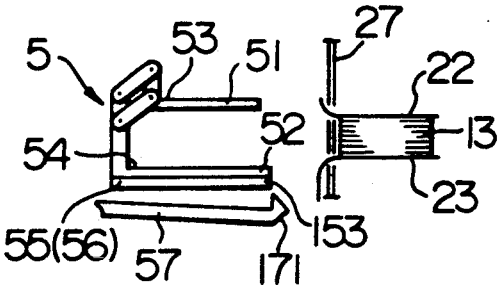

Upon completion of the accommodating action, as shown in FIG. 26, the lower holding plate 54 is, together with the accommodating members 55 and 56, retracted with the upper holding fingers 51 opened. At this time, since the movement of the accommodated paper money block 13 is restricted by the shutter 27, it is left in the second paper money accommodating portion 92. By the description made with reference to FIGS. 19 to 22, and FIGS. 23 to 26, the action of the extraction and action of accommodating the paper money block 13 in the second accommodating portion 92 of the he extracting and accommodating the paper money block 13 from and in the first and second accumulating portions 61 and 62 of the paper money separating portion 6, each of the stacking portions 81, 82, 83 and 84 of the third accumulating portion 8 for stacking the paper money, and the fourth accumulating portion 33 of the money input and output portion 3 can, of course, be performed in a similar manner.

In operation, the automatic cashier separates, by the holding means 5, a predetermined quantity forming the paper money block from the paper money sheets stacked in the first paper money accommodating portion 91 of the cash box 9. This holding means is then so raised by the lift 4 as to supply the thus-held paper money block to the first accumulating portion 61 of the paper money separating portion 6. Similarly, the paper money block accumulated in the second paper money accommodating portion 92 of the cash box 9 is held by the holding means 5, and is raised by the lift 4 so that this paper money block is supplied to the second accumulating portion 62 of the paper money separating portion 6. It is assumed that the paper money sheets accumulated in the first paper money accommodating portion 91 are bills of a first denomination while the paper money accumulated in the second paper money accommodating portion 92 are bills of a denomination other than the first denomination.

Figure 27:
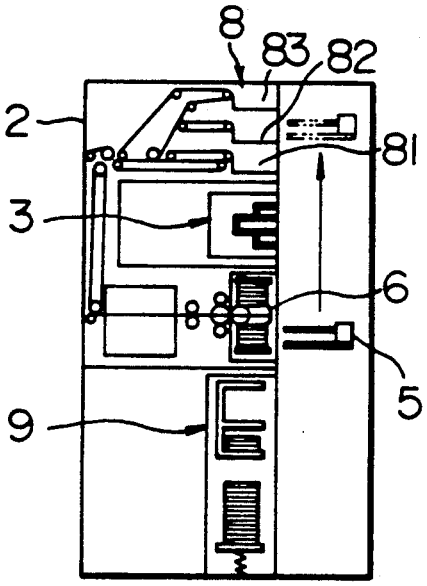
FIG. 27 to 30 are schematic views illustrating the money output action performed by a paper money circulating mechanism.
Figure 29:
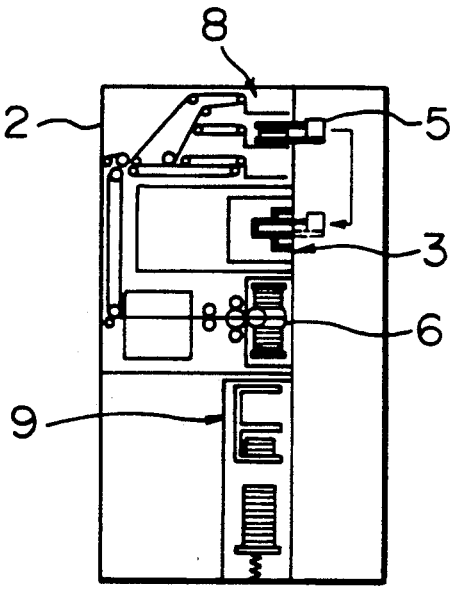
Figure 28:
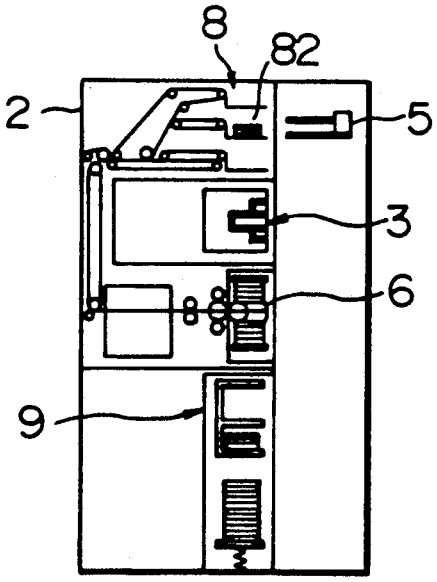
Figure 30:
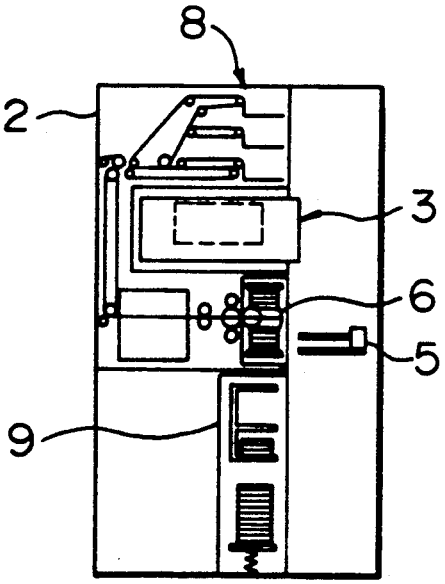

When paper money dispensing action is performed, the paper money separating portion 6 separates a predetermined number of paper money sheets from the block in the first accumulating portion 61 and the second accumulating portion 62 supplied by the holding means 5 and conveys the separated paper money sheets to the discriminating portion 7. That is, assuming that fifty-two dollars are demanded of the automatic cashier in which ten dollar bills are stacked in the first accumulating portion 61 thereof while one dollar bills are stacked in the second accumulating portion 62, five ten dollar bills are separated from the money sheets in the first accumulating portion 61 and two one dollar bills are separated from the money sheets in the second accumulating portion 62 before conveyance. The discrimination portion 7 discriminates whether or not the subject bill is true or counterfeit. After the supply of the paper money, the holding means 5 is moved to the third accumulating portion 8 (FIG. 27). Then, the paper money is conveyed through the conveying passage 10 after the discrimination. If a paper money sheet is determined, by the discriminating portion 7, to be a counterfeit, damaged (it cannot be used as the paper money to be dispensed), or impossible to be discriminated, it is accumulated in the stacking portion 81 of the third accumulating portion 8 after passing through the conveying passage 84 upon the action of the gate 87. If the paper money sheet is determined to be true, the paper money sheet is stacked in the stacking portion 82 of the third accumulating portion 8 after passing through the conveying passage 85 upon the actions of the gates 87 and 88 (FIG. 28). After a predetermined number of the paper money sheets has been stacked in the stacking portion 82, the stacked paper money sheets are held by the holding means 5 and moved, by the lift 4, to a position corresponding to the position of the paper money input and output portion 3. Then, the thus-positioned paper money sheets are discharged in the fourth accumulating portion 33 of the money input and output portion 3 which has been positioned to confront the holding means 5 (FIG. 29). This money input and output portion 3 is rotated relative to the shaft 31 an is positioned to confront the front surface of the case 2. Simultaneously, the fourth accumulating portion 33 is rotated to confront the money input and output port 34 by the motor 32 so that the paper money sheets are dispensed to the user (FIG. 30). On the other hand, the above-described paper money sheet which has been determined to be counterfeit, a damaged paper money sheet (it cannot be used as the paper money to be dispensed), a paper money sheet which is impossible to be discriminated and thus accumulated in the stacking portion 81, is held by the holding means 5 which is then moved to the position of the cash box 9 by the lift 4. Then, the paper money sheet in question is accommodated in the third paper money accommodating portion 93 for accommodating rejected paper money sheets and paper money sheets which are not to be circulated. If the paper money sheets in the first accumulating portion 61 are exhausted during the action of the separating portion 6 for separating the paper money sheets in the first accumulating portion 61, the holding means 5 is lowered, by the lift 4, to the position corresponding to the position of the cash box 9 for the purpose of separating another predetermined block from the accumulated paper money sheets in the first paper money accommodating portion 91 by the holding means 5. Then, the holding means 5 is raised by the lift 4 to supply the thus-separated paper money block to the first accumulating portion 61 of the paper money separating portion 6. Thus, the above-described separation action can be continued. If the paper money in the second accumulating portion 62 is exhausted during the action of the separating portion 6 for separating the paper money sheets in the second accumulating portion 62, this fact is displayed to the user and this operation is temporarily stopped. Then the operation mode is switched to a mode in which only the paper money sheets in the first accumulating portion 61 of the paper money separating portion 6 are dispensed. That is, a mode in which, for example, only bills of the denomination stacked in the first paper money accommodating portion 91 are dispensed.

Figure 31:
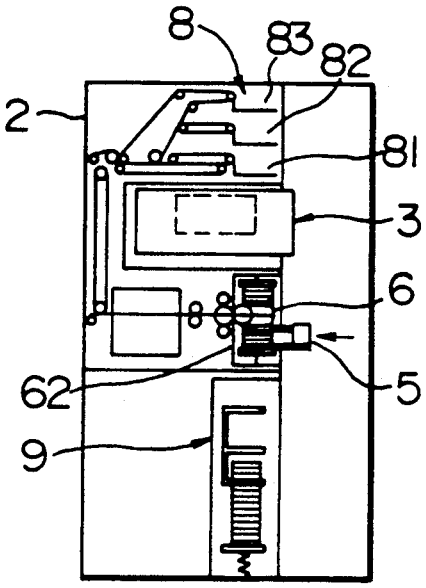
FIGS. 31 to 38 are views illustrating the money input action performed by the paper money circulating mechanism.
Figure 33:
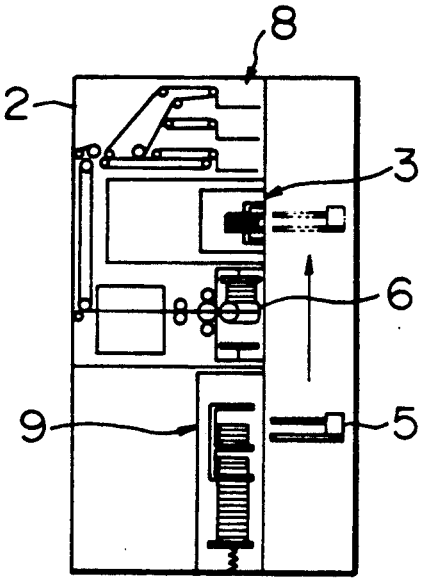
Figure 32:
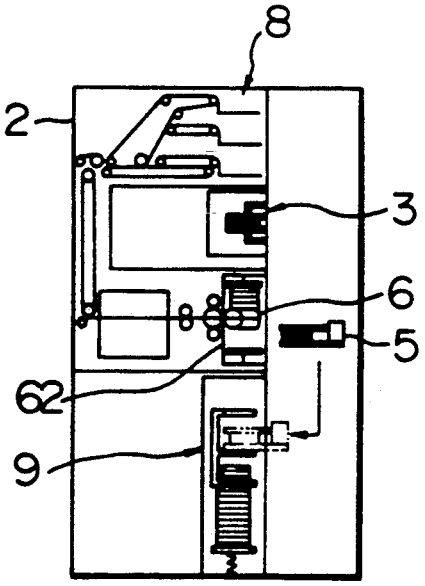
Figure 34:
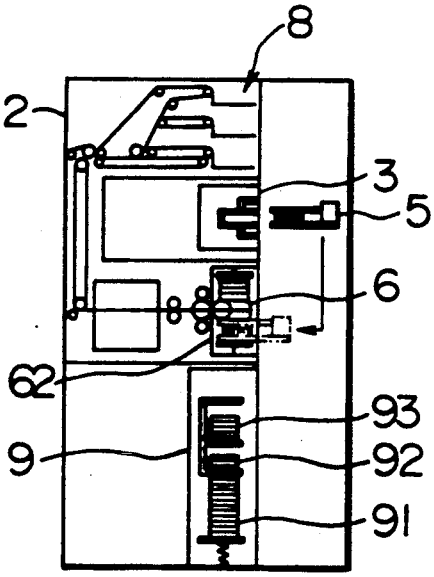
Figure 35:
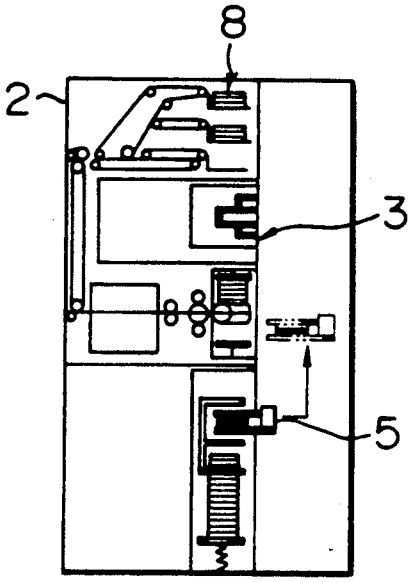
Figure 37:
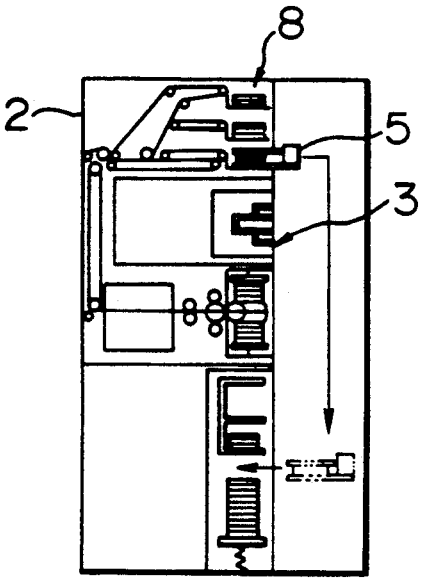
Figure 36:
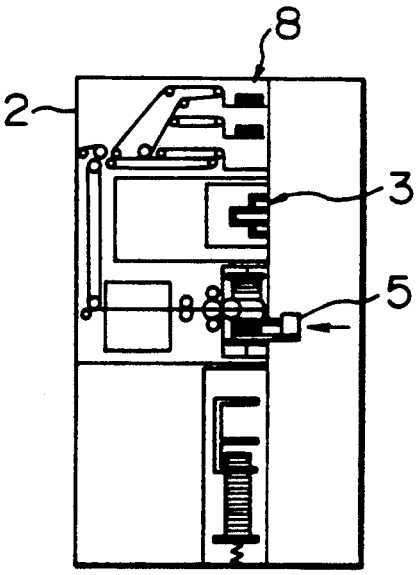
Figure 38:
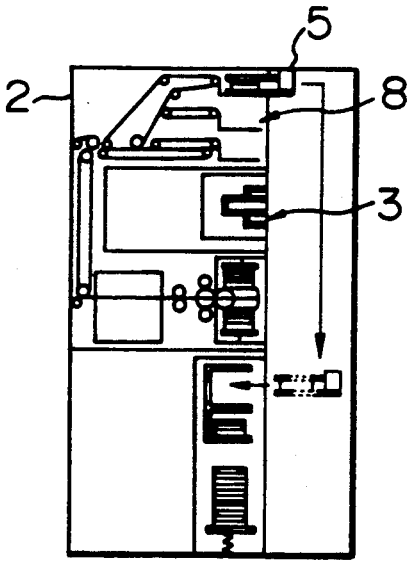

As for money input action, when a user inputs paper money sheets to the fourth accumulating portion 33 through the money input and output port 34 in the money input and output portion 3 positioned to confront the front surface of the case 2, the money input and output portion 3 is rotated relative to the shaft 31. Simultaneously, the fourth accumulating portion 33 is moved by the motor 32 so as to be positioned to confront the holding means 5. The holding means 5 holds the paper money block accumulated in the second accumulating portion 62 of the separating portion 6 (FIG. 31) and is lowered by the lift 4 so that this paper money block is accommodated in the second paper money accommodating portion 92 of the cash box (FIG. 32). Then, this holding means 5 is moved, by the lift 4, to the position which corresponds to the position of the money input and output portion 3 so as to hold the paper money in the fourth accumulating portion 33. It is then lowered, by the lift 4, to the position which corresponds to the position of the paper separating portion 6 to supply this paper money block to the accumulating portion 62 of the separating portion 6 (FIG. 34). The paper money sheets are supplied to the second accumulating portion 62 of the separating portion 6, similarly to the money dispensing action, separated and are then subjected to the discrimination. The paper money sheet determined to be counterfeit, or a paper money sheet which cannot be discriminated is, by the action of the gate 87, accumulated in the stacking portion 81 of the third accumulating portion 8 after the paper money sheet has passed through the conveying passage 84. The paper money sheet which has been determined to be a true one is accumulated in such a manner that a first denomination bill is accumulated in the stacking portion 82 after passing through the conveying passage 85 by the action of the gates 87 and 88. Bills of other denominations and the paper money sheets determined to be damaged are, upon the action of the gates 87 and 88, accumulated in the stacking portion 83 of the third accumulating portion 8 after passing through the conveying passage 86 (FIG. 35). When the paper money sheet introduced by a user includes no counterfeit or paper money sheets which cannot be discriminated and when the operation of the confirmation key by the user is detected, bills of the first denomination accumulated in the stacking portion 81 of the third accumulating portion 8 are held by the holding means 5 and are lowered by the lift 4 so as to be accommodated in the first paper money accommodating portion 91 of the cash box 9 (FIG. 37). Bills of other denominations and damaged bills of the first denomination accumulated in the stacking portion 83 of the third accumulating portion 8 are similarly held by the holding means 5, and are accommodated in the third paper accommodating portion 93 of the cash box 9 (FIG. 38). If the introduced paper money group includes a counterfeit or paper money sheet which cannot be discriminated, the thus-determined paper money is, as described above, accumulated in the stacking portion 81 of the third accumulating portion 8. Then, the thus-accumulated paper money group is held by the holding means 5, is returned to the money input and output portion 3 before a request of reintroduction is made to the user. When the user again introduces the returned paper money into the money input and output portion or another bill is introduced, and the thus-introduced paper money group is held by the holding means 5 so as to be supplied to the second accumulating portion 62 of the paper money separating portion 6, from which the paper money sheets are each separated and conveyed to the discriminating portion 7, after this action, if there were no counterfeit, the paper money group accumulated, as described above, in the stacking portion 82 of the third accumulating portion 8 is accommodated in the first paper money accommodating portion 91 of the cash box 9 by the holding means 5, while the paper money group accumulated in the stacking portion 83 of the third accumulating portion 8 is, also by the holding means 5, accommodated in the third paper money accommodating portion 93 of the cash box 9.

In a case where a user stops the money input operation when the counterfeit or paper money which cannot be discriminated is detected and returned to the user, and, in a case where the user stops the money input operation since the indicated account does not meet the account committed to the user's memory even if all of the introduced paper money sheets were determined to be true bills, the paper money group accumulated in the stacking portions 82, 82 and 83 of the third accumulating portion 8 is returned to the money input and output portion in response to the pushing of the cancel key performed by the user after the following processes have been performed. First, the holding means 5 holds the paper money group in the stacking portion 83 of the third accumulating portion 8 so as to supply it to the second accumulating portion 62 of the paper separating portion 6. The bills of this paper money group are each separated and conveyed to the stacking portion 81 of the third accumulating portion 8 after they have passed through the discriminating portion 7. Thus, the paper money sheets are stacked on the paper money sheets which have been previously accumulated as counterfeit or paper money which cannot be discriminated. The paper money group in the stacking portion 82 of the third accumulating portion 8 is also accumulated in the stacking portion 81 after it has been subjected to the similar operation. After the thus-input paper money sheets have been collectively accumulated, they can be held by the holding means 5 so as to be moved to the money input and output portion 3 and returned to the user.

Figure 39:
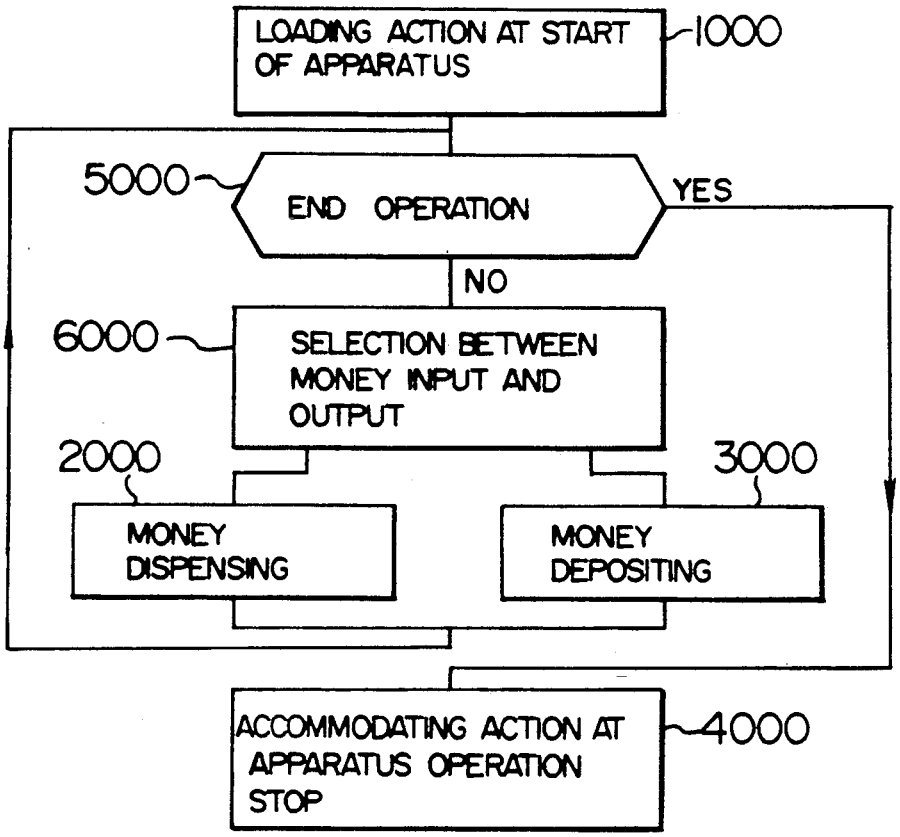
FIGS. 39 to 54 are flowcharts of the operation sequences according to the present invention.

FIG. 39 illustrates a usual operation of the apparatus. The operation of the apparatus comprises: a loading action 1000 at the time of start of the apparatus; money output action 2000 and money input action 3000; and a accommodating action 4000 at the time of the apparatus stop. Each of the selection of the money output action and the money input action is performed by the user with the keyboard, while the operation stop can be performed by a staff member.

Figure 40:
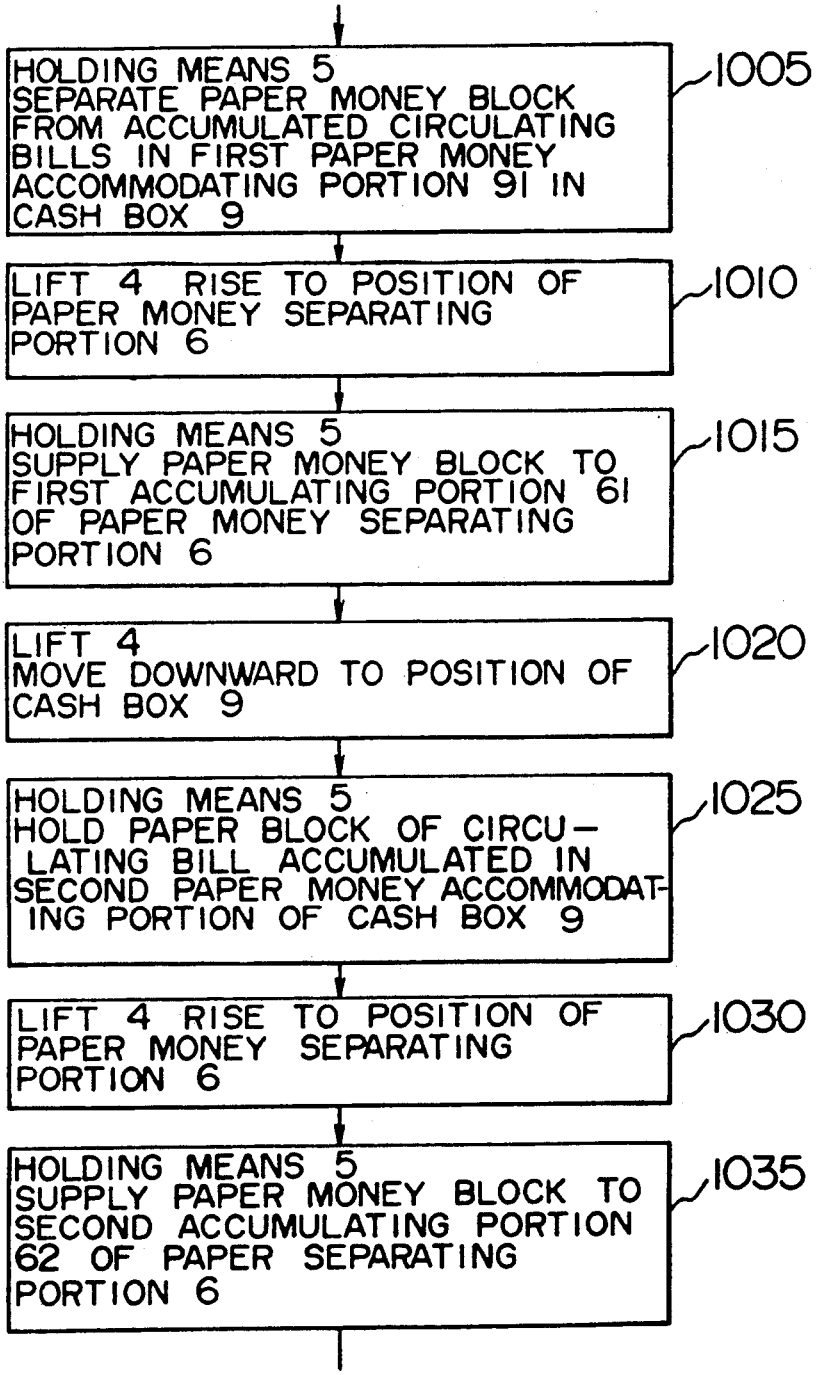

FIG. 40 illustrates the detailed sequence of the loading action 1000 at the time of start of the apparatus.

First, the holding means 5 separates (1005) a paper money block of a predetermined quantity from paper money, for example, ten dollar bills (to be called "circulating bills" hereinafter), to be utilized in a circulated manner and accumulated in the first paper money accommodating portion 91 of the cash box 9. The thus-separated block is held by the holding means 5 and raised to the position which corresponds to the position of the paper money separating portion 6 (1010), and this paper money block is supplied to the first accumulating portion 61 of the separating portion 6 (1015).

Then, the holding means 5 is lowered to the position which corresponds to the position of the cash box 9 (1020), and it also holds the paper money block of, for example, one dollar bill (to be called "non-circulating bill" hereinafter) accumulated in the second paper money accommodating portion 92 of the cash box (1025). The holding means 5 is raised by the lift 4 to the position which corresponds to the position of the separating portion 6 (1030). Then, the thus-held paper money block is supplied to the first accumulating portion 61 of the separating portion 6 (1035).

Figure 41:
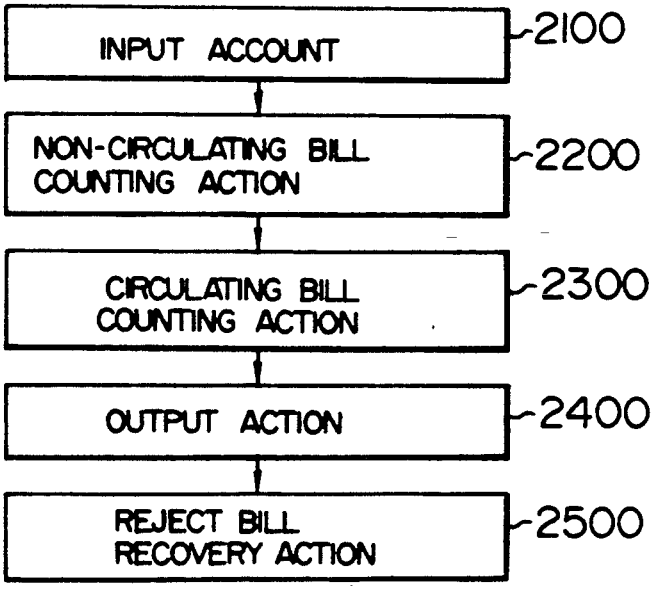

FIG. 41 illustrates the money output action 2000.

The money output action 2000 comprises: an account input action 2100 in which a desired account is input with the keyboard by a user; a non-circulating bill output counting action 2200 in which a predetermined number of paper money in the second accumulating portion 62 of the separating portion 6 are each separated and counted; a circulating bill output counting action 2300 in which a predetermined number of paper money sheets in the first accumulating portion 61 of the separating portion 6 are each separated and counted; a money output action 2400 in which paper money to be outputted which has been accumulated in the stacking portion 82 of the third accumulating portion 8 is held by the holding means 5, is conveyed to a position which corresponds to the money input and output portion 3 so as to be dispersed to the user; and a reject bill recovery action 2500 in which paper money (to be called "a reject bill" hereinafter), which has been determined, during the non-circulating bill output counting action 2200 and the circulating bill output counting action 2300, to be a counterfeit, a damaged paper money, or a paper money which cannot be discriminated and has been accumulated in the stacking portion 81 of the third accumulating portion 8, is held by the holding means 5 so as to be conveyed to the third accommodating portion 93. That is, for example, when a user inputs an account of fifty-two dollars to the keyboard, two sheets of one dollar bills are taken out from the second accumulating portion 62 and five sheets of ten dollar bills are taken out from the first accumulating portion 61 so as to be dispensed.

Figure 42:
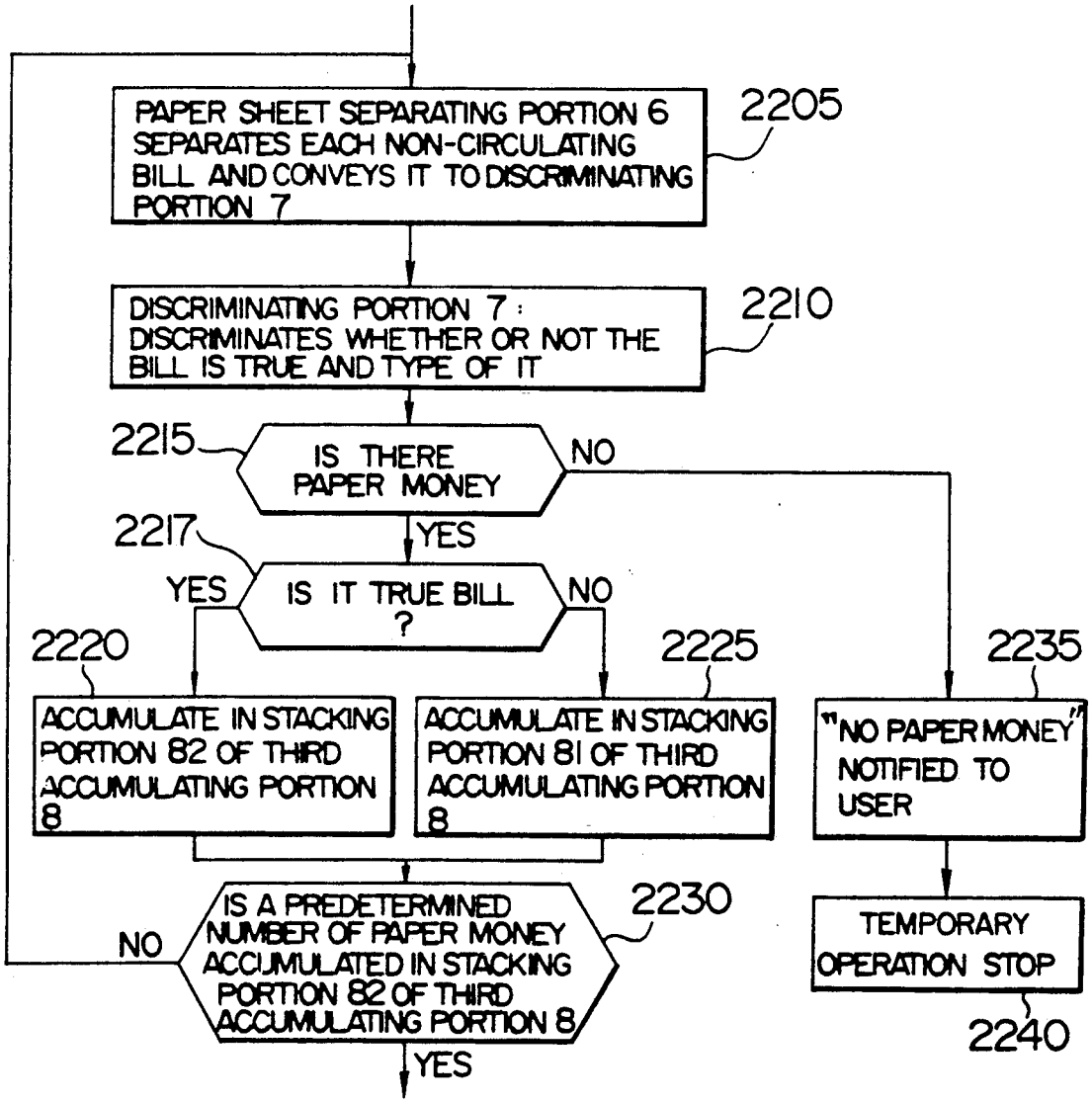

FIG. 42 illustrates the detailed sequence of the non-circulating bill output counting action 2200.

First, the separating portion 6 separates each non-circulated paper money sheet in the second accumulating portion 62 from those previously supplied by the holding means 5 and conveys the thus-separated non-circulating bills to the discriminating portion 7 (2205). The discriminating portion 7 discriminates whether or not the subject paper money sheet is true and determines the types of the subject paper money sheets (2210). The paper money sheet which has been conveyed through the conveying passage 10 is, if the subject paper money sheet is determined to be true (2217) as the result of the determination made as above, accumulated in the stacking portion 82 of the third accumulating portion 8 after it has passed through the conveying passage 85 in accordance with the action performed by the gates 87 and 88 (2220). If the subject paper money sheet is determined to be a reject bill (2217), it is accumulated in the stacking portion 81 of the third accumulating portion 8 after it has passed through the conveying passage 84 in accordance with the action performed by the gate 87 (2225). The separating action (2205) is repeated until a predetermined number of bills are accumulated in the stacking portion 82 of the third accumulating portion 8 (2230).

Figure 43:
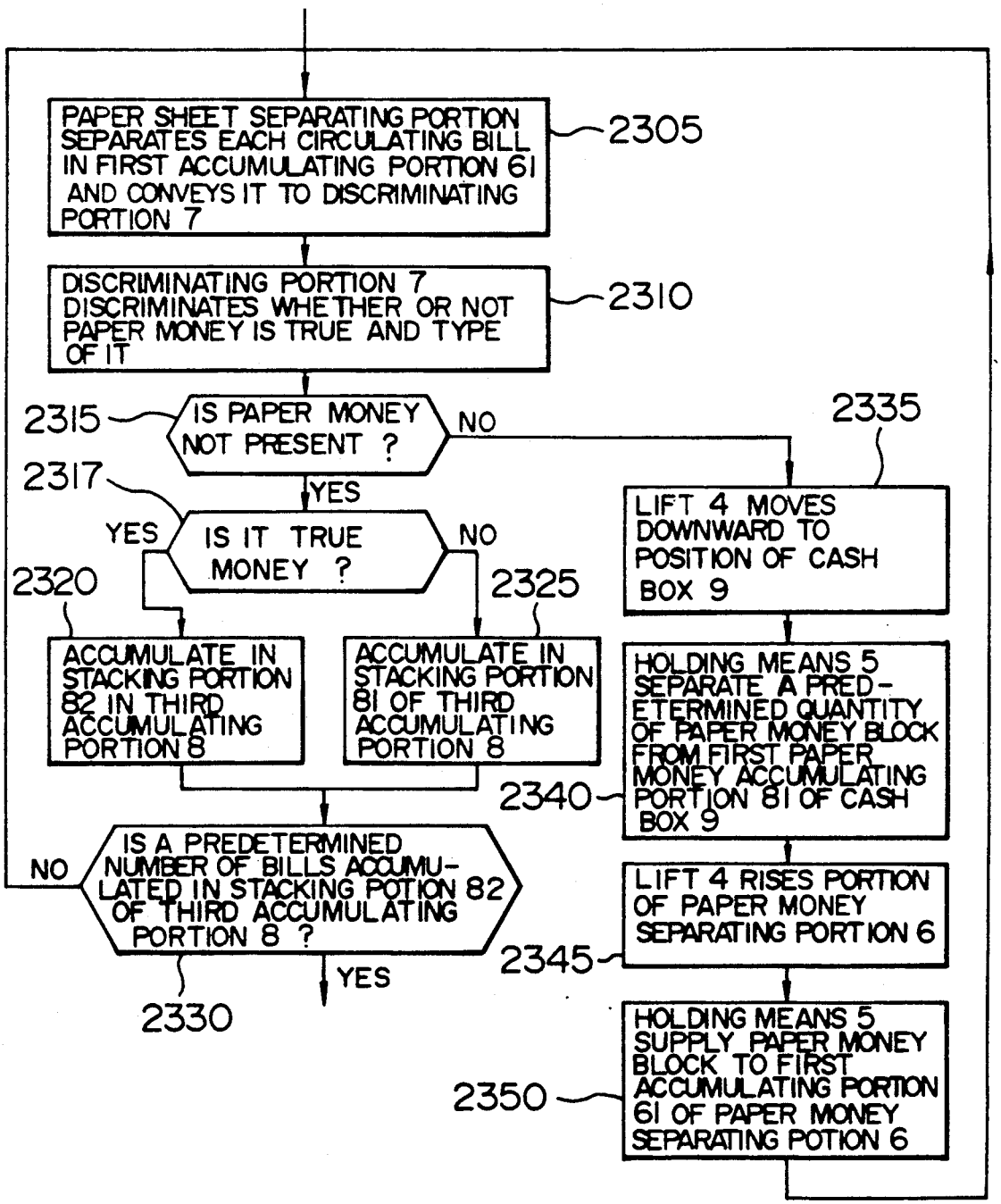

If the paper money in the second accumulating portion 62 is exhausted during the separating action (2215), the user is notified (2235), the money output/input operation is temporarily stopped (2240), and a money output action mode is realized in which only the circulating output bill counting action 2300 is performed. FIG. 43 illustrates a detailed sequence of the circulating bill output counting action 2300.

Similarly to the non-circulating bill output counting action 2200, the separating portion 6 separates each circulating bill in the first accumulating portion 61 which has been previously supplied by the holding means 5 and conveys the thus-separated circulating bill to the discriminating portion (2305). The discriminating portion 7 determines whether or not the subject paper money sheets are true and discriminates the type of the same (2310). The paper money which has been conveyed through the conveying passage 84 is, if the subject paper money sheet is determined to be true (2317) as the result of the determination made above, accumulated in the stacking portion 82 of the third accumulating portion 8 after it has passed through the conveying passage 85 in accordance with the action performed by the gates 87 and 88 (2320). If the subject paper money sheet is determined to be a reject bill (2317), it is accumulated in the stacking portion 81 of the third accumulating portion 8 after it has passed through the conveying passage 84 in accordance with the action performed by the gate 87 (2325).

The separating action (2305) is repeated until a predetermined number of bills are accumulated in the stacking portion 82 of the third accumulating portion 8 (2330).

If the paper money in the first accumulating portion 61 is exhausted during the separating action (2315), the holding means 5 is lowered by the lift 4 to a position which corresponds to the position of the cash box 9 (2335), separates a predetermined paper money block from the first accommodating portion 91 (2340) and is again raised by the lift 4 (2345) so that this paper money block is supplied to the first accumulating portion 61 of the separating portion 6 (2350), whereby the separating action (2305) is continued.

Figure 44:
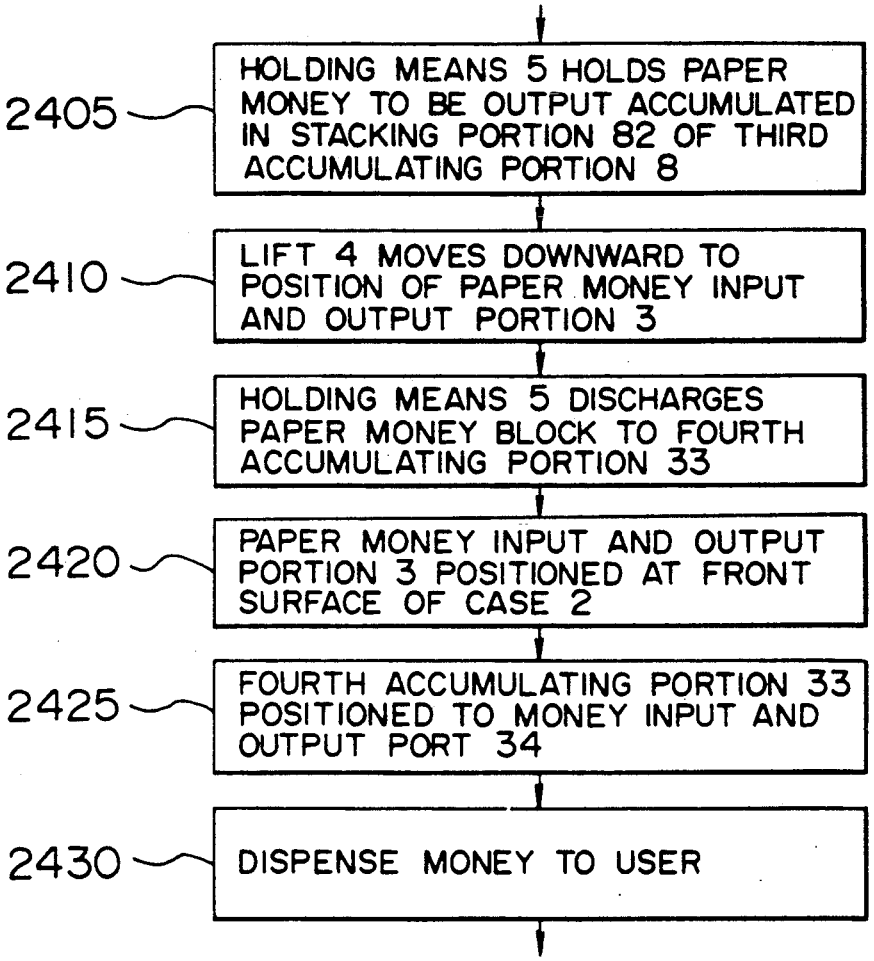

FIG. 44 illustrates the detailed sequence of the money output action 2400. The holding means 4 holds the paper money to be outputted which has been accumulated in the stacking portion 82 of the third accumulating portion 8 (2405), it is lowered by the lift 4 to a position which corresponds to the position of the money input and output portion 3 (2410), then the holding means 5 discharges the paper money block to the fourth accumulating portion 33 which has been positioned to confront this holding means (2415). The money input and output portion 3 rotates relative to the shaft 31, and is positioned to confront the front surface of the case 2 (2420). Simultaneously, the fourth accumulating portion 33 is moved by the motor 32 so as to be positioned confronting the money input and output portion 34 (2425) so that a requested amount of money is dispensed (2430).

Figure 45:
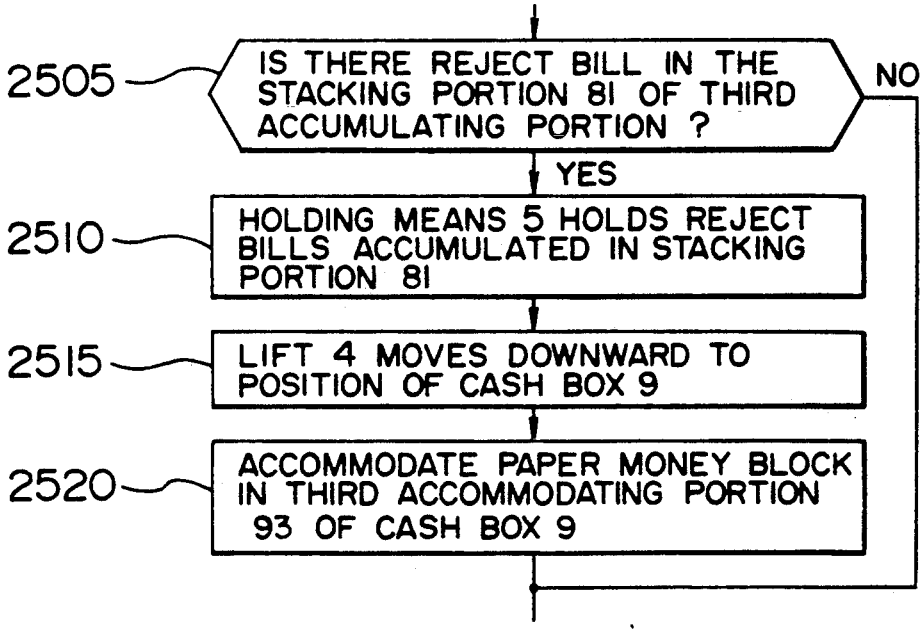

FIG. 45 illustrates the detailed sequence of the reject bill recovery action 2500.

If a determination is made that a counterfeit bill, a damaged bill, or a paper money sheet which cannot be discriminated is included during the non-circulating bill output counting action 2200 and the circulating bill output counting action 2300 and such a reject bill is accumulated in the stacking portion 81 of the third accumulating portion 8 (2505), the holding means 5 holds the reject bill accumulated in the stacking portion 81 of the third accumulating portion 8 (2510), is lowered to a position which corresponds to the position of the cash box 9 by the lift 4 (2515) so that this paper money sheet is accommodated in the third accommodating portion 93 of the cash box 9 (2520). If no reject bill is detected, the reject bill recovery action 2500 is omitted.

Figure 46:
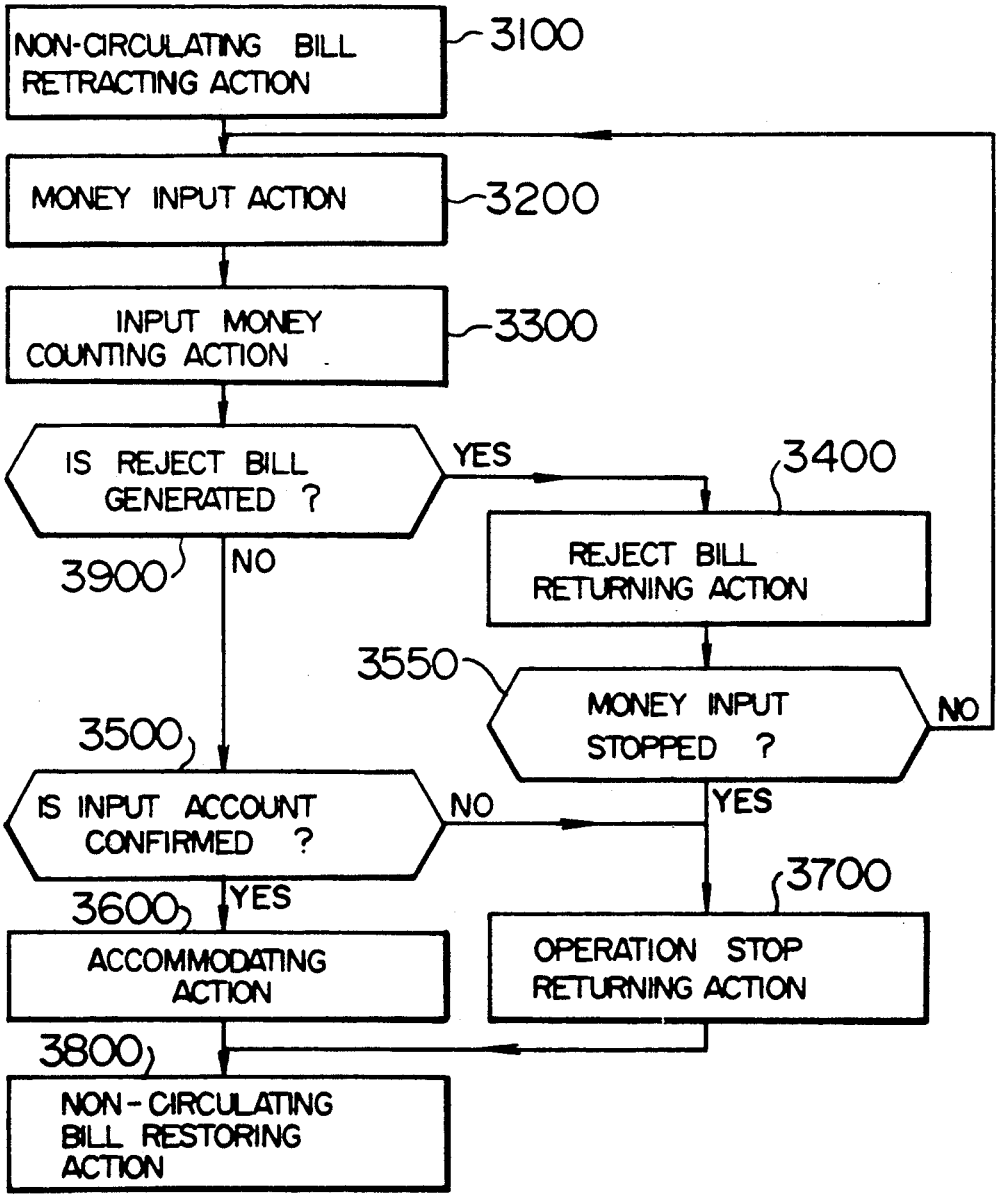

FIG. 46 illustrates the money input action 3000.

The money input action 3000 comprises: a non-circulating bill retracting action 3100 conducted simultaneously with the money input action performed through the keyboard operated by a user; a money input action 3200 for conveying the paper money input by the user from the money input and output portion 3 to the second accumulating portion 62 of the paper money separating portion 6; an input counting action 3300 for separating each paper money and counting the same; a reject bill returning action 3400 for returning accumulated paper money sheets in the stacking portion 81 of the third accumulating portion 8 if a reject bill which has been detected to be a counterfeit bill or a paper money sheet which cannot be discriminated is detected (3900) during the input counting action 3300 and urges the user to again input bill; an input account confirmation 3500 in which the user confirms the account of the input money; an accommodating action 3600 in which the paper money sheets accumulated in the third accumulating portion 8 are accommodated in such a manner that the circulating bill, for example, a ten dollar bill is accommodated in the first paper money accommodating portion 91 of the cash box 9 and a non-circulating bill, for example, one dollar bill is accommodated in the third paper money accommodating portion 93 of the cash box 9 when the user pushes the input account confirmation key so that the input account of paper money sheets is confirmed (3500); an operation stop and money returning action 3700 in which the paper money accumulated in the third accumulating portion 8 is returned to the user when the user pushes the input cancel key to stop the input operation (3350); and a non-circulating bill recovery action 3800 performed after the above-described actions have been completed and arranged such that the paper money sheet which has been retracted by the non-circulating bill retracting action 3100 is recovered to original. That is, when a user inputs, for example, an account of fifty-two dollars in the form of bills and the account is confirmed, five ten dollar bills to be utilized as paper money in a circulated manner are accommodated in the first paper money accommodating portion 91 of the cash box 9 and two one dollar bills which are not to be utilized in the circulated manner are accommodated in the third paper money accommodating portion 93 of the cash box 9.

Figure 47:
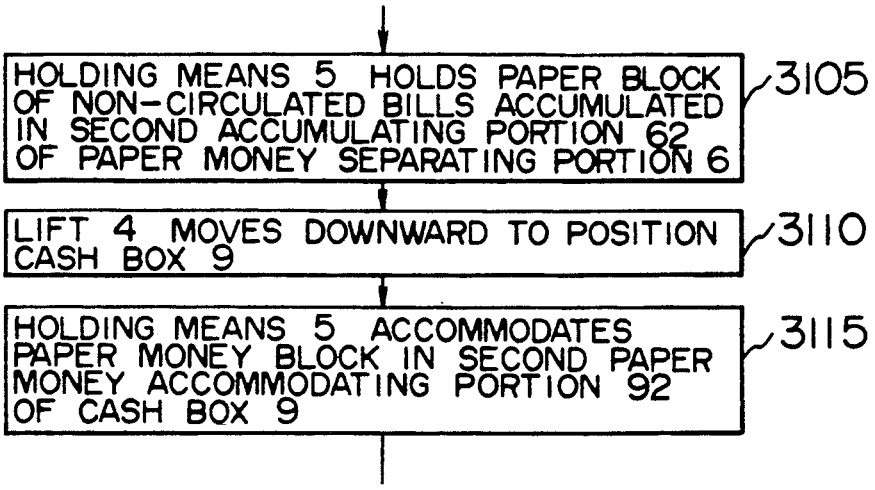

FIG. 47 illustrates the detailed sequence of the non-circulating bill retracting action 3100.

The non-circulating bill retracting action 3100 is an action for retracting the second accumulating portion 62 of the separating portion 6 in which non-circulating bills have been accumulated as a stock to be outputted, with this retracting action being performed during counting of the paper money sheet input by the user. This action is simultaneously performed with the selection of the input action by the user with the keyboard. That is, the holding means 5 holds the paper money block which is a stack of the non-circulating bills accumulated in the second accumulating portion 62 of the separating portion 6 (3105), and is lowered to a position which corresponds to the position of the cash box (3110) so that this paper money block is accommodated in the second paper money accommodating portion 92 of the cash box 9 (3115).

Figure 48:
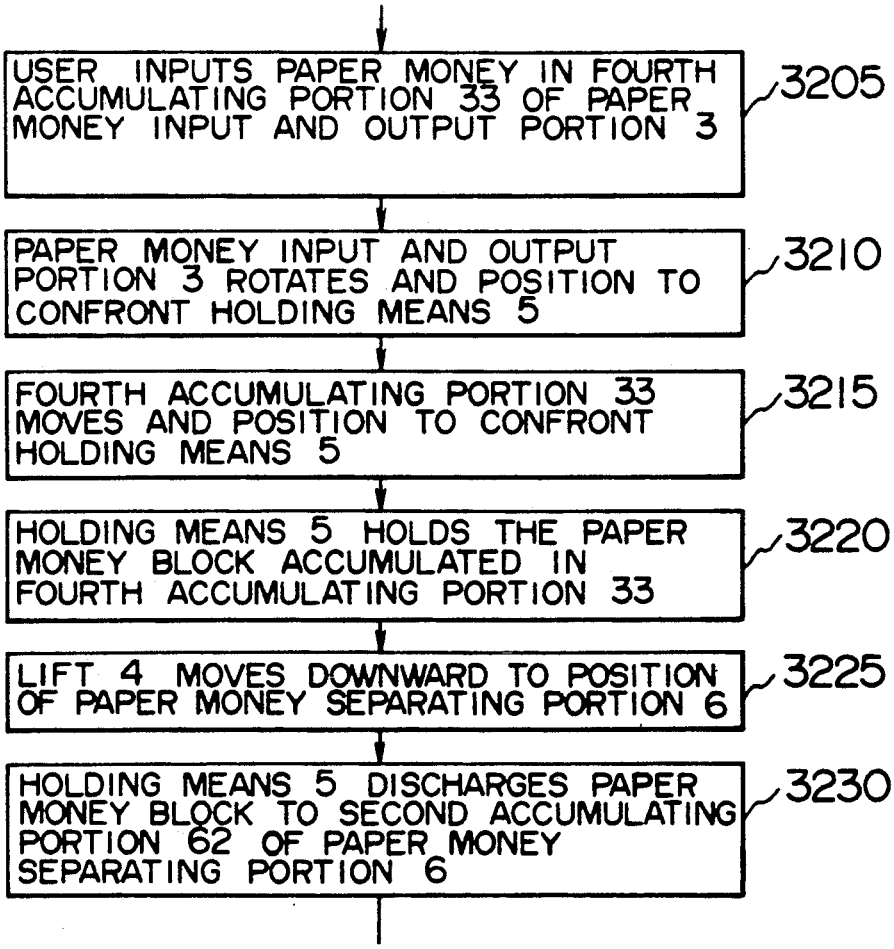

FIG. 48 illustrates the detailed sequence of the money input action 3200.

When paper money sheets are inputted by the user to the fourth accumulating portion 33 through the money input and output port 34 of the money input and output portion 3 which has been positioned to confront the front surface of the case 2 (3205), the money input and output portion 3 is rotated relative to the shaft 31, and is positioned to confront the holding means 5 (3210). Simultaneously, the fourth accumulating portion 33 is, by the motor 32, moved to be positioned to confront the holding means 5 (3215). Then, the holding means 5 holds the paper money block accumulated in the fourth accumulating portion 33 (3220), and is lowered by the lift 4 to the position which corresponds to the position of the paper money separating portion 6 (3225) so that this paper money block is discharged to the second accumulating portion 62 of the paper money separating portion 6 (3230).

Figure 49:
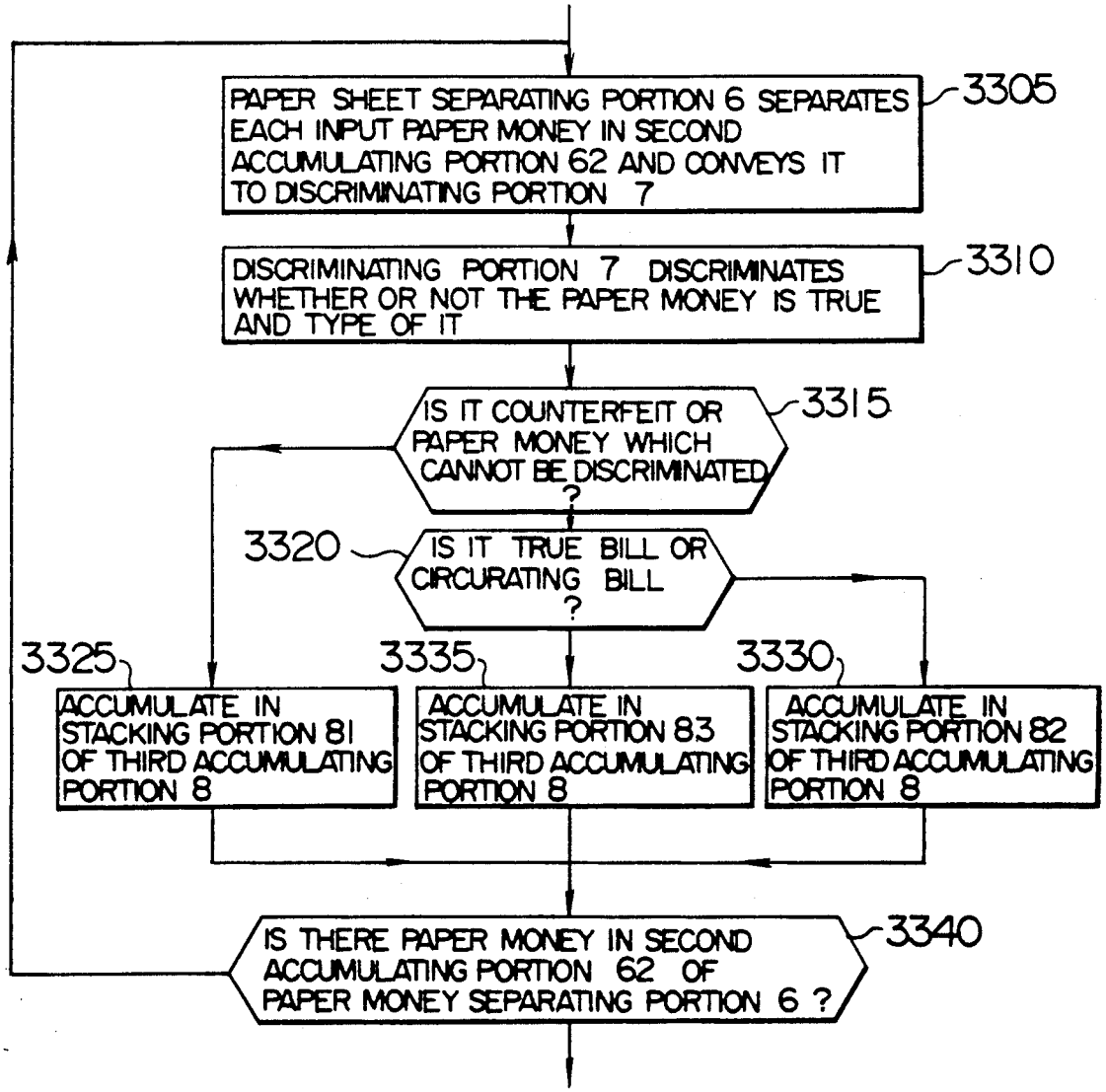

FIG. 49 is a view which illustrates the detailed sequence of the input money counting action 3300.

Separating portion 6 separates each input money sheet in the second accumulating portion 62 conveyed by the holding means 5 in the above-described money input action 3200 and conveys the thus-separated input paper money sheets to the discriminating portion 7 (3305). The discriminating portion 7 determines whether or not the subject paper money sheets are true and discriminates the type of the same (3310). The paper money sheet which has been conveyed through the conveying passage 10 is, if the subject paper money sheet is determined to be a counterfeit bill or a paper money sheet which cannot be discriminated (reject bill) (3315) as a result of the determination made by the discriminating portion 7, accumulated in the stacking portion 81 of the third accumulating portion 8 after it has passed through the conveying passage 84 in accordance with the action performed by the gates 87 (3325). If the subject paper money sheet is determined to be a true circulating bill (3320) it is accumulated in the stacking portion 82 of the third accumulating portion 8 after it has passed through the conveying passage 85 in accordance with the action performed by the gates 87 and 88 (3330). If the subject paper money sheet is determined to be the other type, that is, a damaged non-circulating bill which cannot be circulated so as to be dispensed, it is accumulated in the stacking portion 83 of the third accumulating portion 8 after it has passed through the conveying passage 86 in accordance with the action performed by the gates 87 and 88 (3335). The separating action (3305) is repeated until the quantity of paper money sheets in the second accumulating portion 62 is exhausted (3340).

Figure 50:
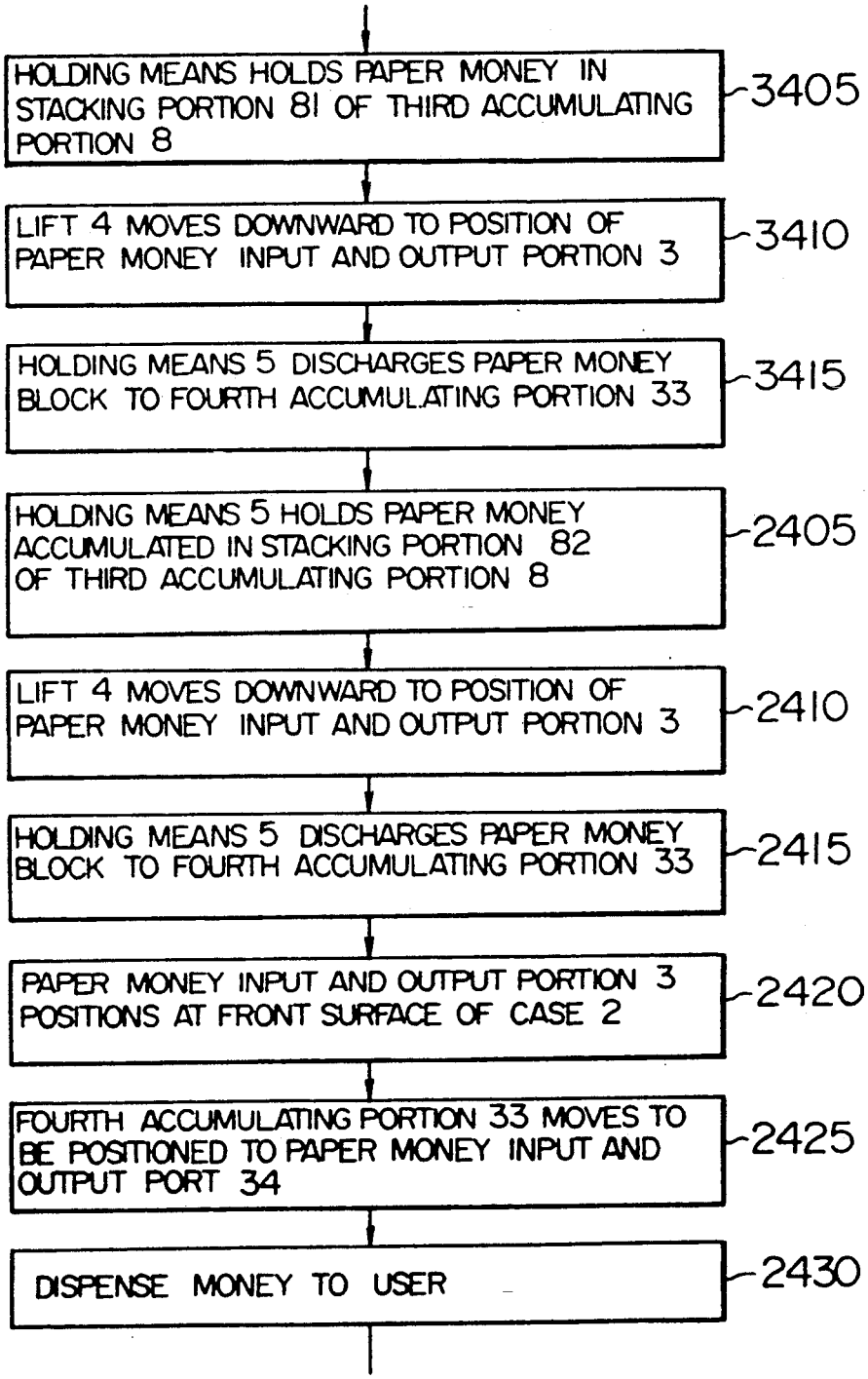

FIG. 50 illustrates the detailed sequence of the reject bill returning action 3400.

If a reject bill which has been determined to be a counterfeit or a paper money sheet which cannot be discriminated is detected during the input money counting action 3300, the holding means 5 holds the thus-detected paper money sheets accumulated in the stacking portion 81 of the third accumulating portion 8 after the input money counting action 33 has been completed (3405). It is then lowered by the lift 4 to the position which confronts the position of the money input and output portion 3 (3410). The thus-held paper money block is discharged to the fourth accumulating portion 33 which has been positioned to confront the holding means 5 (3415). Then, similarly to the above-described money output action 2400, the paper money sheet is returned to the user through the money input and output port 34.

Figure 51:
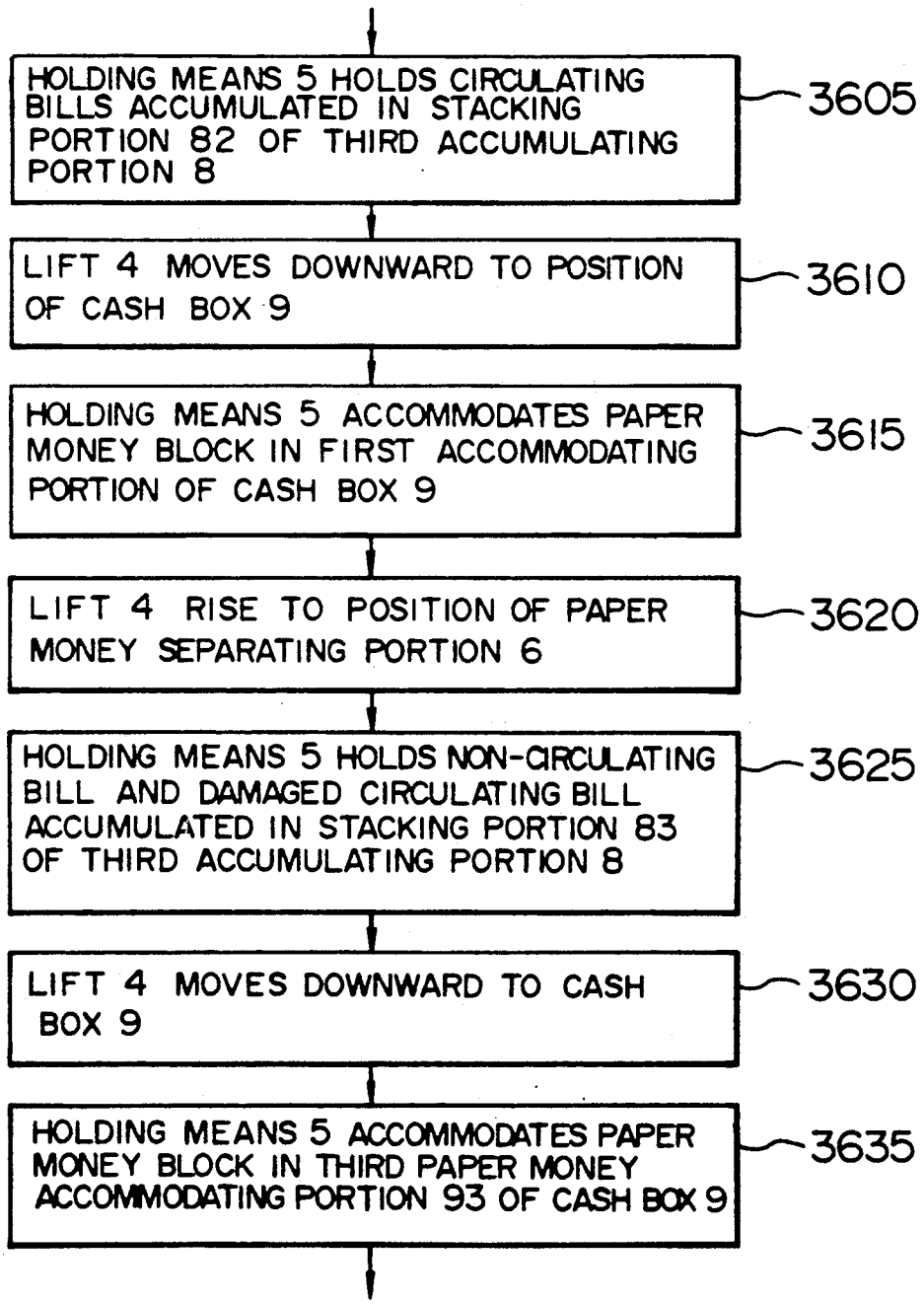

FIG. 51 illustrates the detailed sequence of the accommodating action 3600.

When a user pushes the input account confirmation key so that the input account is confirmed, the holding means 5 first holds the circulating bill accumulated in the stacking portion 82 of the third accumulating portion 8 (3605), and is lowered by the lift 4 to the position which corresponds to the position of the cash box 9 (3610) so that this paper money block is accommodated in the first accommodating portion 91 of the cash box 9 (3615). Then, the holding means 5 is again raised by the lift 4 to the position which confronts the position of the separating portion 6 (3620), holds the non-circulating bills or the damaged circulating bills accumulated in the stacking portion 83 of the third accumulating portion 8 (3625), and is lowered by the lift 4 to the position confronting the position of the cash box 9 (3630) so that this paper money block is accommodated in the paper money accommodating portion 93 of the cash box 9 (3635).

Figure 52:
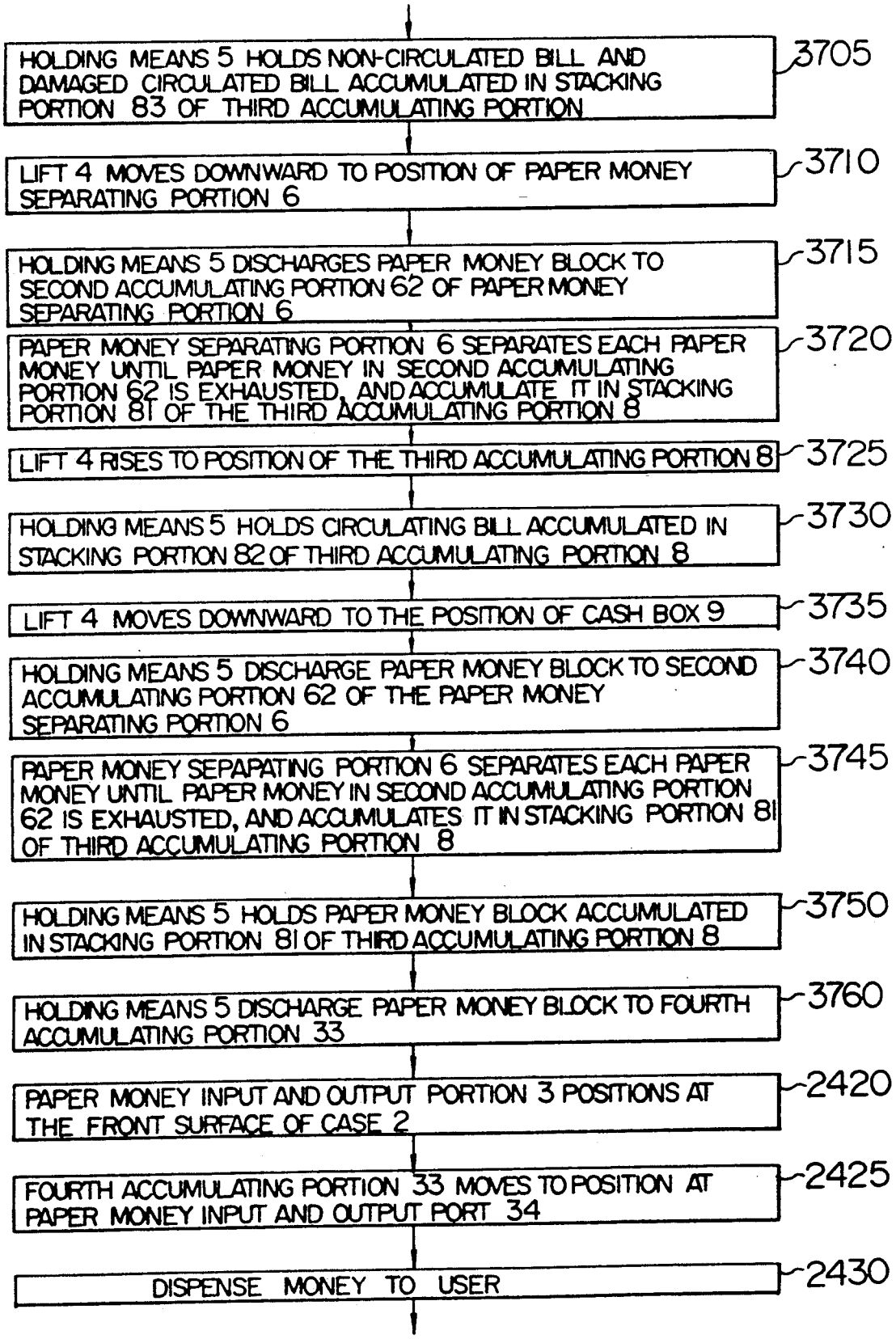

FIG. 52 illustrates the detailed sequence of the cancel and money returning action 3700.

When a user pushes the money input cancel key to cancel the money input and output action, the holding means first holds the damaged one of the non-circulating bills or the damaged circulating bill accumulated in the stacking portion 83 of the third accumulating portion 8 (3705), and is lowered by the lift 4 to the position which corresponds to the position of the separating portion 6 (3710) so that the paper money block is discharged to the accumulating portion 62 of the paper money separating portion 6 (3715). The separating portion 6 separates each paper money until the paper money sheets accumulated in the second accumulating portion 62 are exhausted. The thus-separated paper money is accumulated in the stacking portion 81 of the third accumulating portion 8 after it has passed through the conveying passage 10, gate 87 and the conveying passage 84 (3710). Then, the holding means 5 is, by the lift 4, again raised to the position which corresponds to the position of the third accumulating portion (3725) so as to hold the circulating bills accumulated in the stacking portion 82 of the third accumulating portion 8 (3730), and is lowered by the lift 4 to the position which corresponds to the cash box 9 (3735) so that the paper money block is discharged to the second accumulating portion 62 of the paper money separating portion 6 (3740). The paper money separating portion 6 similarly separates each of the paper money sheets so as to accumulate them in the stacking portion 81 of the third accumulating portion 8 (3745). When all of the thus-input paper money is accumulated in the stacking portion 81 of the third accumulating portion 8, the holding means 5 holds this paper money block (3750), and is lowered by the lift 4 to the position which corresponds to the position of the money input and output portion 3 (3755) so that the paper money block is discharged to the fourth accumulating portion 33 which has been conditioned to confront the holding means 5 (3760). Then, similarly to the above-described money output action 2400, the paper money is returned to the user through the money input and output port 34.

Figure 53:
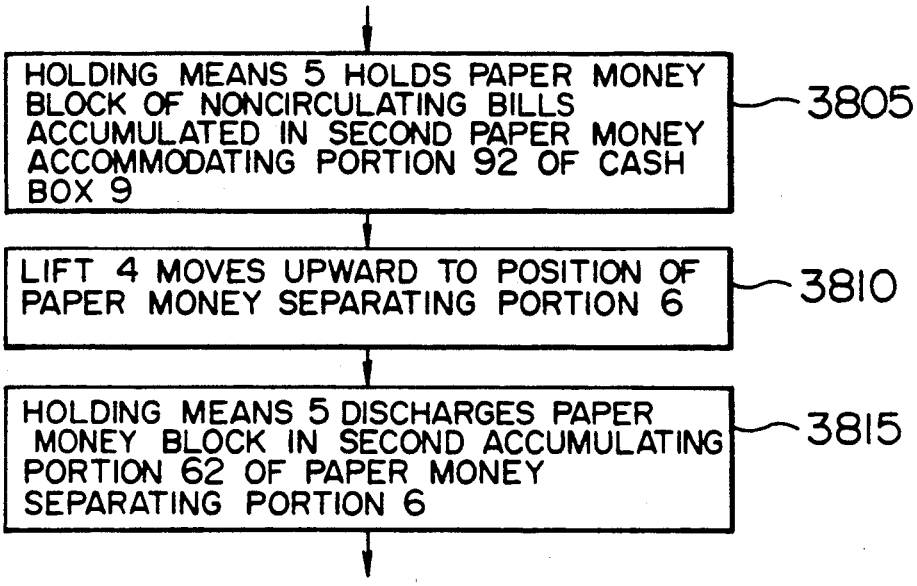

FIG. 53 illustrates the detailed sequence of the non-circulating bill restoring action 3800.

The non-circulating bill restoring action 38 is an action to return the non-circulating bills to be outputted which have been retracted in the non-circulating bill retracting action 3100 to the second accumulating portion 62 of the separating portion 6.

That is, the holding means 5 holds the paper block of the non-circulating bills accumulated in the second paper money accommodating portion 92 of the cash box 9 (3805), and is raised by the lift 4 (3810) so that this paper money block is discharged to the second accumulating portion 62 of the paper money separating portion 6 (3815).

Figure 54:
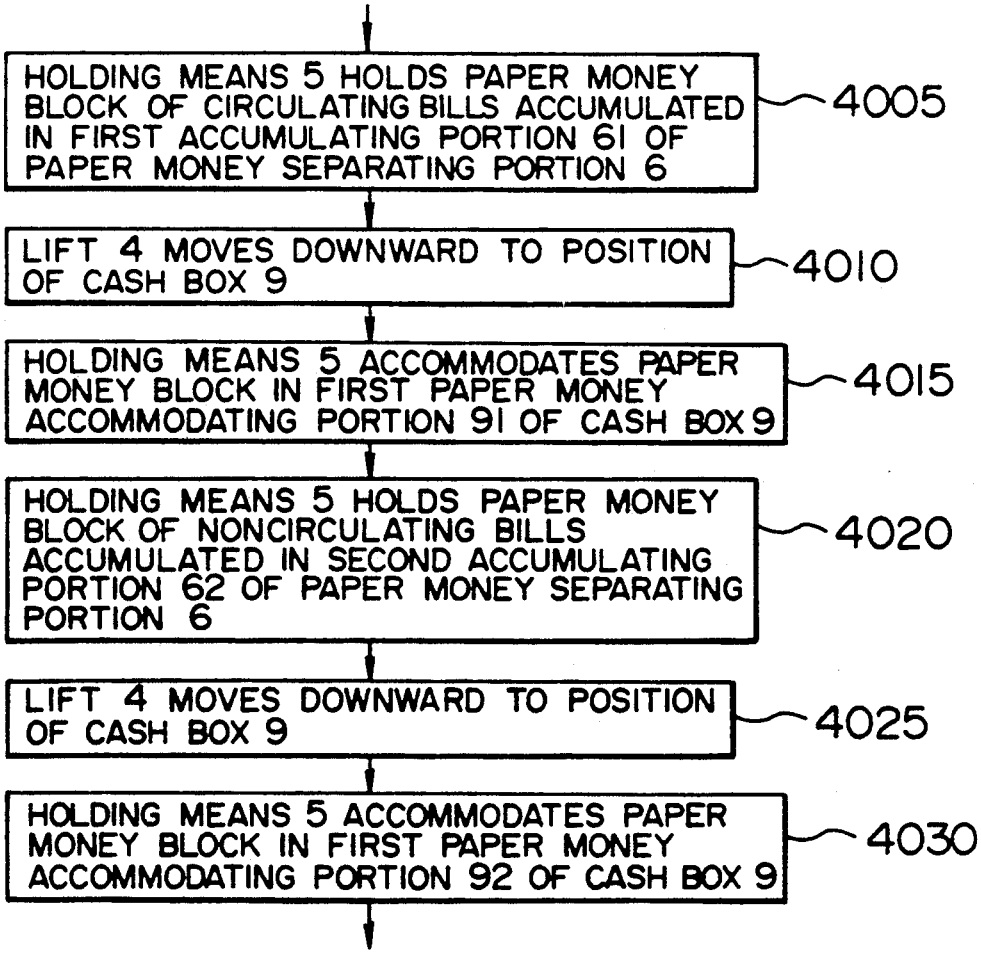

FIG. 54 illustrates the accommodating action 4000 when the apparatus is stopped.

First, the holding means 5 holds the paper money block of the circulating bills accumulated in the first accumulating portion 61 of the separating portion 6 (4005), and is lowered by the lift 4 to the position which corresponds to the position of the cash box 9 (4010) so that this paper money block is accommodated in the first paper money accommodating portion 91 of the cash box (4015). Then, the holding means 5 holds the paper money block of the non-circulating bills accumulated in the second accumulating portion of the paper money separating portion 6 (4020), and is lowered by the lift 4 to the position which corresponds to the position of the cash box 9 (4025) so that this paper money block is accommodated in the first paper money accommodating portion of the cash box 9 (4030).

The automatic cashier according the present invention is operated in accordance with the above-described sequence.

According to the above-described embodiment, since the separating means for separating a predetermined number of paper money sheets from the sheets of paper money accumulated in the paper money accumulating means, the paper money accommodating means for accommodating a predetermined number of paper money sheets in addition to the paper money sheets which have been accumulated in the paper money accumulating means, and the holding and conveying means are integrally formed, the overall size of the apparatus can be reduced.

Figure 55:
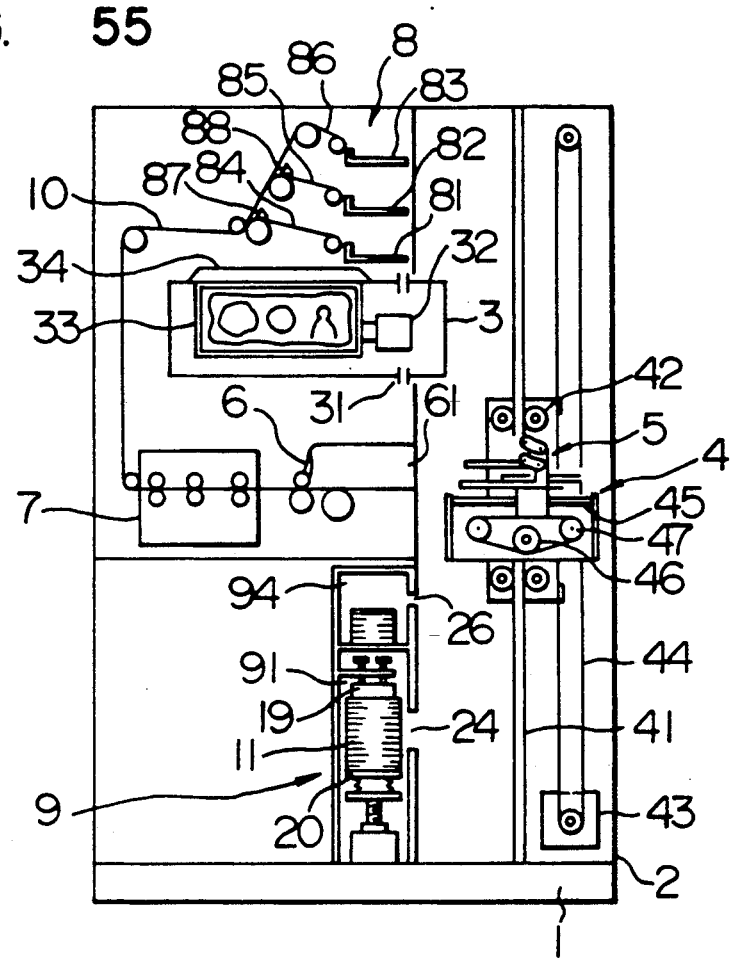
FIG. 55 is a schematic view of another embodiment of an automatic cashier according to the present invention.

According to the embodiment of FIG. 55, the separating portion 6 includes only the first accumulating portion 61. The cash box 9 includes the first paper money accommodating portion 91 and the fourth paper money accommodating portion 94, with the first paper money accommodating portion 91 accommodating the circulating bills, while the fourth paper money accommodating portion 94 accommodates non-circulating bills and reject bills.

Figure 56:
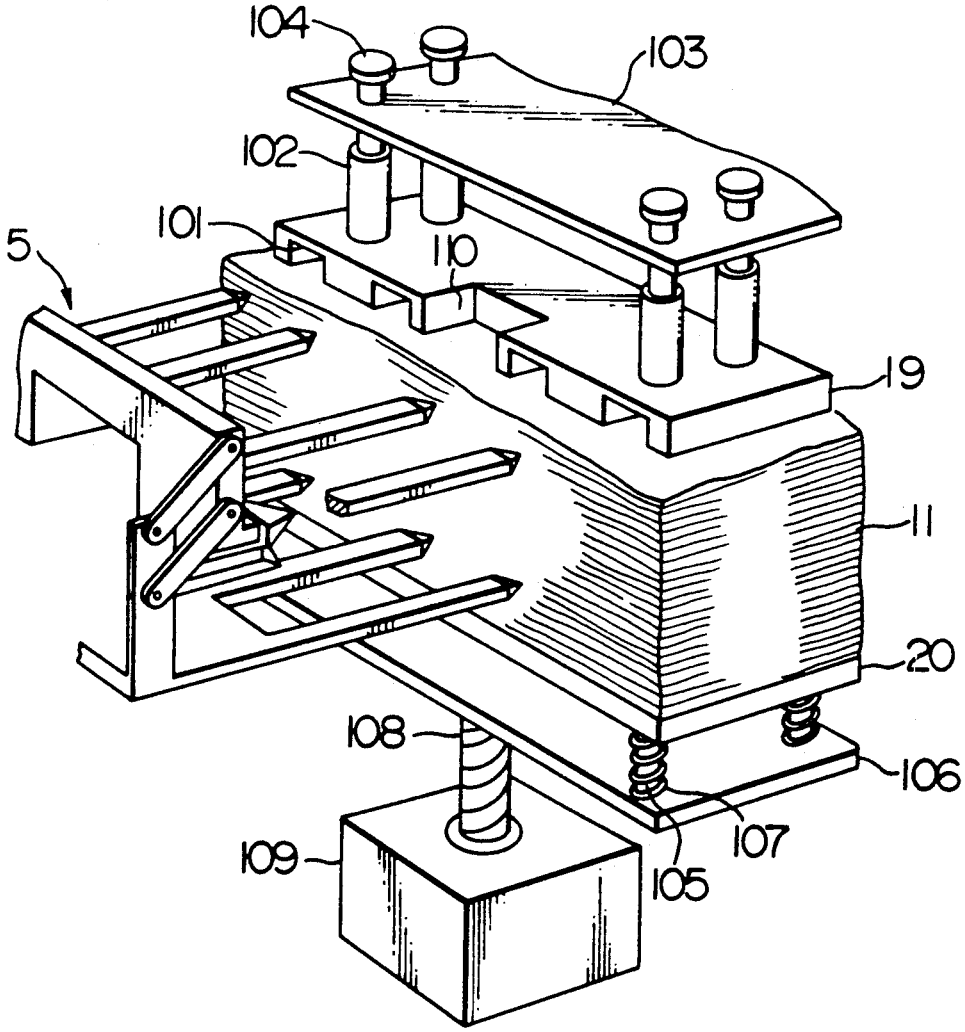
FIG. 56 is a perspective view of a first paper money accommodating portion of the cash box of the automatic cashier of FIG. 55.

As shown in FIG. 56, a notch 110 is formed in the push plate 19 on the side confronting the holding means 5.

Figure 57:
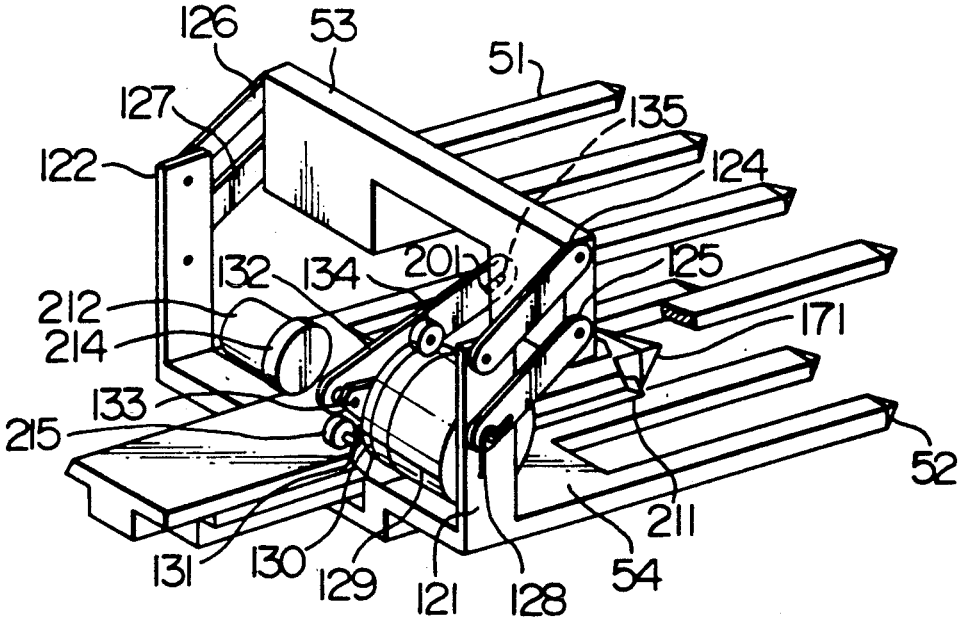
FIG. 57 is a perspective view of the holding means of the automatic cashier of FIG. 55.
Figure 58:
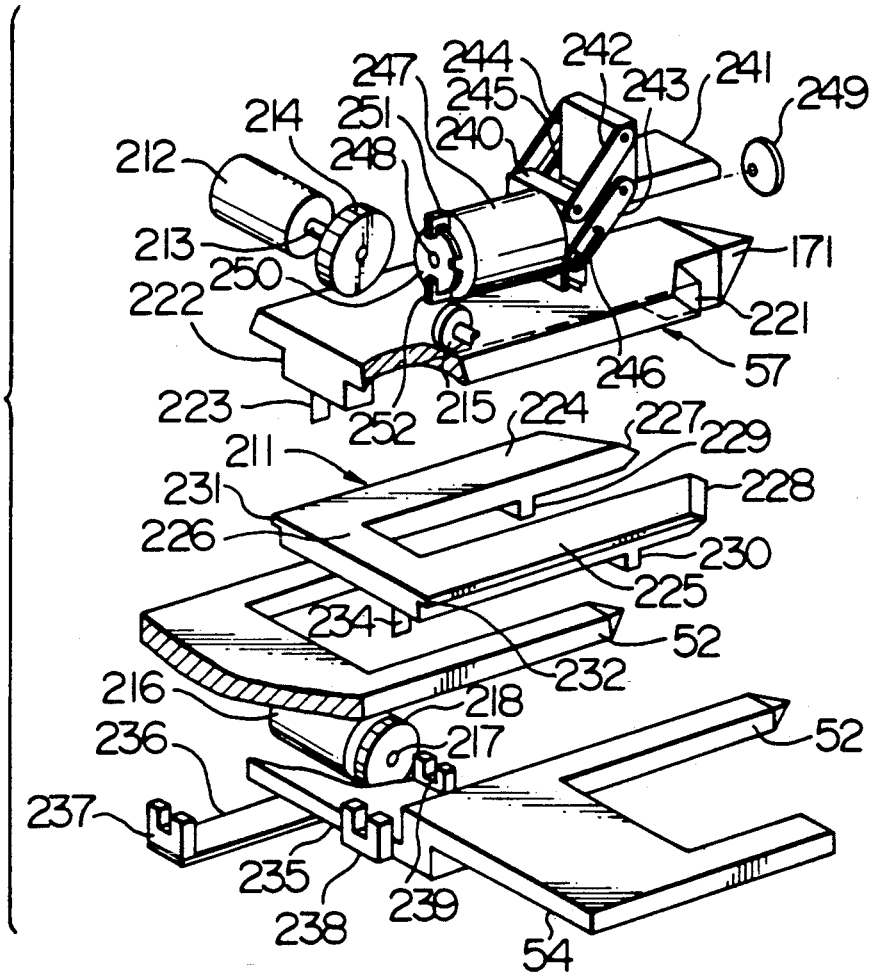
FIG. 58 is an exploded view which illustrates the holding means of FIG. 57.
Figure 59:
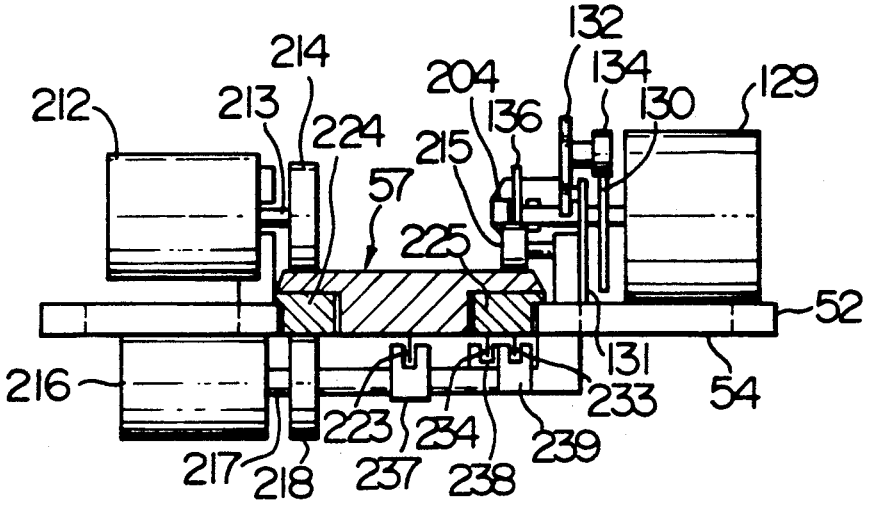
FIG. 59 is a partial cross-sectional view of the holding means shown in FIG. 57.

FIGS. 57, 58 and 59 provide an example of the holding means of the embodiment of FIG. 55, wherein a link plate 132 is coupled to the second bearing plate 131 by a shaft 133 including the cam follower 134 capable of coming in contact the cam plate 130. The link plate 132 is connected to the shaft 135 and is fastened to the upper holding plate 53 by an elongated guide slot 201 formed therein. The slit plate 136 is coupled to the shaft 203 of the fifth motor 129. A first sensor 204 is so fastened to the second bearing plate 131 as to be disposed to have the slit plate 136 held therebetween.

Figure 60:
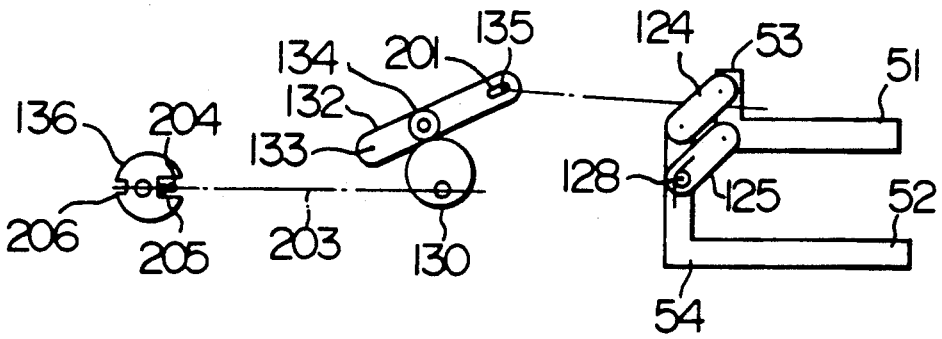
FIGS. 60 to 74 are views which illustrate the operations of the components of the holding means according to the present invention.
Figure 61:
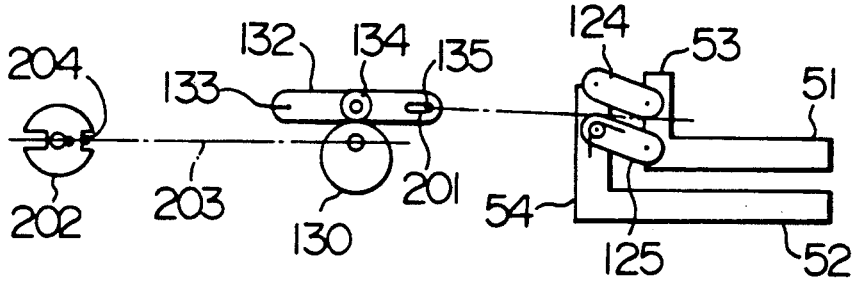

FIGS. 60 and 61 illustrate the shape and movement of the slit plate 136, the operation of the first sensor 204, the cam plate 130, the lower holding plate 54, and the upper holding plate 53.

FIG. 60 illustrates the original position, in which both the two optical axes of the first sensor 24 are turned on by an elongated hole 205 formed in a first slit plate 202 coupled to a shaft 203 of the fifth motor 129, and the motor 129 is stopped. At this time, since the cam plate 130 coupled to the shaft 203 of the fifth motor 129 pushes the cam follower 134 upwardly, the link plate 132 upwardly pushes the shaft 135 coupled to the upper holding plate 53 through the elongated guide slot 201. As a result, the lower holding fingers 52 and the upper holding fingers 51 are opened. Referring to FIG. 61, the fifth motor 129 is rotated by 180° with respect to the original position with the lower holding fingers 52 and thus the upper holding fingers 51 are closed, and either of the two optical axes of the first sensor 204 is turned on by a short hole 206 formed in the first slit plate 202 fastened to the shaft 203 of the fifth motor 129, and the fifth motor 129 is stopped. At this time, the cam plate 130 coupled to the shaft 203 of the fifth motor 129, loses its force to push the cam follower 34 upwardly, and the lower holding fingers 52 and the upper holding fingers 51 are closed by the torsion spring 182. Therefore, if a paper money block or the like is present between the lower holding fingers 52 and the upper holding fingers 51, it can be held with a proper holding force, preventing any excess force from acting on the fifth motor 129 and the linking plate 132.

The separating member 57 comprises a pointed member 171 and a setter 211 for moving this pointed member 171 held thereon to the lower holding plate 54 and the lower holding plate 52 connected thereto. A seventh motor 212 is disposed above the lower holding plate 54. A first friction wheel 214 is connected to the shaft 213 of the seventh motor 212 in such a manner that the thus-connected friction wheel 214 contacts the pointed member 171. A guide wheel 215 is connected to the third bearing plate 131, an eighth motor 216 is disposed below the lower holding plate 54, and a second friction wheel 218 is connected to a shaft 217 of the eighth motor 216 in such a manner that the thus-connected second friction wheel 218 contacts the setter 211.

The pointed member 171 is arranged at the central portion of the separating member 57, with edge portions 221 on both sides thereof, and a stopper 222 and a second slit plate 223 disposed in the lower portion at the rear end portion thereof. The setter 211 is formed by guide portions 224 and 225, and a connecting portion 226 for connecting the guide portions 224 and 225. The guide portions 224 and 225 have introducing edge portions 227 and 228 at the front lower portions thereof, movement guides 231 and 232 at two sides thereof, and a third slit plate 233 and a fourth slit plate 234 on the bottom side of the connecting portion 226 thereof. The two lower holding plates 54 are connected by a connecting member 235 at the position below the setter 211 so as to form a U-shape. This connecting member 235 is provided with a second sensor 237 at a position on the locus of the movement of the second slit plate 223 melted through a stator 236 on the pointed member 171 such that the second sensor 237 sandwiches the slit plate 223, and a third sensor 238 and a fourth sensor 239 at a position on the loci of the third slit plate 223 and the fourth slit plate 234 mounted on the setter 211 such that the third and the fourth sensors 238 and 239 sandwich the third and the fourth slit plates 233 and 234. A third bearing 204 is provided on the pointed member 171. A holding finger 241 is connected to the third bearing 240 by second parallel linking plates 242, 243, 244 and 245. This parallel linking plate 243 and the third bearing plate 240 are connected to each other by a second torsion spring 246. A ninth motor 247 is mounted on the third bearing plate 240. A second cam plate 249 is coupled to a shaft 248 of the ninth motor 247. A fifth slit plate 250 is coupled to the shaft 248 of the ninth motor 247. A fifth sensor 251 and a sixth sensor 252 are provided for the ninth motor 247 such that they sandwich the fifth slit plate 250.

FIGS. 62 to 65 illustrate the actions of the pointed member 171, setter 211, and first and second friction wheels 214 and 218, and the positional relationship of the components group consisting of the second slit plate 223 provided for the projecting member 171, third and fourth slit plates 233 and 234 provided for the setter 211, second, third and fourth sensors 237, 238 and 239 fastened to the connecting member 235. In order to make the relationship clear in the drawings, the vertical positions are shifted.

Figure 62:
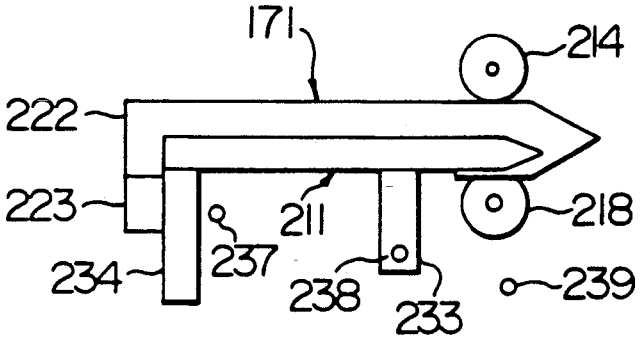

FIG. 62 illustrates a state where the pointed member 171 and the setter 211 are positioned at the farthest position in the holding means, that is, they are at the original position. The stopper 222 of the pointed member 171 and the connecting portion 226 of the setter 211 contact each other, causing the third slit plate 233 to turn on the third sensor 238.

Figure 63:
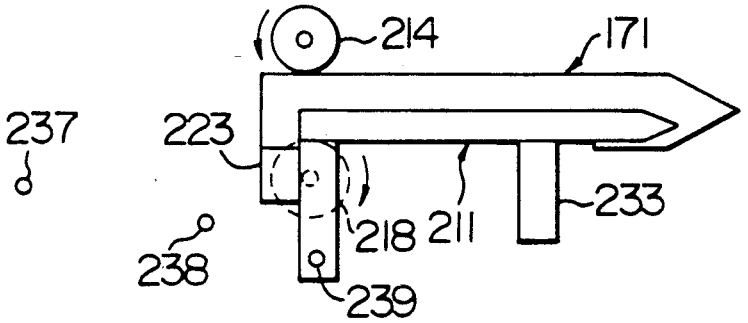

FIG. 63 illustrates a state where the pointed member 171 and the setter 211 project by the maximum degree over the holding means. When the first friction wheel 214 is rotated in a counterclockwise direction, as viewed in the drawing, by the seventh motor 212 from the original position shown in FIG. 62, the pointed member 171, positioned in contact with the friction wheel 214 moves forward, causing the stopper 222 of the pointed member 171 to push the connecting portion 226 of the setter 211. As a result, the setter 211 is also moved forward. The seventh motor 212 is stopped when the fourth slit plate 234, fastened to the setter 211, turns on the fourth sensor 239.

Figure 64:
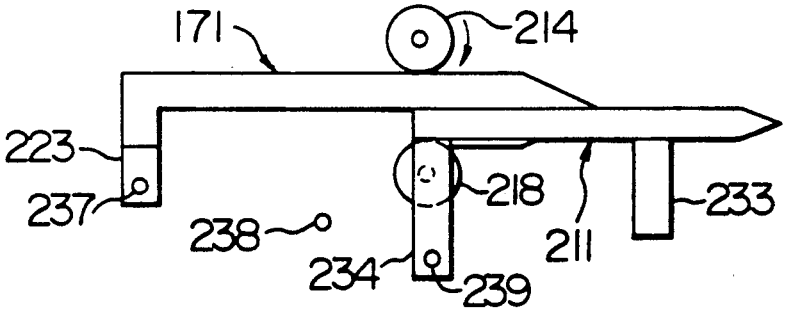
Figure 65:
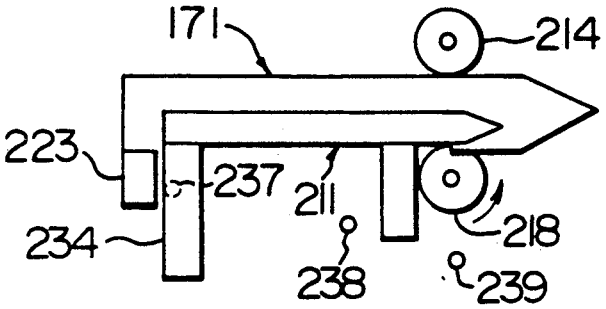

FIG. 64 illustrates a state where the pointed member 171 is retracted and only the setter 211 projects over the holding means by the maximum degree, that is, the retracted position. When the first friction wheel 214 is rotated by the seventh motor 212 in a counterclockwise direction, as viewed in the drawing from the retracted portion shown in FIG. 63, only the pointed member 171, positioned in contact with the friction wheel 214, is retracted, while the setter 211 remains in the projected position. The seventh motor 212 is stopped when the second slit plate 223, fastened to the projecting member 171, turns on the second sensor 237.

FIG. 64 illustrates a state where the setter 211 is also retracted, that is, a holding position. When the third friction wheel 218 is, by the eighth motor 216, rotated in a counterclockwise direction from the retracted position shown in FIG. 64, the setter 211, in contact with the third friction wheel 218, is moved rearward. The eighth motor 216 is stopped when the connecting portion 226 pushes the stopper 212, and the second slit plate 223 fastened the projecting member 171 turns off the second sensor 237. The third friction wheel 218 is rotated in a counterclockwise direction, as viewed in the drawing, by the third motor 216, and the setter 211, in contact with the third friction wheel 218, pushes the stopper 222, so that the third slit plate 223, fastened to the setter 211, is rotated until it turns on the third sensor 237. As a result, the components are restored to the original position shown in FIG. 62.

Figure 66:
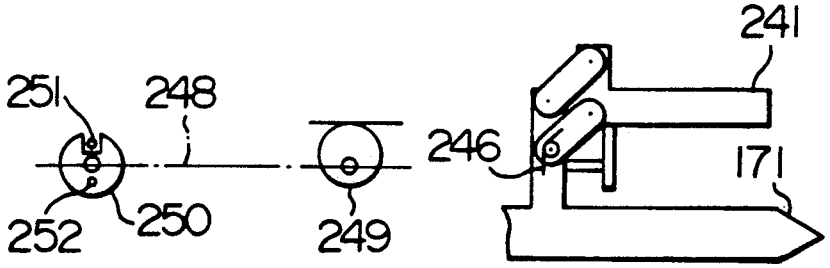
Figure 67:
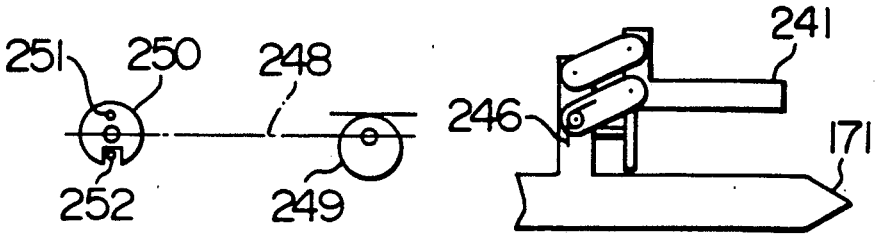

Then, the holding action will be described. FIGS. 66 and 67 are views which illustrate the positional relationship of the components group consisting of the fifth slit plate 250 coupled to the shaft 248 of the ninth motor 247, the fifth sensor 251 and sixth sensor 252 fastened to the ninth motor 247 such that they sandwich the fifth slit plate 250, and the operation of the second cam plate 249 coupled to the shaft 248 of the ninth motor 247 and holding finger 241.

FIG. 66 illustrates the original position, where the fifth sensor 251 is turned on, the sixth sensor 252 is turned off, and a ninth motor 247 is stopped by the hole formed in the fifth slit plate 250 fastened to the shaft 248 of the ninth motor 247 with the holding finger 241 opened. At this time, the second cam plate 249 coupled to the shaft 248 of the ninth motor 247 opens the holding finger 241.

Referring to FIG. 67, the ninth motor 247 is rotated by 180° with respect to the original position, the fifth sensor 251 is turned off and the sixth sensor 252 is turned on by the hole formed in the fifth slit plate 250 coupled to the shaft 248 of the ninth motor 247, and the ninth motor 247 is stopped with the holding finger 241 closed. At this time, the cam plate 249 coupled to the shaft 248 of the ninth motor 247 loses its force to push the holding finger 241 upwardly so that it is closed by the second torsional spring 246. Therefore, if a paper money block or the like is present between the holding fingers 241 and the pointed member 171, it can be held by a proper holding force, preventing the ninth motor 247 from being subjected to any excessive force.

Figure 68:
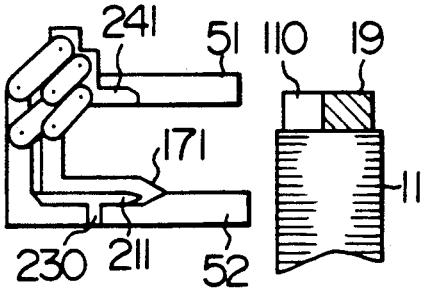

FIGS. 68 to 73 illustrate the operations of the upper holding fingers 51 and the pointed member 171, the setter 211 and the holding finger 241, with FIG. 68 illustrating the original state wherein the upper holding fingers 51 are opened, the holding finger 241 is opened, and the pointed member 171 and the setter 211 are positioned at the farthest position of the holding means. This original state corresponds to the states described in connection with FIGS. 60, 62 and 66.

Figure 69:
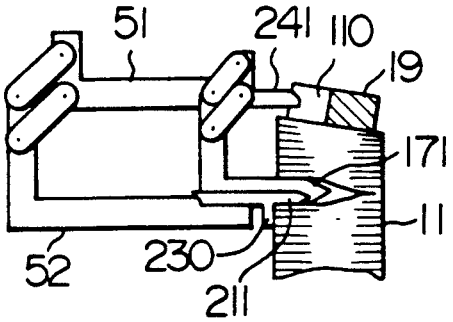
Figure 70:
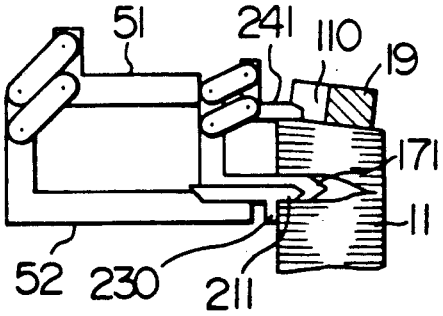
Figure 71:
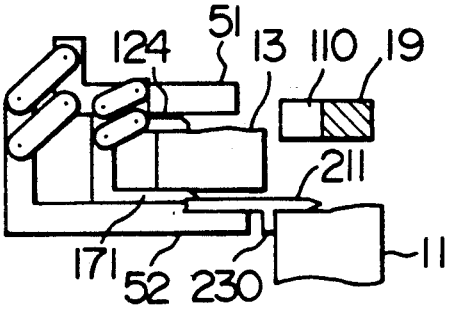

FIG. 69 illustrates a projection state wherein the pointed member 171 projects by the maximum degree over the holding means with the upper holding fingers 51 opened and the holding finger 241 opened so that the projecting member 171 and the setter 211 are inserted into the accumulated paper money sheets while the holding finger 241 is introduced into the notch 110 formed in the push plate 19. At this time, since the accumulated paper money sheets 11 are supported under a predetermined compressive force and with a predetermined compliance, an upper part of the accumulated paper money sheets 11 can be smoothly vertically separated by the inserted pointed member 171 and the setter 211. Then, the holding finger 241 is closed, and the state of holding shown in FIG. 70 is realized, with this state corresponding to the state shown in FIG. 67. FIG. 71 illustrates an extraction state in which the projecting member 171 is retracted with the holding finger 241 closed so that a block 13 of a predetermined number of paper money sheets is taken in the holding means, with this state corresponding to the state shown in FIG. 64. At this time, the setter 211 is stopped so that the stoppers 229 and 230 at the lower front portion of the setter 211 prevent the residual accumulated paper money sheets 11 below the setter 211 from being adversely raised or moved outside of the cash box.

Figure 72:
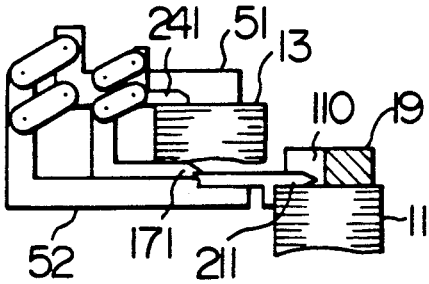
Figure 73:
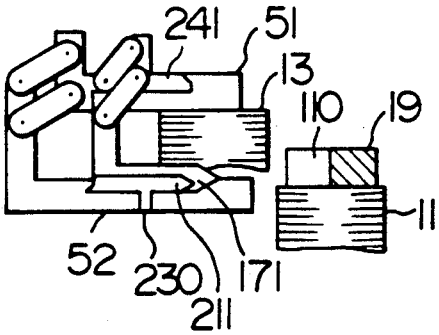

In the holding state as shown in FIG. 72, the upper holding fingers 51 are closed so that the separated money block 13 is held, and the push plate 19 is lowered to apply a load to the residual accumulated paper money sheets 11. Then, as shown in FIG. 73, the setter 211 is retracted, and the holding finger 241 is opened, with this state corresponding to the states shown in FIGS. 61, 65 and 66.

Figure 74:
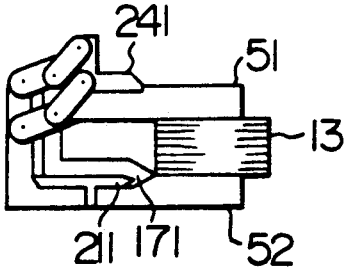

FIG. 74 illustrates the conveying state where the upper holding fingers 51 are closed, the holding finger 241 is opened, and the pointed member 171 and the setter 211 are returned to the original position which is farthest position in the holding means. In this state, the separated money block 13 is held and conveyed by the four parallel lower holding fingers 52 and the four parallel upper holding fingers 51.

The difference of the overall operation of the automatic cashier shown in FIG. 55 from that shown in FIG. 2 lies only in the paper money accommodating action and separating action performed in the separating portion 6 and the cash box 9 since the types of the subject paper money sheets to be utilized as the circulating bills are different and the other components are arranged in substantially the same manner as in the embodiment of FIG. 2.

The structure of the holding means of the apparatus shown in FIG. 2 and the structure of the holding means of the apparatus shown in FIG. 55 are not limited to that described above and can be optionally modified.

According to the embodiments described above, since the separating portion for separating a predetermined number of bills from the accumulated paper money sheets and the holding means for holding the paper money sheets are integrally formed, the overall size of the apparatus can be reduced. In addition, by reducing the size of the mechanism for collectively conveying the paper money sheets, the overall size of the automatic cashier can be reduced.

Figure 75:
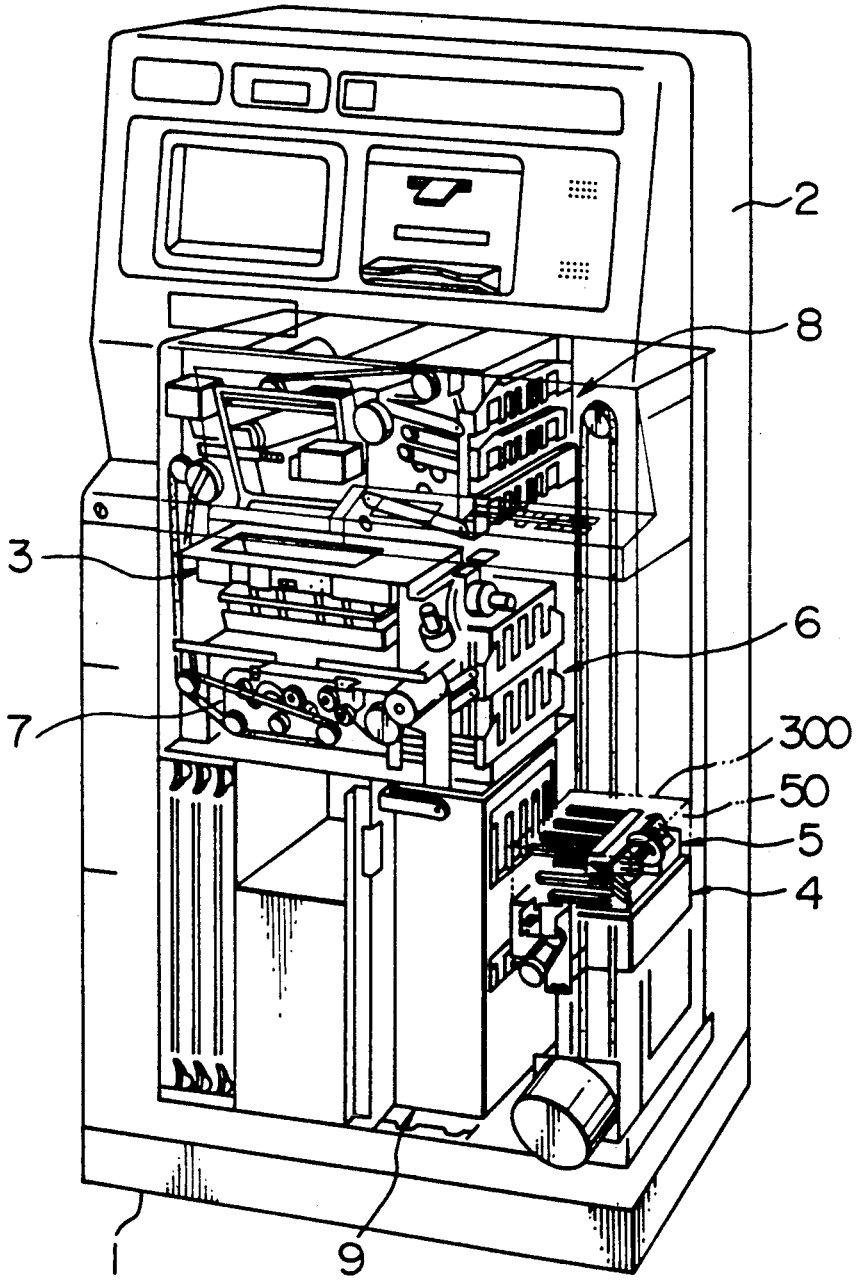
FIG. 75 is a perspective view of a further embodiment of an automatic cashier according to the present invention.
Figure 76:
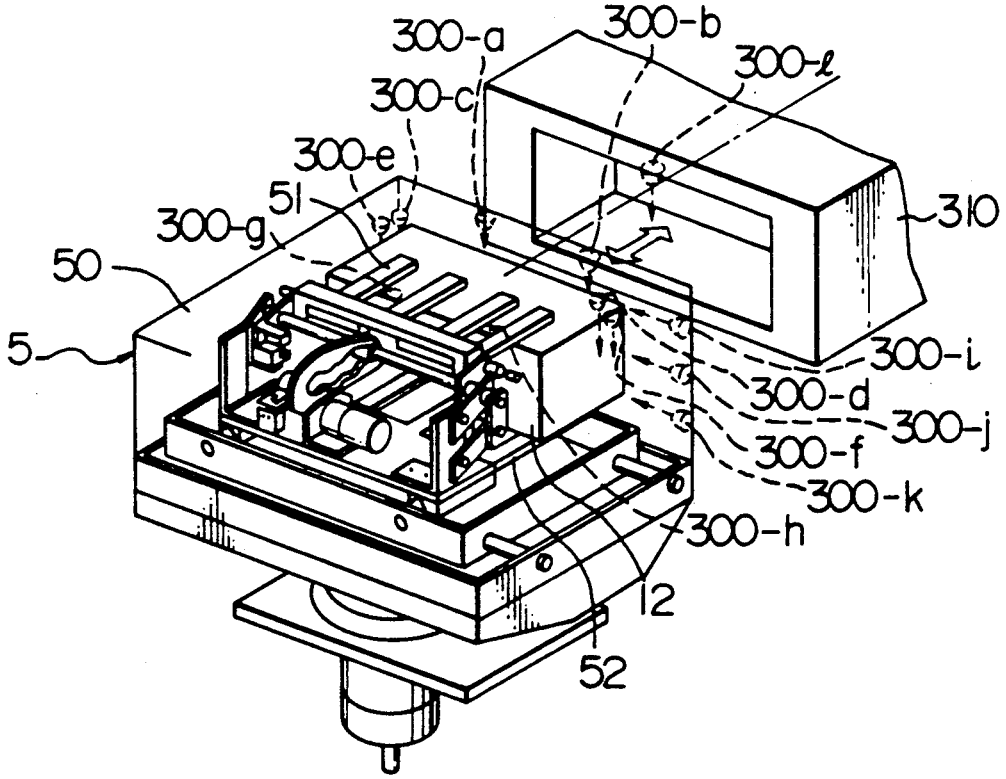
FIG. 76 is a perspective view of the holding means of the automatic cashier of FIG. 75.

According to the embodiment of FIGS. 75 and 76, a paper money detection sensor means 300 for detecting the abnormality of the paper money sheets is provided on a frame portion 50 of the holding means 5 and an associated component 310.

Figure 77:
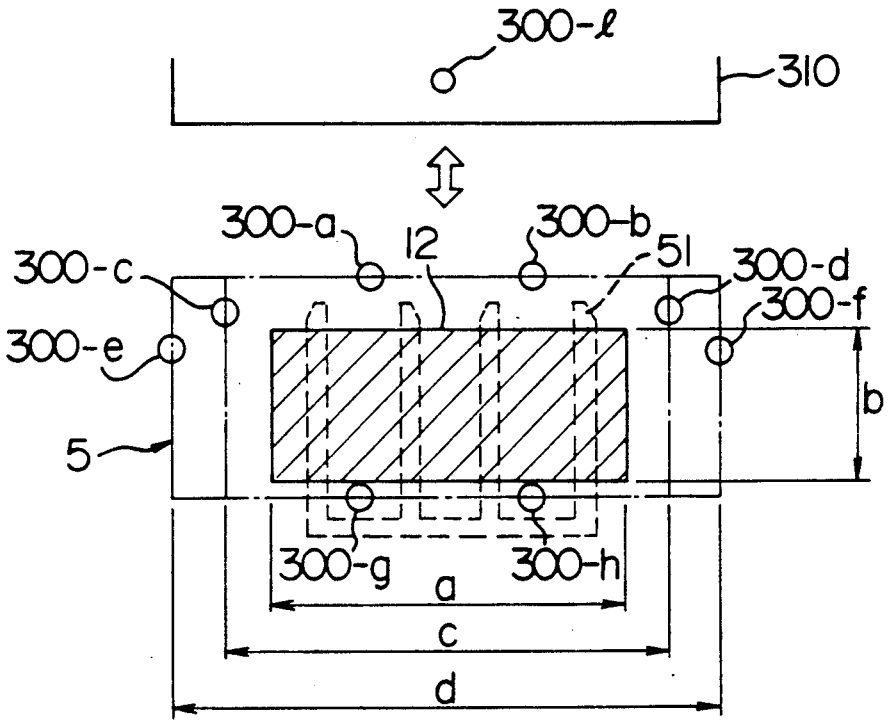
FIGS. 77 and 78 are schematic views of an arrangement of paper money detection sensors.
Figure 78:
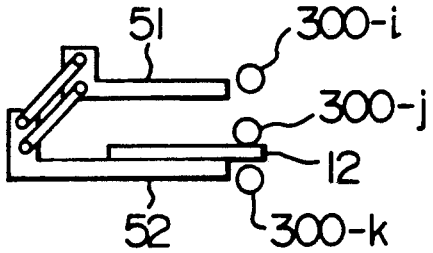

FIG. 75 illustrates the overall shape of the automatic cashier having the paper money detection means referenced above, with FIG. 76 illustrating a portion of the holding means 5, and FIGS. 77 and 78 illustrating the arrangement of the sensor means 300. The sensor means 300 are disposed at a plurality of positions on the frame portion 50 and the corresponding component 310. According to this embodiment, eleven sensor means 300-*a* to 300-*k* are provided in the frame portion 50, while one sensor means 300-*l* is provided in the associated component 310.

The sensor means 300-*a* to 300-*h* of the sensor means 300-*a* to 300-*k* are disposed at the positions which correspond to the allowable limit within which the paper money sheets having the dimensions a and b can be conveyed normally by the holding means. On the other hand, the sensor means 300-*i* to 300-*k* are so disposed so as to be capable of detecting any hanging or undulation of the paper money sheets which can generate an abnormal conveyance when the paper money sheet is held by the holding means 5.

These sensor means 300 detect the abnormality of the paper money sheet upon forward/rearward movement of the holding means 5 holding the paper money sheet within the frame 50 when the holding means 5 is stopped.

Then, the function of the sensor means 300 is best understood with reference to FIGS. 79 to 88.

The sensor means 300-*a* and 300-*b* detect the state where the paper money sheet is transferred between the holding means 5 and the associated component 310 by a change in the sensor means 300 during the movement of the holding means 5, that is, change in the light received by the light receiving element.

Figure 81:
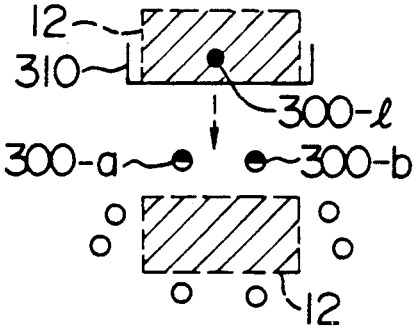

That is, when the paper money block 12 is taken out from the associated component 310 by the holding means 5, the sensor means 300-*a* and 300-*b* necessarily change from bright (no paper money) to dark (paper money is present) which is due to obstruction of light by the paper money, and again to bright (no paper money). However, upon a malfunctioning in the transfer of the paper money sheet, the following phenomena might be considered:

When the sensor means 300-*a* and 300-*b* are changed correctly but the sensor means 300-*l* on the associated component 310 is not changed and remains dark, the paper money sheets are judged to be separately left on the holding means 5 and the associated component 310 (FIG. 81).

Figure 82:
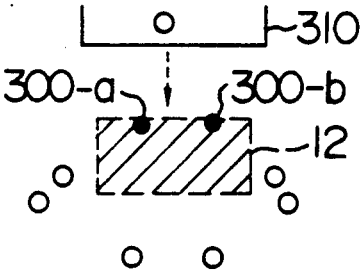

When the sensor means 300-*l* on the component 310 is changed to bright but the sensor means 300-*a* and 300-*b* are not changed and remain dark, incomplete extraction of the paper money sheets is judged (FIG. 82).

Figure 83:
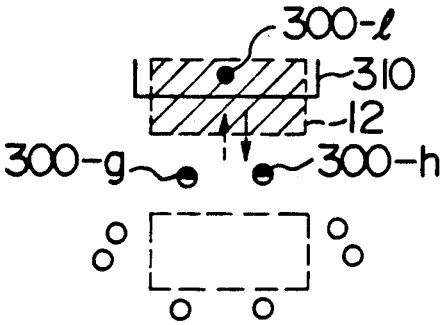

When the sensor means 300-*l* is changed to dark at the time of sending the paper money block 12 from the holding means 5 to the associated component 310 but the sensors 300-*a* and 300-*b* remain dark during the retraction of the holding means 5, an incomplete insertion of paper money sheets is judged (FIG. 83).

Figure 84:
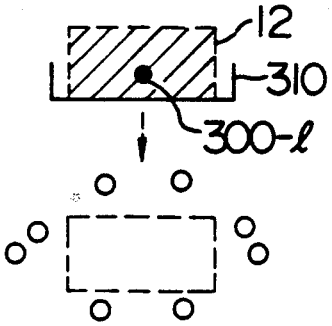

When the sensors 300-*a* and 300-*b* remain bright and the sensor 300-*l* is dark at the time of extracting the paper money block 12 from the associated component 310, it is judged that the paper money block 12 is not transferred to the holding means 5 (FIG. 84).

Figure 85:
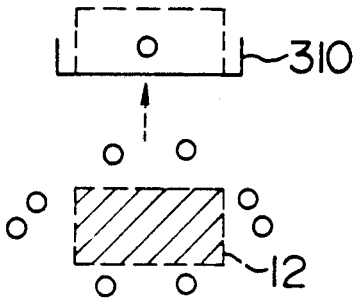

When the sensor means 300-*a* and 300-*b* are bright and the sensor means 300-*l* is also bright during a forward movement of the holding means 5 when the paper money block 12 in the holding means is to be transferred to the associated component 310, no transfer is judged (FIG. 85).

Figure 79:
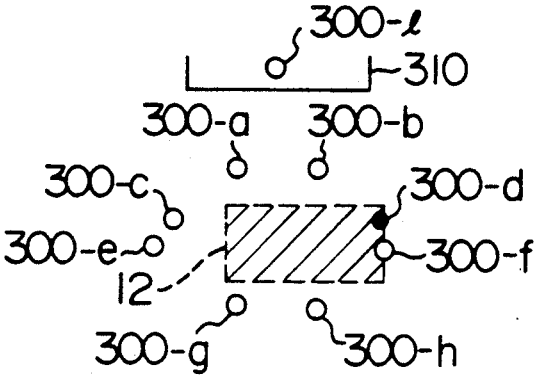
FIGS. 79 to 88 are schematic views illustrating the types of the abnormalities of the paper money.
Figure 80:
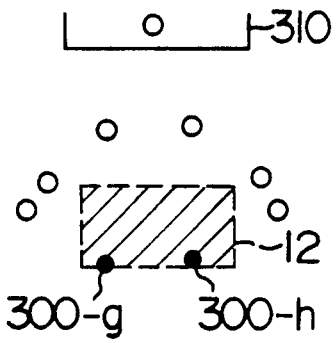
Figure 86:
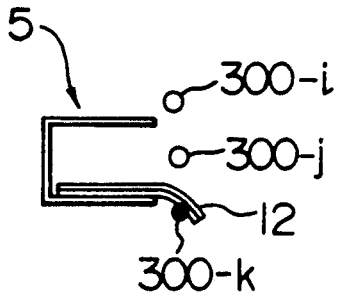
Figure 87:
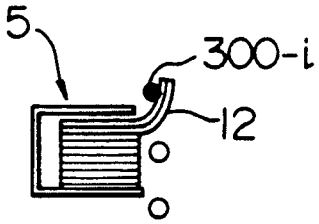
Figure 88:
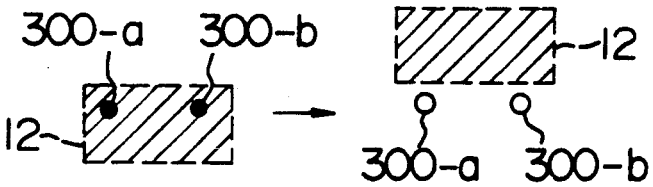

When the sensor means 300-*c*, 300-*d*, 300-*e* and 300-*f* are dark at the time when the holding means 5 holds the paper money block 12, it is judged that the paper money does not meet the correct passage (FIGS. 79 and 80). The sensor means 300-*c* and 300-*d* are used when the associated component 310 does not permit a large deflection of the paper money block 12, while the sensor means 300-*e* and 300-*f* are used when the associated component 310 admits a certain deflection. The sensor means 300-*i*, 300-*j* and 300-*k* are capable of detecting the hanging and undulation of the paper money (FIGS. 86 and 87). The sensor means 300-*i* is used in a case of a large quantity of the paper money, while the sensor means 300-*j* is used in a case of a small quantity of paper money. Sensor means 300-*a* and 300-*b* are used to detect whether or not the paper money has fallen during the vertical movement of the holding means. That is, when the sensor means 300-*a* and 300-*b* are changed from dark to bright after a certain time period has elapsed, a falling of the paper may occur (FIG. 88). FIG. 79 illustrates the lateral deflection of the paper money, while FIG. 80 illustrates rearward deflection of the paper money.

Then, the recovery action from the abnormal state will be described more fully hereinbelow.

Figure 89:
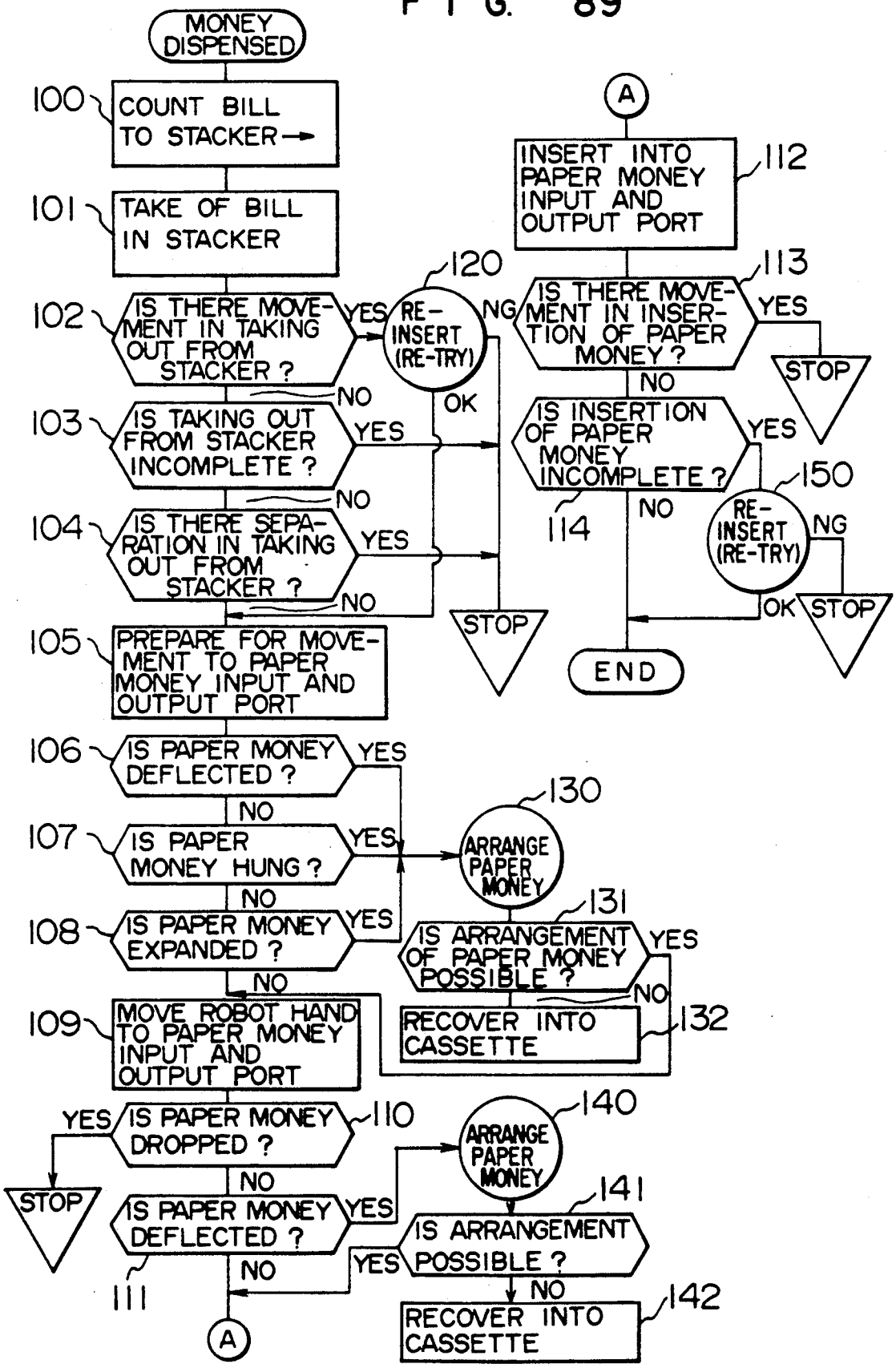
FIG. 89 is a flowchart of the abnormality recovery action in the money output action.

FIG. 89 illustrates a flow of the paper money to be dispensed. That is, when the paper money which has been counted and conveyed to the stacker is taken out by the holding means 5, it is determined whether or not the paper money has been transferred, incomplete extraction has occurred, and separation of the paper money sheets has occurred. If no movement is determined, re-extracting is performed. If the abnormality has not been overcome, the operation is stopped, while if the normal state is restored, the flow advances to the next step (steps 102 and 103 shown in FIG. 89). When incomplete extraction or separation of extracted money occur, the operation is stopped (steps 103 and 104).

Then, the holding means 5, holding the paper money, is moved to the money input and output port. Prior to this movement, it is detected whether or not there is a deflection of the paper money, hanging and undulation. If any one of these problems is detected, the paper money is arranged by a paper money arrangement mechanism (to be described later) mounted on the holding means 5, and the holding means 5 is then moved to the money input and output port (steps 106, 107, 108, 130, 109). After the paper money arrangement action has been completed, a sensor means detects whether or not the arrangement is complete. If it is detected that the arrangement is complete, the flow advances to step 109. If the arrangement is incomplete, the paper money is recovered in a cassette in step 132. The arrangement of the paper money is a primary countermeasure action for overcoming the abnormality and the recovery into the cassette is a secondary countermeasure to overcome the same. Then, it is determined whether or not the falling of the paper money has occurred during the movement of the holding means. If the falling is detected, the operation is stopped (step 110). Finally, when the paper money is sent to the money input and output port, the deflection of the paper money is inspected. If it is determined that the deflection of the paper money has occurred, the paper money arrangement is conducted and the paper money is sent to the money input and output port. At this time, if no movement of the paper money is detected, the operation is stopped (step 113). If an incomplete insertion is detected, a reinsertion is performed (steps 114, 150). After this paper money arrangement has been conducted, the primary and secondary countermeasure actions for overcoming the abnormalities are also conducted in a manner similar to the above-described steps 130–132.

Figure 90B:
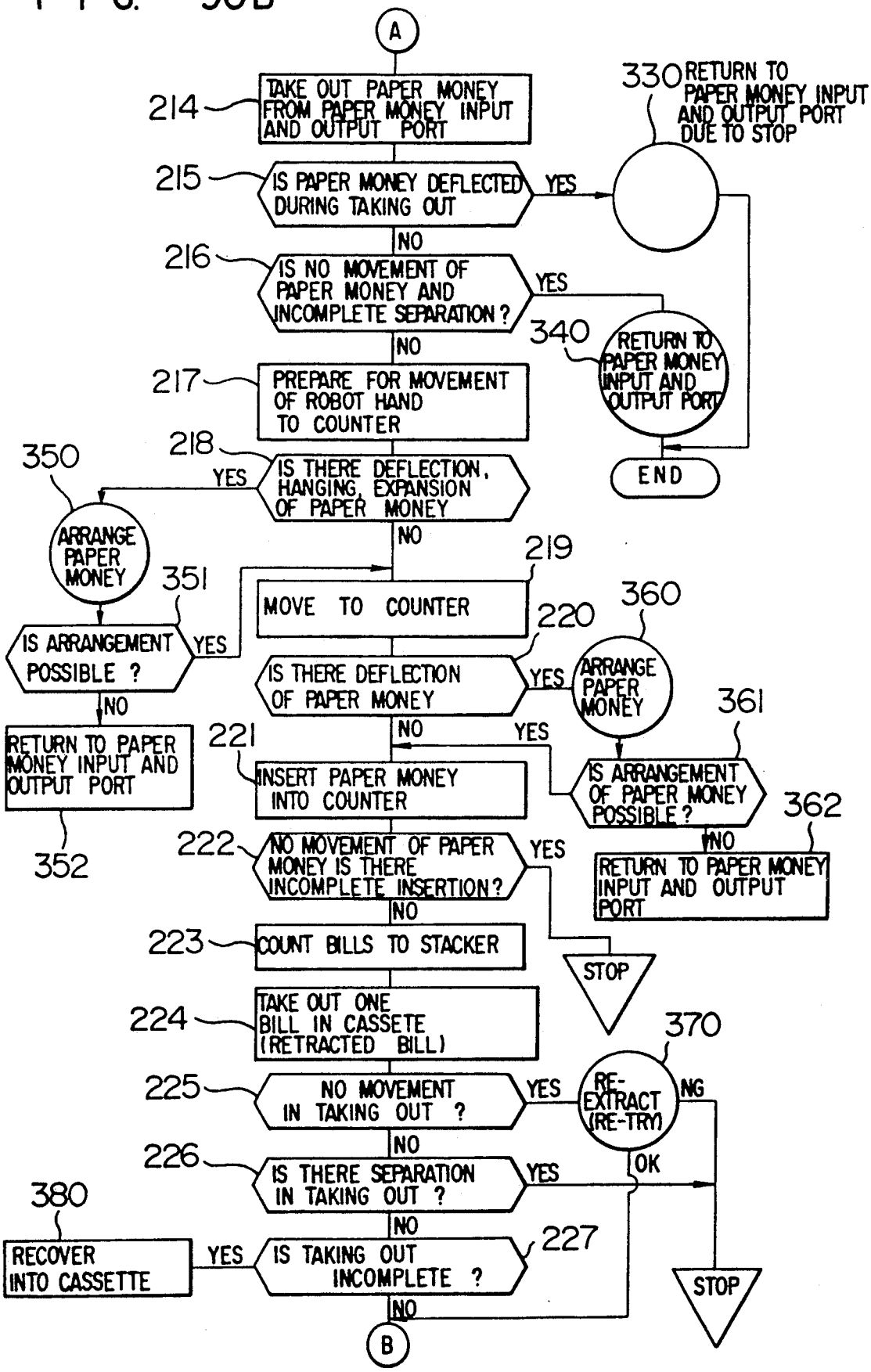
Figure 91A:
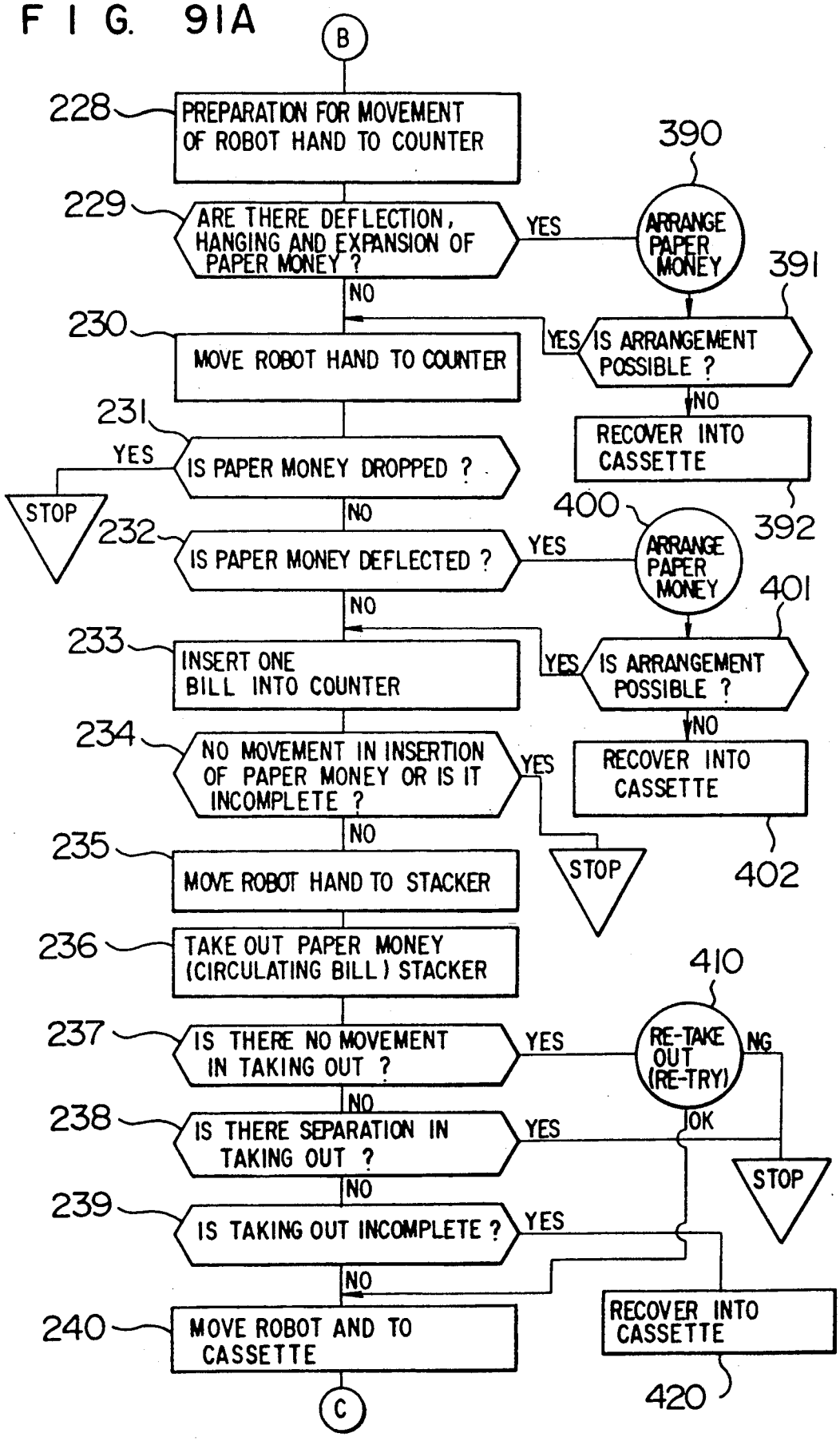
Figure 91B:
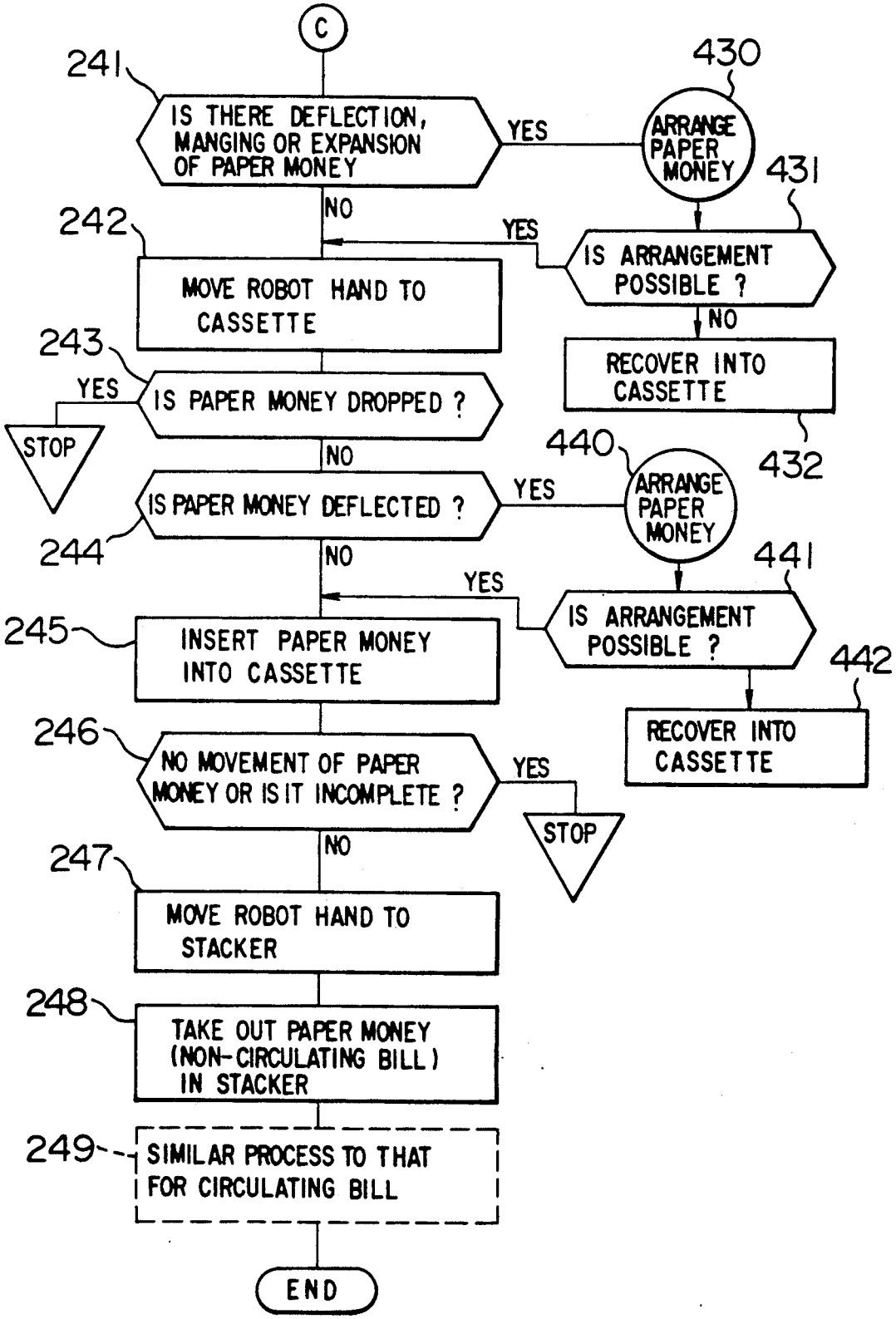

Then, abnormality recovery process at the time of inputting money will be described with reference to FIGS. 90 and 91. When the paper money is inputted, the money inputted by a user can be received and counted by extracting one bill to be dispensed from the money separating means. At this time, if the extracting movement is not detected, re-extracting is performed. If the abnormality has not been overcome as yet, the operation is stopped (steps 202, 300 shown in FIG. 90). When incomplete extraction or separation of extracted money is detected, the operation is also stopped (steps 203, 204). Then, if a deflection, hanging or undulation is detected prior to movement of the holding means to the cash box 9, the paper money arrangement is conducted (steps 206, 310).

After the holding means 5 has been moved to the cash box 9, whether or not there is a falling of paper money is detected. If a falling is detected, the operation is stopped (step 208). In a case where bills are inserted into the cash box 9, the paper money arrangement is conducted if the deflection of the paper money was detected prior to the insertion (step 209, 320). It is detected whether or not there is movement and incomplete insertion when the paper money is inserted, and if either of the above-described abnormalities is detected, the operation is stopped (step 211, 212). After completion of the steps 310 and 320, the countermeasure action similar to steps 130-132 are conducted.

Then, the holding means 5 is moved to the money input and output port where the paper money input by the user is taken out. During this, if any deflection is detected, the retraction of the holding means is stopped, and the latter is returned to the money input and output port (steps 215, 330). If no movement, separation or incomplete insertion was detected after retraction of the holding means, the holding means is returned to the money input and output port (steps 216, 240). Since the paper money input by the user may include defective bills, that is a crumpled or otherwise damaged bill, the apparatus is protected from problems caused by such defects. After the paper money has been normally received, it is sent to the counter at which the number of bills is counted before conveyance to the accumulating portion. After this counting, the bills retracted in the cash box are taken out so as to be returned to the separating portion 6. If no extraction movement is detected at this time, re-extracting is conducted (steps 225, 370). If an extraction separation is detected, the operation is stopped (step 226). If an incomplete insertion is detected, it is recovered into the cash box (steps 227, 380). After the paper money arrangement which is carried out separate from steps 218 and 220 has been completed, the paper money is returned to the money input and output port as a countermeasure to overcome the abnormality. Since the user is considered to have ownership of the paper money obtained through the money input and output port until the count is completed by the counter, the paper money is, as the final countermeasure action, returned to the money input and output port if the abnormality occurred. Then, the paper money inserted by the user is counted and divided into circulating bills and non-circulating bills before being accumulated in the accumulating portion.

When two types or denomination of bills are taken out by the holding means 5 so as to be accommodated in the cash box 9, processes consisting of detection of the abnormalities at the time of extracting of the paper money and the abnormality recovery action are conducted in accordance with the flow chart shown in FIGS. 90A, 90B and 91A, 91B.

Then, the relationship in the abnormality detection between the paper money detection sensor means and the associated components is shown in Table 92 wherein the circles represent a conducting of an abnormality detection.

FIG. 93 is a table which illustrates the contents of the abnormality recovery actions. That is, the relationship between the abnormality detection at the time of transportation of the paper money between the holding means and the associated components and the recovery actions is diagrammatically shown in FIG. 93.

As described above, since the state where the paper money is transported between the components and the holding means is detected by the sensor means 300, the abnormality recovery actions can be conducted in accordance with the type of the abnormality. As a result, total ratio of the trouble generation in the apparatus can be reduced.

Figure 94:
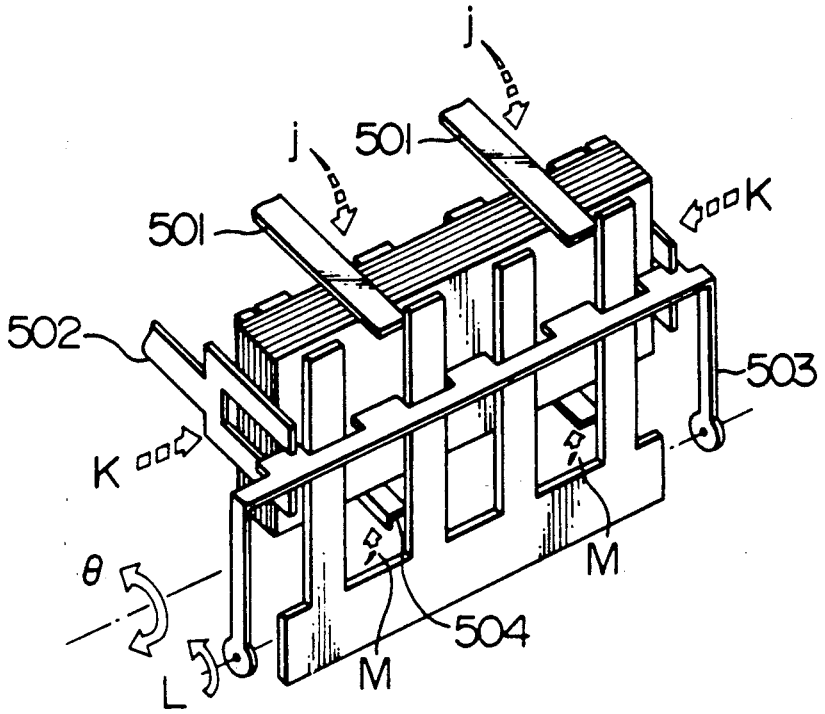
FIG. 94 is a perspective view of the operation of the paper money arranging mechanism.
Figure 95:
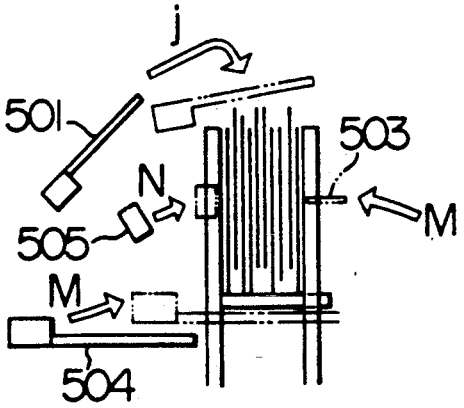
FIG. 95 is a side elevational view of the operation of the paper money arranging mechanism.

FIGS. 94 and 95 illustrate the paper money arrangement mechanism of a vertical type.

That is, reference numeral 501 represents a front retainer for arranging the end portion of the paper money by its movement in the direction designated by the arrow J, 502 represents a lateral arrangement plate for pushing the side surface of the paper money in the direction designated by an arrow k, 503 represents an upper retainer for pushing the upper surface of the paper money by its rotation in the direction designated by the arrow L, 504 represents a rear retainer for pushing the lower end portion of the paper money by its movement in the direction designated by an arrow M, and 505 represents a hanging stopper for preventing hanging of the paper money when lying horizontally.

According to the present invention, since any abnormalities to be generated between the components of the paper sheet depositing and dispensing apparatus and the holding means can be detected, a recovery action corresponding to the type of the abnormality can be conducted. As a result, the total rate of operational malfunctions in the apparatus can be reduced.

What is claimed is:

1. An automatic cashier utilizing deposited money sheets to be dispensed in a circulating manner, said automatic cashier comprising:

first accumulating means for accumulating a stack of money sheets to be dispensed;

second accumulating means for accumulating another stack of money sheets to be dispensed and money sheets which have been deposited;

means for selectively separating and feeding the money sheets accumulated by said first and second accumulating means;

discriminating means for discriminating the money sheets separated by said means for selectively separating and feeding the money sheets;

third accumulating means for accumulating a further stack of the money sheets discriminated by said discriminating means;

a money input and output port provided with fourth accumulating means for accumulating a still further stack of deposited money sheets and money sheets to be dispensed;

a cash box including first accommodating means for accommodating a still further stack of money sheets to be dispensed and money sheets which can be circulated, second accommodating means for accommodating yet another stack of money sheets to be dispensed, and third accommodating means for accommodating an additional stack of money sheets which money sheets are not to be circulated;

money sheet conveying means for conveying a plurality of money sheets from a first position adjacent one of said first, second, third and fourth accumulating means and said first, second and third accommodating means to a second position adjacent another one of said first, second, third and fourth accumulating means and said first, second and third accommodating means;

a separating member movably mounted on said conveying means and adapted to be driven, when said conveying means is in said first position, into an associated stack of money sheets to divide the stack into first and second parts with a gap formed therebetween;

money sheet gripping means movably mounted on said conveying means including two sets of gripping fingers extending in parallel relationship, said two sets of gripping fingers being movable towards and away from each other and moveable, when said conveying means is in said first position, to said stack of money sheets to grip said second part of said stack of money sheets, said gripping means being retractable together with the gripped second part of the money sheets;

holding means mounted on said conveying means and adapted to be moved, independently of said separating member and said gripping means, into said gap when said conveying means is in said first position to hold said first part of said stack of money sheets to thereby prevent the money sheets of said first part from being moved when said gripping means is retracted together with said second part of said money sheets; and means on said conveying means for independently driving said separating member, said gripping means and said holding means, wherein said conveying means is movable from said first position to said second position together with said separating member, said gripping means, said holding means and said driving means and the gripped second part of the money sheets.

2. An automatic cashier comprising:

first accumulating means for accumulating a stack of money sheets to be dispensed;

means for separating and feeding said money sheets accumulated by said first accumulating means;

means for discriminating the money sheets separated by said separating means;

second accumulating means for accumulating, on the basis of the result of the discrimination by said discriminating means, other stacks of the money sheets discriminated by said discriminating means;

a money input and output port provided with third accumulating means for accumulating a further stack of money sheets to be dispensed from the apparatus;

a cash box including means for accommodating still further stacks of money sheets to be dispensed, in accordance with predetermined types of money sheets;

money sheet conveying means for conveying a plurality of money sheets from a first position adjacent one of said first, second and third accumulating means and said cash box to a second position adjacent another one of said first, second and third accumulating means and said cash box;

a separating member movably mounted on said conveying means and adapted to be driven, when said conveying means is in said first position, into an associated stack of money sheets to divided the stack into first and second parts with a gap formed therebetween;

money sheet gripping means movably mounted on said conveying means including two sets of gripping fingers extending in parallel relationship, said two sets of gripping fingers being movable towards and away from each other and also movable, when said conveying means is in said first position, to said stack of money sheets to grip said second part of said stack of money sheets, said gripping means being retractable together with the gripped second part of the money sheets;

holding means mounted on said conveying means and adapted to be moved, independently of said separating member and said gripping means, into said gap when said conveying means is in said first position to hold said first part of said stack of money sheets to thereby prevent the money sheets of said first part from being moved when said gripping means is retracted together with said second part of said money sheets; and means on said conveying means for independently driving said separating member, said gripping means and said holding means, said conveying means being movable from said first position to said second position together with said separating member, said gripping means, said holding means and said driving means and the gripped second part of said stack of money sheets.

3. An abnormality recovery system for a paper sheet depositing and dispensing apparatus comprising:

a money sheet input and output port through which said paper sheets are deposited and/or dispensed;

a counter means for counting a number of said paper sheets;

accommodating means for accommodating said paper sheets; and a conveying means capable of moving in a predetermined sequential order between said paper money input and output port, said counter means, and said accommodating means and collectively conveying and receiving a plurality of said paper sheets, wherein said conveying means includes sensor means for detecting abnormal conditions of said paper sheets to be conveyed or deposited when said paper sheets are conveyed or deposited and enabling a recovery action in dependence upon the abnormal condition of the paper sheets detected by said sensor means and performing an ensuring action as a result of said recovery action.

4. An abnormality recovery system according to claim 3, wherein said sensor means rechecks the result of said recovery action and said conveying means effects a subsequent conveying on the basis of the result of the rechecking performed by said sensor means.

5. An abnormality recovery system according to claim 3, wherein said recovery action by said conveying means includes an arrangement of said paper sheets in dependence upon the detected abnormal conditions by said sensor means and an abnormality recovery action on the basis of a result of a second detection of an abnormal condition performed by said sensor means after said arrangement of said paper sheets.

6. An abnormality recovery system according to claim 3, wherein said recovery action by said conveying means includes a recovery retrial transferring action of said paper sheets in dependence upon the detected abnormal condition by said sensor means and an abnormality recovery action as a result of a second detection of an abnormal condition performed by said sensor means after said retrial transferring action.

7. An abnormality recovery system for a paper sheet depositing and dispensing apparatus comprising:

a paper sheet input and output port through which said paper sheets are deposited and/or dispensed;

counter means for counting a number of said paper sheets;

accommodating means for accommodating said paper sheets; and conveying means capable of moving in a predetermined sequential order between said input and output port, counter means and accommodating means and collectively conveying and receiving a plurality of said paper sheets, wherein said conveying means includes sensor means for detecting whether or not said paper sheets conveyed and/or received are abnormally positioned outside of an allowable region, and effecting a recovery action in dependence upon the detected position by said sensor means and performing an ensuring action as a result of said recovery action.

8. An abnormality recovery system according to claim 7, wherein said sensor means are disposed on said conveying means for determining said allowable region in dependence upon a width dimension of a transfer port of each of said input and output port, said counter means, said accommodating means and said conveying means.

9. An abnormality recovery system according to claim 8 wherein said sensor means includes a plurality of sets of sensors disposed on said conveying means for determining said allowable region.

10. An abnormality recovery system according to claim 7, wherein said sensor means are disposed on said conveying means for determining said allowable region in a direction in which said paper sheets are stacked.

11. An abnormality recovery system according to claim 10 wherein said sensor means includes a plurality of sensors disposed on said conveying means for determining a plurality of allowable regions in a direction in which said paper sheets are stacked.

12. An abnormality recovery system according to claim 7, wherein said recovery action by said conveyor means includes an arrangement of said paper sheets in dependence upon said detected position by said sensor means and an abnormality recovery action as a result of a second detection of a position of the paper sheets performed by said sensor means after said arrangement of said paper sheets.

13. An abnormality recovery system according to claim 7 wherein said conveying means includes recovery retrial transferring action of said paper sheets in dependence upon said detected position by said sensor means and an abnormality recovery action as a result of a second detection of a position of the paper sheets performed by said sensor means after said retrial transferring action.

14. A paper sheet handing apparatus comprising:

means for accumulating a stack of paper sheets including a first support member for supporting a stack of paper sheets and a second support member movable toward and away from said first support member and resiliently urging the stack of paper sheets against said first support member to cooperate therewith to resiliently sandwich said stack of paper sheets therebetween;

paper sheet conveying means movable between a first position adjacent said paper sheet accumulating means and at least one second position remote from said first position;

separating member movably mounted on said conveying means and adapted to be driven, when said conveying means is in said first position, into said stack of paper sheets to divide the stack into first and second parts with a gap formed therebetween, said second part being adjacent said second support member;

paper sheet gripping means movably mounted on said conveying means and including two sets of gripping fingers extending in a parallel relationship, said two sets of gripping fingers being movable toward and away from each other and also movable, when said conveying means is in said first position, to said stack of paper sheets to grip said second part of said stack of paper sheets, said gripping means being retractable together with the gripped second part of the paper sheets;

holding means mounted on said conveying means and adapted to be moved, independently of said separating member and said gripping means, into said gap when said conveying means is in said first position to cooperate with said first support member to hold said first part of said stack of paper sheets to thereby prevent the paper sheets from said first part from being moved when said gripping means has retracted together with said second part of said paper sheets; and means on said conveying means for independently driving said separating member, said gripping means and said holding means, said conveying means being movable from said first position to said at least one second position together with said separating member, said gripping means, said holding means, said driving means and the gripped second part of said stack of paper sheets.

15. A paper sheet handling apparatus according to claim 14, wherein said second support member includes grooves formed therein for accommodating the gripping fingers of one of said two sets of gripping fingers when said gripping fingers are moved to said stack of paper sheets.

16. A paper sheet handling apparatus according to claim 14, wherein said conveying means include sensor means for detecting an abnormal condition of the paper sheets to be transferred when said paper sheets are transferred, and wherein said conveying means is adapted to perform a recovery action in dependence upon a type of abnormal condition detected by said sensor means and then effect a subsequent handling action as a result of said recovery action.

17. A paper sheet handling apparatus according to claim 16, wherein said sensor means rechecks a result of said recovery action and said conveying means perform said subsequent handling action as a result of the rechecking performed by said sensor means.

18. A paper sheet handling apparatus according to claim 16, wherein said conveying means perform a recovery arrangement action for a recovery of a state of said paper sheets in dependence upon the abnormal condition detected by said sensor means and an abnormality recovery action as a result of a second abnormal condition detection performed by said sensor means after said recovery arrangement action.

19. A paper sheet handling apparatus according to claim 16, wherein said conveying means performs a recovery retrial transferring action for a recovery of a state of said paper sheets in dependence upon the abnormal condition detected by said sensor means and an abnormality recovery action as a result of a second abnormality detection performed by said sensor means after said retrial transferring action.

20. A paper sheet handling apparatus comprising:

a paper sheet input and output port means through which said paper sheets are received in and/or discharged from the apparatus;

means for counting a number of paper sheets received or to be discharged;

means for accommodating paper sheets; and conveying means for moving in a predetermined sequential order between said port means, said counting means and said accommodating means and collectively transferring a plurality of paper sheets, wherein said conveying means include sensor means for sensing whether or not the paper sheets to be transferred are positioned within an allowable region, said conveying means being adapted to perform a recovery action on the basis of a result of the sensing by said sensing means and a subsequent action in dependence upon the result of said recovery action.

21. A paper sheet handling apparatus according to claim 20, wherein said sensor means are so disposed on said conveying means as to said allowable region in dependence upon a dimensional width of a transfer port of each of said input and output port means, said counting means, said accommodating means and said conveying means.

22. A paper sheet handling apparatus according to claim 20, wherein said sensor means comprises a plurality of sets of sensors so disposed on said conveying means as to determine a plurality of such allowable regions on a basis of the width dimension of the transfer ports of said input and output port means, said counting means, said accommodating means and said conveying means.

23. A paper sheet handling apparatus according to claim 20, wherein said sensor means are so disposed on said conveying means as to determine said allowable region in a direction in which the paper sheets to be transferred are stacked.

24. A paper sheet handling apparatus according to claim 23, wherein said sensor means comprise a plurality of sets of sensors so disposed on said conveying means as to determine a plurality of allowable regions in a direction in which the paper sheets to be transferred are stacked.

25. A paper sheet handling apparatus according to claim 20, wherein said conveying means perform a recovery arranging action for the paper sheets to be transferred on the basis of the result of the sensing by said sensor means and an abnormality recovery action on the basis of an abnormal condition detection performed by said sensor means after said recovery arranging action.

26. A paper sheet handling apparatus according to claim 20, wherein said conveying means perform a recovery retrial transferring action for the paper sheets to be transferred on the basis of a result of the sensing by said sensor means and an abnormality condition detection performed by said sensor means after said retrial transferring action.

* * * * *